US011077415B2

(12) United States Patent
Yurkovetsky et al.

(10) Patent No.: US 11,077,415 B2
(45) **Date of Patent: *Aug. 3, 2021**

(54) METHODS FOR FORMING MIXED DROPLETS

(71) Applicant: Bio-Rad Laboratories, Inc., Hercules, CA (US)

(72) Inventors: Yevgeny Yurkovetsky, Winchester, MA (US); Darren Roy Link, Lexington, MA (US); Jonathan William Larson, Chelsea, MA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 41 days.

This patent is subject to a terminal disclaimer.

(21) Appl. No.: 16/181,256

(22) Filed: Nov. 5, 2018

(65) Prior Publication Data

US 2019/0134581 A1 May 9, 2019

Related U.S. Application Data

(63) Continuation of application No. 15/171,616, filed on Jun. 2, 2016, now Pat. No. 10,155,207, which is a (Continued)

(51) Int. Cl.
*B01L 3/00* (2006.01)
*B01F 13/00* (2006.01)
(Continued)

(52) U.S. Cl.
CPC ..... *B01F 13/0076* (2013.01); *B01F 3/0803* (2013.01); *B01F 3/0865* (2013.01);
(Continued)

(58) Field of Classification Search
CPC ..... B01F 3/0865; B01F 5/0085; B01L 2200/0673; B01L 2400/0487; B01L 3/502784
See application file for complete search history.

(56) References Cited

U.S. PATENT DOCUMENTS 2,097,692 A 11/1937 Fiegel
2,164,172 A 6/1939 Dalton
(Continued)

FOREIGN PATENT DOCUMENTS

AT 140025 T 7/1996
AT 140880 T 8/1996
(Continued)

OTHER PUBLICATIONS

Joo, 1999, Laboratory evolution of peroxide-mediated cytochrome P450 hydroxylaion, Nature 399:670.
(Continued)

*Primary Examiner* — Betty J Forman
(74) *Attorney, Agent, or Firm* — Brown Rudnick LLP; Thomas C. Meyers

(57) ABSTRACT

The invention generally relates to methods for forming mixed droplets. In certain embodiments, methods of the invention involve forming a droplet, and contacting the droplet with a fluid stream, wherein a portion of the fluid stream integrates with the droplet to form a mixed droplet.

12 Claims, 11 Drawing Sheets

Related U.S. Application Data continuation of application No. 13/371,222, filed on Feb. 10, 2012, now Pat. No. 9,364,803.

(60) Provisional application No. 61/441,985, filed on Feb. 11, 2011.

(51) Int. Cl.

| | |
|---|---|
| ***B01F 5/04*** | (2006.01) |
| ***B01L 7/00*** | (2006.01) |
| ***B01F 3/08*** | (2006.01) |
| ***B01F 5/00*** | (2006.01) |

(52) U.S. Cl.

CPC ..... *B01F 5/0085* (2013.01); *B01F 5/0471* (2013.01); *B01F 5/0473* (2013.01); *B01F 13/0062* (2013.01); *B01F 13/0071* (2013.01); *B01L 3/502784* (2013.01); *B01L 7/525* (2013.01); *B01F 2215/0037* (2013.01); *B01L 2200/0652* (2013.01); *B01L 2200/0673* (2013.01); *B01L 2300/0867* (2013.01); *B01L 2400/0415* (2013.01); *B01L 2400/0487* (2013.01)

(56) References Cited

U.S. PATENT DOCUMENTS 2,636,855 A 4/1953 Schwartz
2,656,508 A 10/1953 Coulter
2,692,800 A 10/1954 Nichols et al.
2,797,149 A 6/1957 Skeggs
2,879,141 A 3/1959 Skeggs
2,971,700 A 2/1961 Peeps
3,479,141 A 11/1969 Smythe et al.
3,608,821 A 9/1971 Simm et al.
3,621,059 A 11/1971 Bartlett
3,698,635 A 10/1972 Sickles
3,784,471 A 1/1974 Kaiser
3,816,331 A 6/1974 Brown, Jr. et al.
3,930,061 A 12/1975 Scharfenberger
3,960,187 A 6/1976 Stock et al.
3,980,541 A 9/1976 Aine
3,982,541 A 9/1976 L'Esperance, Jr.
4,014,469 A 3/1977 Sato
4,022,575 A 5/1977 Hansen et al.
4,034,966 A 7/1977 Suh et al.
4,059,552 A 11/1977 Zweigle et al.
4,091,042 A 5/1978 Alexanderson et al.
4,117,550 A 9/1978 Folland et al.
4,130,394 A 12/1978 Negersmith
4,210,809 A 7/1980 Pelavin
4,253,846 A 3/1981 Smythe et al.
4,266,721 A 5/1981 Sickles
4,279,345 A 7/1981 Allred
4,297,345 A 10/1981 Howarth
4,315,754 A 2/1982 Ruzicka et al.
4,378,957 A 4/1983 Malkin et al.
4,383,767 A 5/1983 Jido
4,439,980 A 4/1984 Biblarz et al.
4,508,265 A 4/1985 Jido
4,533,634 A 8/1985 Maldonado et al.
4,585,209 A 4/1986 Aine et al.
4,618,476 A 10/1986 Columbus
4,675,285 A 6/1987 Clark et al.
4,676,274 A 6/1987 Brown
4,683,195 A 7/1987 Mullis et al.
4,683,202 A 7/1987 Mullis
4,739,044 A 4/1988 Stabinsky
4,757,141 A 7/1988 Fung et al.
4,767,515 A 8/1988 Scott et al.
4,767,929 A 8/1988 Valentine
4,779,805 A 10/1988 Jackson et al.
4,795,330 A 1/1989 Noakes et al.
4,801,086 A 1/1989 Noakes
4,801,529 A 1/1989 Perlman
4,829,996 A 5/1989 Noakes et al.
4,853,336 A 8/1989 Saros et al.
4,856,363 A 8/1989 LaRocca et al.
4,859,363 A 8/1989 Davis et al.
4,865,444 A 9/1989 Green et al.
4,883,750 A 11/1989 Whiteley et al.
4,908,112 A 3/1990 Pace
4,931,225 A 6/1990 Cheng
4,941,959 A 7/1990 Scott
4,962,885 A 10/1990 Coffee
4,963,498 A 10/1990 Hillman et al.
4,981,580 A 1/1991 Auer
4,996,004 A 2/1991 Bucheler et al.
5,055,390 A 10/1991 Weaver et al.
5,091,652 A 2/1992 Mathies et al.
5,096,615 A 3/1992 Prescott et al.
5,104,813 A 4/1992 Besemer et al.
5,122,360 A 6/1992 Harris et al.
5,149,625 A 9/1992 Church et al.
5,180,662 A 1/1993 Sitkovsky
5,185,099 A 2/1993 Delpuech et al.
5,188,290 A 2/1993 Gebauer et al.
5,188,291 A 2/1993 Cross
5,192,659 A 3/1993 Simons
5,204,112 A 4/1993 Hope et al.
5,207,973 A 5/1993 Harris et al.
5,241,159 A 8/1993 Chatteriee et al.
5,260,466 A 11/1993 McGibbon
5,262,027 A 11/1993 Scott
5,270,163 A 12/1993 Gold et al.
5,296,375 A 3/1994 Kricka et al.
5,304,487 A 4/1994 Wilding et al.
5,310,653 A 5/1994 Hanausek-Walaszek et al.
5,313,009 A 5/1994 Guenkel et al.
5,333,675 A 8/1994 Mullis et al.
5,344,594 A 9/1994 Sheridon
5,354,670 A 10/1994 Nickoloff et al.
5,376,252 A 12/1994 Ekstrom et al.
5,378,957 A 1/1995 Kelly
5,397,605 A 3/1995 Barbieri et al.
5,399,461 A 3/1995 Van et al.
5,399,491 A 3/1995 Kacian et al.
5,403,617 A 4/1995 Haaland
5,413,924 A 5/1995 Kosak et al.
5,417,235 A 5/1995 Wise et al.
5,427,946 A 6/1995 Kricka et al.
5,445,934 A 8/1995 Fodor et al.
5,452,878 A 9/1995 Gravesen et al.
5,452,955 A 9/1995 Lundstrom
5,454,472 A 10/1995 Benecke et al.
5,460,945 A 10/1995 Springer et al.
5,468,613 A 11/1995 Erlich et al.
5,475,096 A 12/1995 Gold et al.
5,475,610 A 12/1995 Atwood et al.
5,480,614 A 1/1996 Kamahori
5,486,335 A 1/1996 Wilding et al.
5,498,392 A 3/1996 Wilding et al.
5,498,523 A 3/1996 Tabor et al.
5,500,415 A 3/1996 Dollat et al.
5,503,851 A 4/1996 Mank et al.
5,512,131 A 4/1996 Kumar et al.
5,516,635 A 5/1996 Ekins et al.
5,518,709 A 5/1996 Sutton et al.
5,523,162 A 6/1996 Franz et al.
5,587,128 A 12/1996 Wilding et al.
5,589,136 A 12/1996 Northrup et al.
5,602,756 A 2/1997 Atwood et al.
5,604,097 A 2/1997 Brenner
5,610,016 A 3/1997 Sato et al.
5,612,188 A 3/1997 Shuler et al.
5,616,478 A 4/1997 Chetverin et al.
5,617,997 A 4/1997 Kobayashi et al.
5,635,358 A 6/1997 Wilding et al.
5,636,400 A 6/1997 Young
5,641,658 A 6/1997 Adams et al.
5,643,729 A 7/1997 Taniguchi et al.
5,655,517 A 8/1997 Coffee
5,656,155 A 8/1997 Norcross et al.

(56) References Cited

U.S. PATENT DOCUMENTS 5,656,493 A 8/1997 Mullis et al.
5,661,222 A 8/1997 Hare
5,662,874 A 9/1997 David
5,670,325 A 9/1997 Lapidus et al.
5,681,600 A 10/1997 Antinone et al.
5,695,934 A 12/1997 Brenner
5,726,026 A 3/1998 Wilding et al.
5,726,404 A 3/1998 Brody
5,733,526 A 3/1998 Trevino et al.
5,739,036 A 4/1998 Parris
5,744,366 A 4/1998 Kricka et al.
5,750,988 A 5/1998 Apffel et al.
5,762,775 A 6/1998 DePaoli
5,779,868 A 7/1998 Parce et al.
5,783,431 A 7/1998 Peterson et al.
5,789,206 A 8/1998 Tavtigian et al.
5,840,506 A 11/1998 Giordano
5,846,719 A 12/1998 Brenner et al.
5,849,491 A 12/1998 Radomski et al.
5,851,769 A 12/1998 Gray et al.
5,858,187 A 1/1999 Ramsey et al.
5,858,655 A 1/1999 Arnold
5,858,670 A 1/1999 Lam et al.
5,863,722 A 1/1999 Brenner
5,868,322 A 2/1999 Loucks
5,872,010 A 2/1999 Karger et al.
5,876,771 A 3/1999 Sizer et al.
5,880,071 A 3/1999 Parce et al.
5,882,680 A 3/1999 Suzuki et al.
5,882,856 A 3/1999 Shuber
5,884,846 A 3/1999 Tan
5,887,755 A 3/1999 Hood, III
5,888,746 A 3/1999 Tabiti et al.
5,888,778 A 3/1999 Shuber
5,904,933 A 5/1999 Riess et al.
5,921,678 A 7/1999 Desai et al.
5,927,852 A 7/1999 Serafin
5,928,870 A 7/1999 Lapidus et al.
5,932,100 A 8/1999 Yager et al.
5,935,331 A 8/1999 Naka et al.
5,942,056 A 8/1999 Singh
5,942,443 A 8/1999 Parce et al.
5,958,203 A 9/1999 Parce et al.
5,972,187 A 10/1999 Parce et al.
5,980,936 A 11/1999 Krafft et al.
5,989,815 A 11/1999 Skolnick et al.
5,989,892 A 11/1999 Nishimaki et al.
5,995,341 A 11/1999 Tanaka et al.
5,997,636 A 12/1999 Gamarnik et al.
6,008,003 A 12/1999 Haak-Frendscho et al.
6,023,540 A 2/2000 Walt et al.
6,028,066 A 2/2000 Unger
6,042,709 A 3/2000 Parce et al.
6,045,755 A 4/2000 Lebl et al.
6,046,056 A 4/2000 Parce et al.
6,048,551 A 4/2000 Hilfinger et al.
6,048,690 A 4/2000 Heller et al.
6,068,199 A 5/2000 Coffee
6,074,879 A 6/2000 Zelmanovic et al.
6,080,295 A 6/2000 Parce et al.
6,086,740 A 7/2000 Kennedy
6,096,495 A 8/2000 Kasai et al.
6,103,537 A 8/2000 Ullman et al.
6,105,571 A 8/2000 Coffee
6,105,877 A 8/2000 Coffee
6,107,059 A 8/2000 Hart
6,116,516 A 9/2000 Ganan-Calvo
6,118,849 A 9/2000 Tanimori et al.
6,119,953 A 9/2000 Ganan-Calvo et al.
6,120,666 A 9/2000 Jacobson et al.
6,124,388 A 9/2000 Takai et al.
6,124,439 A 9/2000 Friedman et al.
6,130,052 A 10/2000 Van Baren et al.
6,130,098 A 10/2000 Handique et al.
6,137,214 A 10/2000 Raina
6,138,077 A 10/2000 Brenner
6,139,303 A 10/2000 Reed et al.
6,140,053 A 10/2000 Koster
6,143,496 A 11/2000 Brown et al.
6,146,828 A 11/2000 Lapidus et al.
6,149,789 A 11/2000 Benecke et al.
6,150,180 A 11/2000 Parce et al.
6,150,516 A 11/2000 Brenner et al.
6,155,710 A 12/2000 Nakajima et al.
6,162,421 A 12/2000 Ordino et al.
6,165,778 A 12/2000 Kedar
6,171,796 B1 1/2001 An et al.
6,171,850 B1 1/2001 Nagle et al.
6,172,214 B1 1/2001 Brenner
6,172,218 B1 1/2001 Brenner
6,174,160 B1 1/2001 Lee et al.
6,174,469 B1 1/2001 Gatian-Calvo
6,177,479 B1 1/2001 Nakajima
6,180,372 B1 1/2001 Franzen
6,184,012 B1 2/2001 Neri et al.
6,187,214 B1 2/2001 Ganan-Calvo
6,189,803 B1 2/2001 Ganan-Calvo
6,196,525 B1 3/2001 Ganan-Calvo
6,197,335 B1 3/2001 Sherman
6,197,835 B1 3/2001 Ganan-Calvo
6,203,993 B1 3/2001 Shuber et al.
6,207,372 B1 3/2001 Shuber
6,207,397 B1 3/2001 Lynch et al.
6,210,396 B1 4/2001 MacDonald et al.
6,210,891 B1 4/2001 Nyren et al.
6,210,896 B1 4/2001 Chan
6,214,558 B1 4/2001 Shuber et al.
6,221,654 B1 4/2001 Quake et al.
6,227,466 B1 5/2001 Hartman et al.
6,234,402 B1 5/2001 Ganan-Calvo
6,235,383 B1 5/2001 Hong et al.
6,235,475 B1 5/2001 Brenner et al.
6,241,159 B1 6/2001 Ganan-Calvo et al.
6,243,373 B1 6/2001 Turock
6,248,378 B1 6/2001 Ganan-Calvo
6,251,661 B1 6/2001 Urabe et al.
6,252,129 B1 6/2001 Coffee
6,258,568 B1 7/2001 Nyren
6,258,858 B1 7/2001 Nakajima et al.
6,261,797 B1 7/2001 Sorge et al.
6,263,222 B1 7/2001 Diab et al.
6,266,459 B1 7/2001 Walt et al.
6,267,353 B1 7/2001 Friedline et al.
6,267,858 B1 7/2001 Parce et al.
6,268,152 B1 7/2001 Fodor et al.
6,268,165 B1 7/2001 O'Brien
6,268,222 B1 7/2001 Chandler et al.
6,274,320 B1 8/2001 Rothberg et al.
6,274,337 B1 8/2001 Parce et al.
6,280,948 B1 8/2001 Guilfoyle et al.
6,292,756 B1 9/2001 Lievois et al.
6,294,344 B1 9/2001 O'Brien
6,296,020 B1 10/2001 McNeely et al.
6,296,673 B1 10/2001 Santarsiero et al.
6,299,145 B1 10/2001 Ganan-Calvo
6,301,055 B1 10/2001 Legrand et al.
6,306,659 B1 10/2001 Parce et al.
6,310,354 B1 10/2001 Hanninen et al.
6,310,653 B1 10/2001 Malcolm, Jr. et al.
6,316,208 B1 11/2001 Roberts et al.
6,316,213 B1 11/2001 O'Brien
6,318,640 B1 11/2001 Coffee
6,326,145 B1 12/2001 Whitcombe et al.
6,336,463 B1 1/2002 Ohta
6,344,325 B1 2/2002 Quake et al.
6,352,828 B1 3/2002 Brenner
6,355,193 B1 3/2002 Stott
6,355,198 B1 3/2002 Kim et al.
6,357,670 B2 3/2002 Ganan-Calvo
6,386,463 B1 5/2002 Ganan-Calvo
6,391,559 B1 5/2002 Brown et al.
6,394,429 B2 5/2002 Ganan-Calvo
6,399,339 B1 6/2002 Wolberg et al.
6,399,389 B1 6/2002 Parce et al.

(56) References Cited

U.S. PATENT DOCUMENTS

| | | | |
|---|---|---|---|
| 6,403,373 | B1 | 6/2002 | Scanlan et al. |
| 6,405,936 | B1 | 6/2002 | Ganan-Calvo |
| 6,408,878 | B2 | 6/2002 | Unger et al. |
| 6,409,832 | B2 | 6/2002 | Weigl et al. |
| 6,429,025 | B1 | 8/2002 | Parce et al. |
| 6,429,148 | B1 | 8/2002 | Chu et al. |
| 6,432,143 | B2 | 8/2002 | Kubiak et al. |
| 6,432,148 | B1 | 8/2002 | Ganan-Calvo |
| 6,432,630 | B1 | 8/2002 | Blankenstein |
| 6,439,103 | B1 | 8/2002 | Miller |
| 6,440,706 | B1 | 8/2002 | Vogelstein et al. |
| 6,440,760 | B1 | 8/2002 | Cho et al. |
| 6,450,139 | B1 | 9/2002 | Watanabe |
| 6,450,189 | B1 | 9/2002 | Ganan-Calvo |
| 6,454,193 | B1 | 9/2002 | Busick et al. |
| 6,464,336 | B1 | 10/2002 | Sharma |
| 6,464,886 | B2 | 10/2002 | Ganan-Calvo |
| 6,475,441 | B1 | 11/2002 | Parce et al. |
| 6,481,648 | B1 | 11/2002 | Zimmermann |
| 6,489,103 | B1 | 12/2002 | Griffiths et al. |
| 6,503,933 | B1 | 1/2003 | Moloney et al. |
| 6,506,609 | B1 | 1/2003 | Wada et al. |
| 6,508,988 | B1 | 1/2003 | Van Dam et al. |
| 6,511,803 | B1 | 1/2003 | Church et al. |
| 6,520,425 | B1 | 2/2003 | Reneker |
| 6,524,456 | B1 | 2/2003 | Ramsey et al. |
| 6,540,395 | B2 | 4/2003 | Muhlbauer et al. |
| 6,540,895 | B1 | 4/2003 | Spence et al. |
| 6,551,836 | B1 | 4/2003 | Chow et al. |
| 6,553,944 | B1 | 4/2003 | Allen et al. |
| 6,553,960 | B1 | 4/2003 | Yoshikawa et al. |
| 6,554,202 | B2 | 4/2003 | Ganan-Calvo |
| 6,557,334 | B2 | 5/2003 | Jager |
| 6,557,834 | B2 | 5/2003 | Ganan-Calvo |
| 6,558,944 | B1 | 5/2003 | Parce et al. |
| 6,558,960 | B1 | 5/2003 | Parce et al. |
| 6,560,030 | B2 | 5/2003 | Legrand et al. |
| 6,565,010 | B2 | 5/2003 | Anderson et al. |
| 6,569,631 | B1 | 5/2003 | Pantoliano et al. |
| 6,576,420 | B1 | 6/2003 | Carson et al. |
| 6,591,852 | B1 | 7/2003 | McNeely et al. |
| 6,592,321 | B2 | 7/2003 | Bonker et al. |
| 6,592,821 | B1 | 7/2003 | Wada et al. |
| 6,601,613 | B2 | 8/2003 | McNeely et al. |
| 6,608,726 | B2 | 8/2003 | Legrand et al. |
| 6,610,499 | B1 | 8/2003 | Fulwyler et al. |
| 6,614,598 | B1 | 9/2003 | Quake et al. |
| 6,627,603 | B1 | 9/2003 | Bibette et al. |
| 6,630,006 | B2 | 10/2003 | Santarsiero et al. |
| 6,630,353 | B1 | 10/2003 | Parce et al. |
| 6,632,619 | B1 | 10/2003 | Harrison et al. |
| 6,637,463 | B1 | 10/2003 | Lei et al. |
| 6,638,749 | B1 | 10/2003 | Beckman et al. |
| 6,645,432 | B1 | 11/2003 | Anderson et al. |
| 6,646,253 | B1 | 11/2003 | Rohwer et al. |
| 6,653,626 | B2 | 11/2003 | Fischer et al. |
| 6,656,267 | B2 | 12/2003 | Newman |
| 6,659,370 | B1 | 12/2003 | Inoue |
| 6,660,252 | B2 | 12/2003 | Matathia et al. |
| 6,670,142 | B2 | 12/2003 | Lau et al. |
| 6,679,441 | B1 | 1/2004 | Borra et al. |
| 6,680,178 | B2 | 1/2004 | Harris et al. |
| 6,682,890 | B2 | 1/2004 | Mack et al. |
| 6,717,136 | B2 | 4/2004 | Andersson et al. |
| 6,729,561 | B2 | 5/2004 | Hirae et al. |
| 6,738,502 | B1 | 5/2004 | Coleman et al. |
| 6,739,036 | B2 | 5/2004 | Koike et al. |
| 6,744,046 | B2 | 6/2004 | Valaskovic et al. |
| 6,752,922 | B2 | 6/2004 | Huang et al. |
| 6,753,147 | B2 | 6/2004 | Vogelstein et al. |
| 6,766,817 | B2 | 7/2004 | da Silva |
| 6,767,194 | B2 | 7/2004 | Jeon et al. |
| 6,767,704 | B2 | 7/2004 | Waldman et al. |
| 6,790,328 | B2 | 9/2004 | Jacobson et al. |
| 6,793,753 | B2 | 9/2004 | Unger et al. |
| 6,797,056 | B2 | 9/2004 | David |
| 6,800,849 | B2 | 10/2004 | Staats |
| 6,806,058 | B2 | 10/2004 | Jesperson et al. |
| 6,808,382 | B2 | 10/2004 | Lanfranchi |
| 6,808,882 | B2 | 10/2004 | Griffiths et al. |
| 6,814,980 | B2 | 11/2004 | Levy et al. |
| 6,818,395 | B1 | 11/2004 | Quake et al. |
| 6,832,787 | B1 | 12/2004 | Renzi |
| 6,833,242 | B2 | 12/2004 | Quake et al. |
| 6,841,350 | B2 | 1/2005 | Ogden et al. |
| 6,872,250 | B2 | 3/2005 | David et al. |
| 6,890,487 | B1 | 5/2005 | Sklar et al. |
| 6,897,018 | B1 | 5/2005 | Yuan et al. |
| 6,905,844 | B2 | 6/2005 | Kim |
| 6,918,404 | B2 | 7/2005 | Dias da Silva |
| 6,926,313 | B1 | 8/2005 | Renzi |
| 6,935,768 | B2 | 8/2005 | Lowe et al. |
| 6,936,417 | B2 | 8/2005 | Orntoft |
| 6,942,978 | B1 | 9/2005 | O'Brien |
| 6,949,342 | B2 | 9/2005 | Golub et al. |
| 6,960,437 | B2 | 11/2005 | Enzelberger et al. |
| 6,964,847 | B1 | 11/2005 | Englert |
| 6,974,667 | B2 | 12/2005 | Horne et al. |
| 6,998,232 | B1 | 2/2006 | Feinstein et al. |
| 7,022,472 | B2 | 4/2006 | Robbins et al. |
| 7,041,481 | B2 | 5/2006 | Anderson et al. |
| 7,049,072 | B2 | 5/2006 | Seshi |
| 7,056,674 | B2 | 6/2006 | Baker et al. |
| 7,057,026 | B2 | 6/2006 | Barnes et al. |
| 7,066,586 | B2 | 6/2006 | da Silva |
| 7,068,874 | B2 | 6/2006 | Wang et al. |
| 7,078,180 | B2 | 7/2006 | Genetta |
| 7,081,192 | B1 | 7/2006 | Wang et al. |
| 7,081,340 | B2 | 7/2006 | Baker et al. |
| 7,090,983 | B1 | 8/2006 | Muramatsu et al. |
| 7,115,230 | B2 | 10/2006 | Sundararajan |
| 7,118,910 | B2 | 10/2006 | Unger et al. |
| 7,129,091 | B2 | 10/2006 | Ismagilov et al. |
| 7,138,233 | B2 | 11/2006 | Griffiths et al. |
| 7,153,700 | B1 | 12/2006 | Pardee et al. |
| 7,156,917 | B2 | 1/2007 | Moriyama et al. |
| 7,163,801 | B2 | 1/2007 | Reed |
| 7,169,560 | B2 | 1/2007 | Lapidus et al. |
| 7,171,311 | B2 | 1/2007 | Dai et al. |
| 7,198,899 | B2 | 4/2007 | Schleyer et al. |
| 7,204,431 | B2 | 4/2007 | Li et al. |
| 7,229,770 | B1 | 6/2007 | Price et al. |
| 7,252,943 | B2 | 8/2007 | Griffiths et al. |
| 7,267,938 | B2 | 9/2007 | Anderson et al. |
| 7,268,167 | B2 | 9/2007 | Higuchi et al. |
| 7,282,337 | B1 | 10/2007 | Harris |
| 7,291,462 | B2 | 11/2007 | O'Brien et al. |
| 7,294,503 | B2 | 11/2007 | Quake et al. |
| 7,300,765 | B2 | 11/2007 | Patel |
| 7,308,364 | B2 | 12/2007 | Shaughnessy et al. |
| 7,314,721 | B2 | 1/2008 | Gure et al. |
| 7,316,906 | B2 | 1/2008 | Chiorazzi et al. |
| 7,323,305 | B2 | 1/2008 | Leamon |
| 7,326,529 | B2 | 2/2008 | Ali et al. |
| 7,332,280 | B2 | 2/2008 | Levy et al. |
| 7,332,590 | B2 | 2/2008 | Nacht et al. |
| 7,341,211 | B2 | 3/2008 | Ganan Calvo et al. |
| 7,348,142 | B2 | 3/2008 | Wang |
| 7,358,231 | B1 | 4/2008 | McCaffey et al. |
| 7,361,474 | B2 | 4/2008 | Siegler |
| 7,364,862 | B2 | 4/2008 | Ali et al. |
| 7,368,255 | B2 | 5/2008 | Bae et al. |
| 7,378,233 | B2 | 5/2008 | Sidransky et al. |
| 7,378,280 | B2 | 5/2008 | Quake et al. |
| 7,390,463 | B2 | 6/2008 | He et al. |
| 7,393,634 | B1 | 7/2008 | Ahuja et al. |
| 7,393,665 | B2 | 7/2008 | Brenner |
| 7,416,851 | B2 | 8/2008 | Davi et al. |
| 7,429,467 | B2 | 9/2008 | Holliger et al. |
| 7,432,064 | B2 | 10/2008 | Salceda et al. |
| 7,442,507 | B2 | 10/2008 | Polsky et al. |
| 7,449,303 | B2 | 11/2008 | Coignet |
| 7,468,271 | B2 | 12/2008 | Golovchenko et al. |
| 7,473,530 | B2 | 1/2009 | Huttemann |

(56) References Cited

U.S. PATENT DOCUMENTS 7,473,531 B1 1/2009 Domon et al.
7,476,506 B2 1/2009 Schleyer et al.
7,479,370 B2 1/2009 Coignet
7,479,371 B2 1/2009 Ando et al.
7,479,376 B2 1/2009 Waldman et al.
7,482,129 B2 1/2009 Soyupak et al.
7,501,244 B2 3/2009 Reinhard et al.
7,504,214 B2 3/2009 Erlander et al.
7,507,532 B2 3/2009 Chang et al.
7,507,541 B2 3/2009 Raitano et al.
7,510,707 B2 3/2009 Platica et al.
7,510,842 B2 3/2009 Podust et al.
7,514,209 B2 4/2009 Dai et al.
7,514,210 B2 4/2009 Holliger et al.
7,524,633 B2 4/2009 Sidransky
7,527,933 B2 5/2009 Sahin et al.
7,537,897 B2 5/2009 Brenner et al.
7,541,383 B2 6/2009 Fu et al.
7,544,473 B2 6/2009 Brenner
7,556,776 B2 7/2009 Fraden et al.
7,582,446 B2 9/2009 Griffiths et al.
7,595,195 B2 9/2009 Lee et al.
7,604,938 B2 10/2009 Takahashi et al.
7,622,081 B2 11/2009 Chou et al.
7,632,562 B2 12/2009 Nair et al.
7,635,562 B2 12/2009 Harris et al.
7,638,276 B2 12/2009 Griffiths et al.
7,655,435 B2 2/2010 Holliger et al.
7,655,470 B2 2/2010 Ismagilov et al.
7,666,593 B2 2/2010 Lapidus
7,691,576 B2 4/2010 Holliger et al.
7,698,287 B2 4/2010 Becker et al.
7,708,949 B2 5/2010 Stone et al.
7,718,578 B2 5/2010 Griffiths et al.
7,736,890 B2 6/2010 Sia et al.
7,741,130 B2 6/2010 Lee, Jr. et al.
RE41,780 E 9/2010 Anderson et al.
7,814,175 B1 10/2010 Chang et al.
7,824,889 B2 11/2010 Vogelstein et al.
7,888,017 B2 2/2011 Quake et al.
7,897,044 B2 3/2011 Hoyos et al.
7,897,341 B2 3/2011 Griffiths et al.
7,901,939 B2 3/2011 Ismagliov et al.
7,915,015 B2 3/2011 Vogelstein et al.
7,968,287 B2 6/2011 Griffiths et al.
7,990,525 B2 8/2011 Kanda
8,012,382 B2 9/2011 Kim et al.
8,067,159 B2 11/2011 Brown et al.
8,153,402 B2 4/2012 Holliger et al.
8,252,539 B2 8/2012 Quake et al.
8,257,925 B2 9/2012 Brown et al.
8,278,071 B2 10/2012 Brown et al.
8,278,711 B2 10/2012 Rao et al.
8,318,434 B2 11/2012 Cuppens
8,337,778 B2 12/2012 Stone et al.
8,436,993 B2 5/2013 Kaduchak et al.
8,462,269 B2 6/2013 Cheng et al.
8,528,589 B2 9/2013 Miller et al.
8,535,889 B2 9/2013 Larson et al.
8,592,221 B2 11/2013 Fraden et al.
8,673,595 B2 3/2014 Nakamura et al.
8,715,934 B2 5/2014 Diehl et al.
8,765,485 B2 7/2014 Link et al.
8,772,046 B2 7/2014 Fraden et al.
8,871,444 B2 10/2014 Griffiths et al.
9,029,083 B2 5/2015 Griffiths et al.
9,029,085 B2 5/2015 Agresti et al.
9,186,643 B2 11/2015 Griffiths et al.
9,364,803 B2 * 6/2016 Yurkovetsky ..... B01F 5/0471
9,448,172 B2 9/2016 Griffiths et al.
9,789,482 B2 * 10/2017 Link ..... B01F 5/0655
9,816,121 B2 11/2017 Agresti et al.
9,839,890 B2 12/2017 Griffiths et al.
9,857,202 B2 1/2018 Seki
9,919,277 B2 3/2018 Griffiths et al.
9,925,501 B2 3/2018 Griffiths et al.
9,944,977 B2 4/2018 Link et al.
10,144,950 B2 12/2018 Nolan
10,151,698 B2 12/2018 Griffiths et al.
10,155,207 B2 * 12/2018 Yurkovetsky ..... B01F 5/0471
10,357,772 B2 7/2019 Fraden et al.
10,526,605 B2 1/2020 Liu et al.
10,584,332 B2 3/2020 Samuels et al.
10,596,541 B2 3/2020 Weitz et al.
10,612,081 B2 4/2020 Hutchison et al.
10,633,652 B2 4/2020 Link et al.
10,639,597 B2 5/2020 Link et al.
10,639,598 B2 5/2020 Griffiths et al.
10,675,626 B2 6/2020 Fraden et al.
2001/0010338 A1 8/2001 Ganan-Calvo
2001/0020011 A1 9/2001 Mathiowitz et al.
2001/0023078 A1 9/2001 Bawendi et al.
2001/0029983 A1 10/2001 Unger et al.
2001/0034025 A1 10/2001 Modlin et al.
2001/0034031 A1 10/2001 Short et al.
2001/0041343 A1 11/2001 Pankowsky
2001/0041344 A1 11/2001 Sepetov et al.
2001/0041357 A1 11/2001 Fouillet et al.
2001/0042793 A1 11/2001 Ganan-Calvo
2001/0048900 A1 12/2001 Bardell et al.
2001/0050881 A1 12/2001 Depaoli et al.
2002/0004532 A1 1/2002 Matathia et al.
2002/0005354 A1 1/2002 Spence et al.
2002/0008028 A1 1/2002 Jacobson et al.
2002/0012971 A1 1/2002 Mehta
2002/0015997 A1 2/2002 Lafferty
2002/0022038 A1 2/2002 Biatry et al.
2002/0022261 A1 2/2002 Anderson et al.
2002/0033422 A1 3/2002 Ganan-Calvo
2002/0034737 A1 3/2002 Drmanac
2002/0036018 A1 3/2002 McNeely et al.
2002/0036139 A1 3/2002 Becker et al.
2002/0041378 A1 4/2002 Peltie et al.
2002/0058332 A1 * 5/2002 Quake ..... B01L 3/502715 435/288.5
2002/0067800 A1 6/2002 Newman et al.
2002/0085961 A1 7/2002 Morin et al.
2002/0090720 A1 7/2002 Mutz et al.
2002/0106667 A1 8/2002 Yamamoto et al.
2002/0119459 A1 8/2002 Griffiths
2002/0127591 A1 9/2002 Wada et al.
2002/0142344 A1 10/2002 Akeson et al.
2002/0143437 A1 10/2002 Handique et al.
2002/0155080 A1 10/2002 Glenn et al.
2002/0158027 A1 10/2002 Moon et al.
2002/0164271 A1 11/2002 Ho
2002/0164629 A1 11/2002 Quake et al.
2002/0166582 A1 11/2002 O'Connor et al.
2003/0008308 A1 1/2003 Enzelberger et al.
2003/0012586 A1 1/2003 Iwata et al.
2003/0015425 A1 1/2003 Bohm et al.
2003/0017305 A1 1/2003 Roitman et al.
2003/0017579 A1 1/2003 Corn et al.
2003/0039169 A1 2/2003 Ehrfeld et al.
2003/0040620 A1 2/2003 Langmore et al.
2003/0059764 A1 3/2003 Ravkin et al.
2003/0061687 A1 4/2003 Hansen et al.
2003/0064414 A1 4/2003 Benecky et al.
2003/0082795 A1 5/2003 Shuler et al.
2003/0083276 A1 5/2003 Li et al.
2003/0104372 A1 6/2003 Ahmadian et al.
2003/0108900 A1 6/2003 Oliphant et al.
2003/0124586 A1 7/2003 Griffiths et al.
2003/0143599 A1 7/2003 Makarov et al.
2003/0144260 A1 7/2003 Gilon
2003/0148273 A1 8/2003 Dong et al.
2003/0148544 A1 8/2003 Nie et al.
2003/0181574 A1 9/2003 Adam et al.
2003/0183525 A1 10/2003 Elrod et al.
2003/0207295 A1 11/2003 Gunderson et al.
2003/0219754 A1 11/2003 Oleksy et al.
2003/0224509 A1 12/2003 Moon et al.
2003/0229376 A1 12/2003 Sandhu
2003/0230486 A1 12/2003 Chien et al.

(56) References Cited

U.S. PATENT DOCUMENTS

2003/0232356 A1 12/2003 Dooley et al.
2004/0005582 A1 1/2004 Shipwash
2004/0005594 A1 1/2004 Holliger et al.
2004/0018525 A1 1/2004 Wirtz et al.
2004/0027915 A1 2/2004 Lowe et al.
2004/0031688 A1 2/2004 Shenderov
2004/0037739 A1 2/2004 McNeely et al.
2004/0037813 A1 2/2004 Simpson et al.
2004/0041093 A1 3/2004 Schultz et al.
2004/0050946 A1 3/2004 Wang et al.
2004/0053247 A1 3/2004 Cordon-Cardo et al.
2004/0057906 A1 3/2004 Hsu et al.
2004/0058450 A1 3/2004 Pamula et al.
2004/0068019 A1 4/2004 Higuchi et al.
2004/0071781 A1 4/2004 Chattopadhyay et al.
2004/0079881 A1 4/2004 Fischer et al.
2004/0086892 A1 5/2004 Crothers et al.
2004/0091923 A1 5/2004 Reyes et al.
2004/0096515 A1 5/2004 Bausch et al.
2004/0134854 A1 7/2004 Higuchi et al.
2004/0136497 A1 7/2004 Meldrum et al.
2004/0142329 A1 7/2004 Erikson et al.
2004/0146866 A1 7/2004 Fu
2004/0146921 A1 7/2004 Eveleigh et al.
2004/0159633 A1 8/2004 Whitesides et al.
2004/0180346 A1 9/2004 Anderson et al.
2004/0181131 A1 9/2004 Maynard et al.
2004/0181343 A1 9/2004 Wigstrom et al.
2004/0182712 A1 9/2004 Basol
2004/0185484 A1 9/2004 Costa et al.
2004/0188254 A1 9/2004 Spaid
2004/0209299 A1 10/2004 Pinter et al.
2004/0224325 A1 11/2004 Knapp et al.
2004/0224419 A1 11/2004 Zheng et al.
2004/0229349 A1 11/2004 Daridon
2004/0241693 A1 12/2004 Ricoul et al.
2004/0253731 A1 12/2004 Holliger et al.
2004/0258203 A1 12/2004 Yamano et al.
2004/0259083 A1 12/2004 Oshima
2005/0000970 A1 1/2005 Kimbara et al.
2005/0003380 A1 1/2005 Cohen et al.
2005/0008592 A1 1/2005 Gardel et al.
2005/0019776 A1 1/2005 Callow et al.
2005/0032238 A1 2/2005 Karp et al.
2005/0032240 A1 2/2005 Lee et al.
2005/0037392 A1 2/2005 Griffiths et al.
2005/0037397 A1 2/2005 Mirkin et al.
2005/0042639 A1 2/2005 Knapp et al.
2005/0042648 A1 2/2005 Griffiths et al.
2005/0048467 A1 3/2005 Sastry et al.
2005/0064460 A1 3/2005 Holliger et al.
2005/0069920 A1 3/2005 Griffiths et al.
2005/0079501 A1 4/2005 Koike et al.
2005/0079510 A1 4/2005 Berka et al.
2005/0084923 A1 4/2005 Mueller et al.
2005/0087122 A1 4/2005 Ismagliov et al.
2005/0095611 A1 5/2005 Chan et al.
2005/0100895 A1 5/2005 Waldman et al.
2005/0103690 A1 5/2005 Kawano et al.
2005/0123937 A1 6/2005 Thorp et al.
2005/0129582 A1 6/2005 Breidford et al.
2005/0130173 A1 6/2005 Leamon et al.
2005/0152908 A1 7/2005 Liew et al.
2005/0161669 A1 7/2005 Jovanovich et al.
2005/0164239 A1 7/2005 Griffiths et al.
2005/0169797 A1 8/2005 Oshima
2005/0170373 A1 8/2005 Monforte
2005/0170431 A1 8/2005 Ibrahim et al.
2005/0172476 A1 8/2005 Stone et al.
2005/0183995 A1 8/2005 Deshpande et al.
2005/0202429 A1 9/2005 Trau et al.
2005/0202489 A1 9/2005 Cho et al.
2005/0207940 A1 9/2005 Butler et al.
2005/0208495 A1 9/2005 Joseph et al.
2005/0214173 A1 9/2005 Facer et al.
2005/0221339 A1 10/2005 Griffiths et al.
2005/0221341 A1 10/2005 Shimkets et al.
2005/0226742 A1 10/2005 Unger et al.
2005/0227264 A1 10/2005 Nobile et al.
2005/0248066 A1 11/2005 Esteban
2005/0260566 A1 11/2005 Fischer et al.
2005/0272159 A1 12/2005 Ismagilov et al.
2005/0287572 A1 12/2005 Mathies et al.
2006/0003347 A1 1/2006 Griffiths et al.
2006/0003429 A1 1/2006 Frost et al.
2006/0003439 A1 1/2006 Ismagilov et al.
2006/0008824 A1 1/2006 Ronaghi et al.
2006/0035386 A1 2/2006 Hattori et al.
2006/0036348 A1 2/2006 Handique et al.
2006/0040197 A1 2/2006 Kabai
2006/0040297 A1 2/2006 Leamon et al.
2006/0046257 A1 3/2006 Pollock et al.
2006/0051329 A1 3/2006 Lee et al.
2006/0068398 A1 3/2006 McMillan
2006/0078475 A1 4/2006 Tai et al.
2006/0078888 A1 4/2006 Griffiths et al.
2006/0078893 A1 4/2006 Griffiths et al.
2006/0094119 A1 5/2006 Ismagilov et al.
2006/0100788 A1 5/2006 Carrino et al.
2006/0108012 A1 5/2006 Barrow et al.
2006/0110759 A1 5/2006 Paris et al.
2006/0115821 A1 6/2006 Einstein et al.
2006/0147909 A1 7/2006 Rarbach et al.
2006/0153924 A1 7/2006 Griffiths et al.
2006/0154298 A1 7/2006 Griffiths et al.
2006/0160762 A1 7/2006 Letter et al.
2006/0163385 A1 7/2006 Link et al.
2006/0169800 A1 8/2006 Rosell et al.
2006/0177832 A1 8/2006 Brenner
2006/0195269 A1 8/2006 Yeatman et al.
2006/0223127 A1 10/2006 Yip et al.
2006/0234254 A1 10/2006 An et al.
2006/0234259 A1 10/2006 Rubin et al.
2006/0234264 A1 10/2006 Hardenbol
2006/0246431 A1 11/2006 Balachandran
2006/0252057 A1 11/2006 Raponi et al.
2006/0257893 A1 11/2006 Takahashi et al.
2006/0258841 A1 11/2006 Michl et al.
2006/0263888 A1 11/2006 Fritz et al.
2006/0269558 A1 11/2006 Murphy et al.
2006/0269934 A1 11/2006 Woudenberg et al.
2006/0269971 A1 11/2006 Diamandis
2006/0281089 A1 12/2006 Gibson et al.
2006/0281098 A1 12/2006 Miao et al.
2007/0003442 A1 1/2007 Link et al.
2007/0009914 A1 1/2007 Wallace et al.
2007/0020617 A1 1/2007 Trnovsky et al.
2007/0026439 A1 2/2007 Faulstich et al.
2007/0045117 A1 3/2007 Pamula et al.
2007/0048744 A1 3/2007 Lapidus
2007/0053896 A1 3/2007 Ahmed et al.
2007/0054119 A1 3/2007 Garstecki et al.
2007/0056853 A1 3/2007 Aizenberg et al.
2007/0065823 A1 3/2007 Dressman et al.
2007/0077572 A1 4/2007 Tawfik et al.
2007/0077579 A1 4/2007 Griffiths et al.
2007/0092914 A1 4/2007 Griffiths et al.
2007/0111303 A1 5/2007 Inoue et al.
2007/0120899 A1 5/2007 Ohnishi et al.
2007/0123430 A1 5/2007 Pasquier et al.
2007/0141593 A1 6/2007 Lee et al.
2007/0154889 A1 7/2007 Wang
2007/0166705 A1 7/2007 Milton et al.
2007/0172873 A1 7/2007 Brenner et al.
2007/0184439 A1 8/2007 Guilford et al.
2007/0184489 A1 8/2007 Griffiths et al.
2007/0195127 A1 8/2007 Ahn et al.
2007/0202525 A1 8/2007 Quake et al.
2007/0213410 A1 9/2007 Hastwell et al.
2007/0241068 A1 10/2007 Pamula et al.
2007/0242105 A1 10/2007 Srinivasan et al.
2007/0243634 A1 10/2007 Pamula et al.
2007/0259351 A1 11/2007 Chinitz et al.
2007/0259368 A1 11/2007 An et al.

(56) References Cited

U.S. PATENT DOCUMENTS

2007/0259374 A1 11/2007 Griffiths et al.
2007/0275415 A1 11/2007 Srinivasan et al.
2007/0292869 A1 12/2007 Becker et al.
2008/0003142 A1 1/2008 Link et al.
2008/0003571 A1 1/2008 McKernan et al.
2008/0004436 A1 1/2008 Tawfik et al.
2008/0009005 A1 1/2008 Kruk
2008/0014589 A1 1/2008 Link et al.
2008/0014590 A1 1/2008 Dahary et al.
2008/0020940 A1 1/2008 Stedronsky et al.
2008/0021330 A1 1/2008 Hwang et al.
2008/0023330 A1 1/2008 Viovy et al.
2008/0032413 A1 2/2008 Kim et al.
2008/0038754 A1 2/2008 Farias-Eisner et al.
2008/0044828 A1 2/2008 Kwok
2008/0050378 A1 2/2008 Nakamura et al.
2008/0050723 A1 2/2008 Belacel et al.
2008/0053205 A1 3/2008 Pollack et al.
2008/0057514 A1 3/2008 Goldenring
2008/0058432 A1 3/2008 Wang et al.
2008/0063227 A1 3/2008 Rohrseitz
2008/0064047 A1 3/2008 Zetter et al.
2008/0081330 A1 4/2008 Kahvejian
2008/0081333 A1 4/2008 Mori et al.
2008/0092973 A1 4/2008 Lai
2008/0113340 A1 5/2008 Schlegel
2008/0118462 A1 5/2008 Alani et al.
2008/0124726 A1 5/2008 Monforte
2008/0138806 A1 6/2008 Chow et al.
2008/0166772 A1 7/2008 Hollinger et al.
2008/0166793 A1 7/2008 Beer et al.
2008/0171078 A1 7/2008 Gray
2008/0176211 A1 7/2008 Spence et al.
2008/0176236 A1 7/2008 Tsao et al.
2008/0181850 A1 7/2008 Thaxton et al.
2008/0206756 A1 8/2008 Lee et al.
2008/0216563 A1 9/2008 Reed et al.
2008/0220986 A1 9/2008 Gormley et al.
2008/0222741 A1 9/2008 Chinnaiyan
2008/0234138 A1 9/2008 Shaughnessy et al.
2008/0234139 A1 9/2008 Shaughnessy et al.
2008/0241830 A1 10/2008 Vogelstein et al.
2008/0261295 A1 10/2008 Butler et al.
2008/0268473 A1 10/2008 Moses et al.
2008/0269157 A1 10/2008 Srivastava et al.
2008/0274513 A1 11/2008 Shenderov et al.
2008/0274908 A1 11/2008 Chang
2008/0280285 A1 11/2008 Chen et al.
2008/0280302 A1 11/2008 Kebebew
2008/0286199 A1 11/2008 Livingston et al.
2008/0286801 A1 11/2008 Arjol et al.
2008/0286811 A1 11/2008 Moses et al.
2008/0293578 A1 11/2008 Shaugnessy et al.
2008/0299565 A1 12/2008 Schneider et al.
2008/0305482 A1 12/2008 Brentano et al.
2008/0311570 A1 12/2008 Lai
2008/0311604 A1 12/2008 Elting et al.
2009/0004687 A1 1/2009 Mansfield et al.
2009/0005254 A1 1/2009 Griffiths et al.
2009/0009855 A1 1/2009 Nakatsuka et al.
2009/0012187 A1 1/2009 Chu et al.
2009/0017463 A1 1/2009 Bhowmick
2009/0021728 A1 1/2009 Heinz et al.
2009/0023137 A1 1/2009 Van Der Zee et al.
2009/0026082 A1 1/2009 Rothberg et al.
2009/0029372 A1 1/2009 Wewer
2009/0042737 A1 2/2009 Katz et al.
2009/0053700 A1 2/2009 Griffiths et al.
2009/0053732 A1 2/2009 Vermesh et al.
2009/0060797 A1 3/2009 Mathies
2009/0062144 A1 3/2009 Guo
2009/0068170 A1 3/2009 Weitz et al.
2009/0069194 A1 3/2009 Ramakrishnan
2009/0075265 A1 3/2009 Budiman et al.
2009/0075307 A1 3/2009 Fischer et al.
2009/0075311 A1 3/2009 Karl
2009/0081237 A1 3/2009 D'Andrea et al.
2009/0081685 A1 3/2009 Beyer et al.
2009/0087849 A1 4/2009 Malinowski et al.
2009/0092973 A1 4/2009 Erlander et al.
2009/0098542 A1 4/2009 Budiman et al.
2009/0098543 A1 4/2009 Budiman et al.
2009/0098555 A1 4/2009 Roth et al.
2009/0105959 A1 4/2009 Braverman et al.
2009/0118128 A1 5/2009 Liu et al.
2009/0124569 A1 5/2009 Bergan et al.
2009/0127454 A1 5/2009 Ritchie et al.
2009/0127589 A1 5/2009 Rothberg et al.
2009/0131353 A1 5/2009 Insel et al.
2009/0131543 A1 5/2009 Weitz et al.
2009/0134027 A1 5/2009 Jary
2009/0191565 A1 7/2009 Lapidus et al.
2009/0197248 A1 8/2009 Griffiths et al.
2009/0197772 A1 8/2009 Griffiths et al.
2009/0215633 A1 8/2009 Van Eijk et al.
2009/0226971 A1 9/2009 Beer et al.
2009/0226972 A1 9/2009 Beer et al.
2009/0233802 A1 9/2009 Bignell et al.
2009/0246788 A1 10/2009 Albert et al.
2009/0317798 A1 12/2009 Heid et al.
2009/0325217 A1 12/2009 Luscher
2009/0325236 A1 12/2009 Griffiths et al.
2010/0003687 A1 1/2010 Simen
2010/0009353 A1 1/2010 Barnes et al.
2010/0015617 A1 1/2010 Toyama
2010/0021984 A1* 1/2010 Edd ..... C12N 11/04
435/174
2010/0022414 A1 1/2010 Link et al.
2010/0035252 A1 2/2010 Rothberg et al.
2010/0075436 A1 3/2010 Urdea et al.
2010/0105112 A1 4/2010 Holtze et al.
2010/0111768 A1 5/2010 Banerjee et al.
2010/0124759 A1 5/2010 Wang et al.
2010/0130369 A1 5/2010 Shenderov et al.
2010/0136544 A1 6/2010 Agresti et al.
2010/0137143 A1 6/2010 Rothberg et al.
2010/0137163 A1 6/2010 Link et al.
2010/0159592 A1 6/2010 Holliger et al.
2010/0172803 A1 7/2010 Stone et al.
2010/0173293 A1 7/2010 Woudenberg et al.
2010/0173394 A1 7/2010 Colston, Jr. et al.
2010/0188073 A1 7/2010 Rothberg et al.
2010/0197507 A1 8/2010 Rothberg et al.
2010/0210479 A1 8/2010 Griffiths et al.
2010/0213628 A1 8/2010 Bausch et al.
2010/0233026 A1 9/2010 Ismagliov et al.
2010/0240101 A1 9/2010 Lieberman et al.
2010/0273173 A1 10/2010 Hirai et al.
2010/0282617 A1 11/2010 Rothberg et al.
2010/0285975 A1 11/2010 Mathies et al.
2010/0300559 A1 12/2010 Schultz et al.
2010/0300895 A1 12/2010 Nobile et al.
2010/0301398 A1 12/2010 Rothberg et al.
2010/0304982 A1 12/2010 Hinz et al.
2011/0000560 A1 1/2011 Miller et al.
2011/0024455 A1 2/2011 Bethuy et al.
2011/0033854 A1 2/2011 Drmanac et al.
2011/0045462 A1 2/2011 Fu et al.
2011/0053151 A1 3/2011 Hansen et al.
2011/0053798 A1 3/2011 Hindson et al.
2011/0059435 A1 3/2011 Vogelstein et al.
2011/0059556 A1 3/2011 Strey et al.
2011/0142734 A1 6/2011 Ismagliov et al.
2011/0151444 A1 6/2011 Albers et al.
2011/0174622 A1 7/2011 Ismagilov et al.
2011/0176966 A1 7/2011 Ismagilov et al.
2011/0177494 A1 7/2011 Ismagilov et al.
2011/0177586 A1 7/2011 Ismagilov et al.
2011/0177609 A1 7/2011 Ismagilov et al.
2011/0188717 A1 8/2011 Baudry et al.
2011/0190146 A1 8/2011 Boehm et al.
2011/0218123 A1 9/2011 Weitz et al.
2011/0223314 A1* 9/2011 Zhang ..... B01J 13/14
427/2.1

(56) References Cited

U.S. PATENT DOCUMENTS

| | | | |
|---|---|---|---|
| 2011/0244455 | A1 | 10/2011 | Larson et al. |
| 2011/0250597 | A1 | 10/2011 | Larson et al. |
| 2011/0257031 | A1 | 10/2011 | Bodeau et al. |
| 2011/0267457 | A1 | 11/2011 | Weitz et al. |
| 2011/0275063 | A1 | 11/2011 | Weitz et al. |
| 2011/0311978 | A1 | 12/2011 | Makarewicz, Jr. et al. |
| 2012/0010098 | A1 | 1/2012 | Griffiths et al. |
| 2012/0010107 | A1 | 1/2012 | Griffiths et al. |
| 2012/0015382 | A1 | 1/2012 | Weitz et al. |
| 2012/0015822 | A1 | 1/2012 | Weitz et al. |
| 2012/0021930 | A1 | 1/2012 | Schoen et al. |
| 2012/0088691 | A1 | 4/2012 | Chen et al. |
| 2012/0122714 | A1 | 5/2012 | Samuels et al. |
| 2012/0167142 | A1 | 6/2012 | Hey |
| 2012/0190032 | A1 | 7/2012 | Ness et al. |
| 2012/0220494 | A1 | 8/2012 | Samuels et al. |
| 2012/0244043 | A1 | 9/2012 | Leblanc et al. |
| 2012/0258516 | A1 | 10/2012 | Schultz et al. |
| 2012/0288857 | A1 | 11/2012 | Livak |
| 2012/0302448 | A1 | 11/2012 | Hutchison et al. |
| 2013/0099018 | A1 | 4/2013 | Miller et al. |
| 2013/0109577 | A1 | 5/2013 | Korlach et al. |
| 2013/0143745 | A1 | 6/2013 | Christen et al. |
| 2013/0157872 | A1 | 6/2013 | Griffiths et al. |
| 2013/0178368 | A1 | 7/2013 | Griffiths et al. |
| 2013/0178378 | A1 | 7/2013 | Hatch et al. |
| 2013/0217601 | A1 | 8/2013 | Griffiths et al. |
| 2013/0224751 | A1 | 8/2013 | Olson et al. |
| 2013/0244906 | A1 | 9/2013 | Collins |
| 2013/0274117 | A1 | 10/2013 | Church et al. |
| 2013/0288254 | A1 | 10/2013 | Pollack et al. |
| 2013/0295567 | A1 | 11/2013 | Link et al. |
| 2013/0295568 | A1 | 11/2013 | Link |
| 2013/0296535 | A1 | 11/2013 | Church et al. |
| 2014/0065631 | A1 | 3/2014 | Froehlich et al. |
| 2014/0256568 | A1 | 9/2014 | Link |
| 2014/0256585 | A1 | 9/2014 | McCoy |
| 2014/0274786 | A1 | 9/2014 | McCoy et al. |
| 2014/0323317 | A1 | 10/2014 | Link et al. |
| 2014/0329239 | A1 | 11/2014 | Larson et al. |
| 2015/0018236 | A1 | 1/2015 | Green et al. |
| 2015/0038356 | A1 | 2/2015 | Karlin-Neumann et al. |
| 2015/0126400 | A1 | 5/2015 | Watson et al. |
| 2015/0184256 | A1 | 7/2015 | Samuels et al. |
| 2015/0197790 | A1 | 7/2015 | Tzonev |
| 2015/0336072 | A1 | 11/2015 | Weitz et al. |
| 2016/0289670 | A1 | 10/2016 | Samuels et al. |
| 2016/0304954 | A1 | 10/2016 | Lin et al. |
| 2017/0304785 | A1 | 10/2017 | Link et al. |
| 2018/0057863 | A1 | 3/2018 | Larson et al. |
| 2018/0223348 | A1 | 8/2018 | Link et al. |
| 2018/0272294 | A1 | 9/2018 | Griffiths et al. |
| 2018/0272296 | A1 | 9/2018 | Link et al. |
| 2018/0272299 | A1 | 9/2018 | Griffiths et al. |
| 2018/0353913 | A1 | 12/2018 | Link et al. |
| 2018/0355350 | A1 | 12/2018 | Link et al. |
| 2018/0361346 | A1 | 12/2018 | Griffiths et al. |
| 2018/0363050 | A1 | 12/2018 | Hutchison et al. |
| 2019/0024261 | A1 | 1/2019 | Griffiths et al. |
| 2019/0107489 | A1 | 4/2019 | Griffiths et al. |
| 2019/0134581 | A1 | 5/2019 | Yurkovetsky et al. |
| 2019/0316119 | A1 | 10/2019 | Samuels et al. |

FOREIGN PATENT DOCUMENTS

| | | | |
|---|---|---|---|
| AT | 155711 | T | 8/1997 |
| AT | 167816 | T | 7/1998 |
| AU | 4032078 | A | 4/1980 |
| AU | 6415380 | A | 5/1981 |
| AU | 1045983 | A | 6/1984 |
| AU | 2177292 | A | 1/1993 |
| AU | 4222393 | A | 11/1993 |
| AU | 4222593 | A | 11/1993 |
| AU | 4222693 | A | 11/1993 |
| AU | 4222793 | A | 11/1993 |
| AU | 4223593 | A | 11/1993 |
| AU | 677197 | B2 | 4/1997 |
| AU | 677781 | B2 | 5/1997 |
| AU | 680195 | B2 | 7/1997 |
| AU | 2935197 | A | 1/1998 |
| AU | 3499097 | A | 1/1998 |
| AU | 3501297 | A | 1/1998 |
| AU | 1276099 | A | 6/1999 |
| AU | 4955799 | A | 12/1999 |
| AU | 3961100 | A | 10/2000 |
| AU | 4910300 | A | 11/2000 |
| AU | 747464 | B2 | 5/2002 |
| AU | 768399 | B2 | 12/2003 |
| AU | 2004225691 | B2 | 6/2010 |
| AU | 2010224352 | A1 | 10/2010 |
| CA | 1093344 | A1 | 1/1981 |
| CA | 2258481 | A1 | 1/1998 |
| CA | 2520548 | A1 | 10/2004 |
| CH | 563 087 | A5 | 6/1975 |
| CH | 563807 | A5 | 7/1975 |
| DE | 2100685 | A1 | 7/1972 |
| DE | 3042915 | A1 | 9/1981 |
| DE | 43 08 839 | C2 | 4/1997 |
| DE | 69126763 | T2 | 2/1998 |
| DE | 199 61 257 | A1 | 7/2001 |
| DE | 100 15 109 | A1 | 10/2001 |
| DE | 100 41 823 | A1 | 3/2002 |
| EP | 0047130 | B1 | 2/1985 |
| EP | 0402995 | A2 | 12/1990 |
| EP | 0249007 | A3 | 3/1991 |
| EP | 0476178 | A1 | 3/1992 |
| EP | 0546174 | A1 | 6/1993 |
| EP | 620432 | A1 | 10/1994 |
| EP | 0637996 | A1 | 2/1995 |
| EP | 0637997 | A1 | 2/1995 |
| EP | 0718038 | A2 | 6/1996 |
| EP | 0540281 | B1 | 7/1996 |
| EP | 0528580 | B1 | 12/1996 |
| EP | 0895120 | | 2/1999 |
| EP | 1362634 | A1 | 11/2003 |
| EP | 04782399.2 | | 5/2006 |
| EP | 1741482 | | 1/2007 |
| EP | 2017910 | A1 | 1/2009 |
| EP | 2127736 | | 12/2009 |
| EP | 2047910 | B1 | 1/2012 |
| EP | 13165665.4 | | 11/2013 |
| EP | 13165667.0 | | 11/2013 |
| EP | 2363205 | A3 | 6/2014 |
| EP | 2534267 | B1 | 4/2018 |
| ES | 2 095 413 | T3 | 2/1997 |
| FR | 2 404 834 | A1 | 4/1979 |
| FR | 2 451 579 | A1 | 10/1980 |
| FR | 2 469 714 | A1 | 5/1981 |
| FR | 2 470 385 | A1 | 5/1981 |
| FR | 2 650 657 | A1 | 2/1991 |
| FR | 2 669 028 | A1 | 5/1992 |
| FR | 2 703 263 | A1 | 10/1994 |
| GB | 1148543 | | 4/1969 |
| GB | 1 446 998 | | 8/1976 |
| GB | 2 005 224 | | 4/1979 |
| GB | 2 047 880 | | 12/1980 |
| GB | 2 062 225 | | 5/1981 |
| GB | 2 064 114 | | 6/1981 |
| GB | 2097692 | A | 11/1982 |
| GB | 2 210 532 | | 6/1989 |
| IE | 922432 | A1 | 2/1993 |
| JP | S5372016 | A | 6/1978 |
| JP | S5455495 | A | 5/1979 |
| JP | 55125472 | | 9/1980 |
| JP | S5636053 | A | 4/1981 |
| JP | 56-124052 | | 9/1981 |
| JP | 59-102163 | | 6/1984 |
| JP | H0665609A | A | 3/1994 |
| JP | 8-153669 | | 6/1996 |
| JP | 10-217477 | | 8/1998 |
| JP | 2000-271475 | A | 10/2000 |
| JP | 2001-301154 | A | 10/2001 |
| JP | 2001-517353 | A | 10/2001 |
| JP | 2002-085961 | A | 3/2002 |

(56) References Cited

FOREIGN PATENT DOCUMENTS

| | | | |
|---|---|---|---|
| JP | 2003-501257 | A | 1/2003 |
| JP | 2003-502656 | A | 1/2003 |
| JP | 2003-222633 | A | 8/2003 |
| JP | 2005-037346 | A | 2/2005 |
| JP | 2009-265751 | A | 11/2009 |
| JP | 2010-198393 | A | 9/2010 |
| NZ | 264353 | A | 5/1996 |
| WO | 84/02000 | | 5/1984 |
| WO | 91/05058 | A1 | 4/1991 |
| WO | 91/07772 | | 5/1991 |
| WO | 91/16966 | A1 | 11/1991 |
| WO | 92/03734 | | 3/1992 |
| WO | 92/21746 | | 12/1992 |
| WO | 93/03151 | | 2/1993 |
| WO | 93/08278 | | 4/1993 |
| WO | 93/22053 | | 11/1993 |
| WO | 93/22054 | | 11/1993 |
| WO | 93/22055 | | 11/1993 |
| WO | 93/22058 | | 11/1993 |
| WO | 93/22421 | | 11/1993 |
| WO | 94/16332 | | 7/1994 |
| WO | 94/23738 | | 10/1994 |
| WO | 94/24314 | | 10/1994 |
| WO | 94/26766 | | 11/1994 |
| WO | 98/00705 | | 1/1995 |
| WO | 95/11922 | | 5/1995 |
| WO | 95/19922 | | 7/1995 |
| WO | 95/24929 | | 9/1995 |
| WO | 95/33447 | | 12/1995 |
| WO | 96/34112 | | 10/1996 |
| WO | 96/38730 | | 12/1996 |
| WO | 96/40062 | | 12/1996 |
| WO | 96/40723 | | 12/1996 |
| WO | 97/00125 | | 1/1997 |
| WO | 97/00442 | | 1/1997 |
| WO | 97/04297 | | 2/1997 |
| WO | 97/23140 | | 7/1997 |
| WO | 97/28556 | | 8/1997 |
| WO | 97/38318 | A1 | 10/1997 |
| WO | 97/39814 | | 10/1997 |
| WO | 97/40141 | | 10/1997 |
| WO | 97/04748 | | 12/1997 |
| WO | 97/45644 | | 12/1997 |
| WO | 97/47763 | A1 | 12/1997 |
| WO | 98/00231 | | 1/1998 |
| WO | 98/02237 | | 1/1998 |
| WO | 98/10267 | | 3/1998 |
| WO | 98/13502 | | 4/1998 |
| WO | 98/22625 | A1 | 5/1998 |
| WO | 98/23733 | | 6/1998 |
| WO | 98/31700 | | 7/1998 |
| WO | 98/33001 | | 7/1998 |
| WO | 98/34120 | | 8/1998 |
| WO | 98/37186 | | 8/1998 |
| WO | 98/41869 | | 9/1998 |
| WO | 98/52691 | | 11/1998 |
| WO | 98/58085 | | 12/1998 |
| WO | 99/02671 | | 1/1999 |
| WO | 99/22858 | | 5/1999 |
| WO | 99/28020 | | 6/1999 |
| WO | 99/31019 | | 6/1999 |
| WO | 99/42539 | A1 | 8/1999 |
| WO | 99/54730 | | 10/1999 |
| WO | 99/61888 | | 12/1999 |
| WO | 00/47322 | | 2/2000 |
| WO | 00/52455 | | 2/2000 |
| WO | 00/40712 | | 6/2000 |
| WO | 00/54735 | | 9/2000 |
| WO | 00/61275 | | 10/2000 |
| WO | 00/70080 | | 11/2000 |
| WO | 00/04139 | A1 | 12/2000 |
| WO | 00/76673 | | 12/2000 |
| WO | 00/078455 | A1 | 12/2000 |
| WO | 01/12327 | | 2/2001 |
| WO | 01/14589 | | 3/2001 |
| WO | 01/18244 | | 3/2001 |
| WO | 01/64332 | | 9/2001 |
| WO | 01/68257 | | 9/2001 |
| WO | 01/69289 | | 9/2001 |
| WO | 01/72431 | | 10/2001 |
| WO | 01/80283 | | 10/2001 |
| WO | 01/089787 | A2 | 11/2001 |
| WO | 01/89788 | A2 | 11/2001 |
| WO | 01/94635 | A2 | 12/2001 |
| WO | 02/16017 | | 2/2002 |
| WO | 02/18949 | | 3/2002 |
| WO | 02/22869 | | 3/2002 |
| WO | 02/23163 | A1 | 3/2002 |
| WO | 02/31203 | | 4/2002 |
| WO | 2002/036815 | A2 | 5/2002 |
| WO | 02/47665 | | 8/2002 |
| WO | 02/060275 | | 8/2002 |
| WO | 02/060591 | A1 | 8/2002 |
| WO | 02/068104 | A1 | 9/2002 |
| WO | 02/078845 | | 10/2002 |
| WO | 02/103011 | | 12/2002 |
| WO | 02/103363 | | 12/2002 |
| WO | 03/011443 | | 2/2003 |
| WO | 03/026798 | A1 | 4/2003 |
| WO | 03/037302 | | 5/2003 |
| WO | 03/044187 | | 5/2003 |
| WO | 03/078659 | | 9/2003 |
| WO | 2003/003015 | | 10/2003 |
| WO | 03/099843 | | 12/2003 |
| WO | 2004/002627 | | 1/2004 |
| WO | 2004/018497 | A2 | 3/2004 |
| WO | 2004/024917 | | 3/2004 |
| WO | 2004/037374 | A2 | 5/2004 |
| WO | 2004/038363 | | 5/2004 |
| WO | 04/071638 | A2 | 8/2004 |
| WO | 2004/069849 | A2 | 8/2004 |
| WO | 2004/074504 | | 9/2004 |
| WO | 2004/083443 | | 9/2004 |
| WO | 2004/083443 | A1 | 9/2004 |
| WO | 2004/087308 | | 10/2004 |
| WO | 2004/088314 | | 10/2004 |
| WO | 2004/091763 | | 10/2004 |
| WO | 2004/102204 | | 11/2004 |
| WO | 2004/103565 | | 12/2004 |
| WO | 2005/000970 | | 1/2005 |
| WO | 2005/002730 | | 1/2005 |
| WO | 2005/003375 | A2 | 1/2005 |
| WO | 2005/11867 | A2 | 2/2005 |
| WO | 05/021151 | | 3/2005 |
| WO | 2005/023427 | A1 | 3/2005 |
| WO | 2005/041884 | A2 | 5/2005 |
| WO | 05/049787 | A2 | 6/2005 |
| WO | 2005/103106 | | 11/2005 |
| WO | 2005/118138 | | 12/2005 |
| WO | 2005/118867 | A2 | 12/2005 |
| WO | 2006/002641 | | 1/2006 |
| WO | 2006/009657 | | 1/2006 |
| WO | 2006/027757 | | 3/2006 |
| WO | 2006/038035 | A2 | 4/2006 |
| WO | 2006/040551 | | 4/2006 |
| WO | 2006/040554 | | 4/2006 |
| WO | 2006/078841 | | 7/2006 |
| WO | 2006/096571 | | 9/2006 |
| WO | 2006/101851 | | 9/2006 |
| WO | 2007/012638 | A1 | 2/2007 |
| WO | 2007/021343 | | 2/2007 |
| WO | 2007/030501 | | 3/2007 |
| WO | 2007/081385 | | 7/2007 |
| WO | 2007/081387 | | 7/2007 |
| WO | 2007/081387 | A1 | 7/2007 |
| WO | 2007/089541 | | 8/2007 |
| WO | 2007/092473 | A2 | 8/2007 |
| WO | 2007/114794 | A1 | 10/2007 |
| WO | 2007/123744 | A2 | 11/2007 |
| WO | 2007/133710 | | 11/2007 |
| WO | 2007/138178 | | 12/2007 |
| WO | 2007/140015 | A2 | 12/2007 |
| WO | 2008/021123 | | 2/2008 |
| WO | 2008/063227 | | 5/2008 |

(56) References Cited

FOREIGN PATENT DOCUMENTS

| | | | |
|---|---|---|---|
| WO | 2008/097559 | | 8/2008 |
| WO | 2008/115626 | A2 | 9/2008 |
| WO | 2008/121342 | | 10/2008 |
| WO | 2008/130623 | | 10/2008 |
| WO | 2007/092473 | | 11/2008 |
| WO | 2008/134153 | A1 | 11/2008 |
| WO | 2009/015296 | A1 | 1/2009 |
| WO | 2009/029229 | | 3/2009 |
| WO | 2009/049889 | A1 | 4/2009 |
| WO | 2009/059430 | A1 | 5/2009 |
| WO | 2009/085929 | A1 | 7/2009 |
| WO | 2009/137415 | A2 | 11/2009 |
| WO | 2009/137606 | A1 | 11/2009 |
| WO | 2010/009365 | A1 | 1/2010 |
| WO | 2010/056728 | A1 | 5/2010 |
| WO | 2010/040006 | | 8/2010 |
| WO | 2010/115154 | A1 | 10/2010 |
| WO | 2010/151776 | | 12/2010 |
| WO | 2011/042564 | | 4/2011 |
| WO | 2011/079176 | | 6/2011 |
| WO | 2011/100604 | A2 | 8/2011 |
| WO | 2012/022976 | A1 | 2/2012 |
| WO | 2012/045012 | A2 | 4/2012 |
| WO | 2012/047297 | A2 | 4/2012 |
| WO | 2012/048341 | A1 | 4/2012 |
| WO | 2012/083225 | A2 | 6/2012 |
| WO | 2012/167142 | A2 | 12/2012 |
| WO | 2013/14356 | A2 | 1/2013 |
| WO | 2013/165748 | A1 | 11/2013 |
| WO | 2014/026031 | A1 | 2/2014 |
| WO | 2014/065756 | A1 | 5/2014 |
| WO | 2014/165559 | A2 | 10/2014 |
| WO | 2014/204939 | A2 | 12/2014 |
| WO | 2015/013681 | A1 | 1/2015 |
| WO | 2015/200893 | A2 | 12/2015 |
| WO | 2017/117358 | A1 | 7/2017 |

OTHER PUBLICATIONS

Joos, 1997, Covalent attachment of hybridizable oligonucleotides to glass supports, Analytical Biochemistry 247:96-101.
Joyce,1994, In vitro Evolution of Nucleic Acids, Curr. Opp. Structural Biol, 4: 331-336.
Kadir, 1990, Haem binding to horse spleen ferritin, Febs Lett, 276: 81-4.
Kallen, 1966, The mechanism of the condensation of formaldehyde with tetrahydrofolic acid, J. Biol. Chem., 241:5851-63.
Kambara, 1988, Optimization of Parameters in a DNA Sequenator Using Fluorescence Detection, Nature Biotechnology 6:816-821.
Kamensky, 1965, Spectrophotometer: new instrument for ultrarapid cell analysis, Science 150(3696):630-631.
Kanouni, 2002, Preparation of a stable double emulsion (W1/0/W2): role of the interfacial films on the stability of the system, Adv. Collid. Interf. Sci., 99(3): 229-254.
Karapatis, 1998, Direct rapid tooling:a review of current research, Rapid Prototyping Joumal, 4(2):77-89.
Katanaev, 1995, Viral Q beta RNA as a high expression vector for mRNA translation in a cell-free system, Febs Lett, 359:89-92.
Katsura, 2001, Indirect micromanipulation of single molecules in water-in-oil emulsion, Electrophoresis, 22:289-93.
Kawakatsu, 1997, Regular-sized cell creation in microchannel emulsification by visual microprocessing method, Journal of the American Oil ChemistS Society, 74:317-21.
Keana, 1990, New reagents for photoaffinity labeling: synthesis and photolysis of functionalized perfluorophenyl azides, J. Org. Chem. 55(11):3640-3647.
Keefe, 2001, Functional proteins from a random-sequence library, Nature, 410: 715-718.
Keij, 1994, High-speed photodamage cell sorting: An evaluation of the ZAPPER prototype, Methods in cell biology, 42:371-358.
Kelly, 2005, Detection of Vascular Adhesion Molecule-1 Expression Using a Novel Multimodal Nanoparticle, Circulation Research 96:327-336.
Kelly, 2007, Miniaturizing chemistry and biology in microdroplets, Chem Commun 18:1773-1788.
Kerker, 1983, Elastic and inelastic light scattering in flow cytometry, Cytometry, 4:1-10.
Khandjian, 1986, UV crosslinking of RNA to nylon membrane enhances hybridization signals, Mol. Bio. Rep. 11:107-115.
Kheir, 2012, Oxygen Gas-Filled Microparticles Provide Intravenous Oxygen Delivery, Science Translational Medicine 4(140):140ra88 (10 pages).
Kim, 2003, Type II quantum dots: CdTe/CdSe (core/shell) and CdSe/ZnTe (core/shell) heterostructures, J. Am Chem Soc. 125:11466-11467.
Kim, 2004, Comparative study on sustained release of human growth hormone from semi-crystalline poly(L-lactic acid) and amorphous poly(D,L-lactic-co-glycolic acid) microspheres: morphological effect on protein release, Journal of Controlled Release, 98(1):115-125.
Kircher, 2010, High-throughput DNA sequencing-concepts and limitations, Bioessays 32(6):524-536.
Kiss, 2008, High-throughput quantitative polymerase chain reaction in picoliter droplets, Anal. Chem 80:8975-8981.
Kitagawa, 1995, Manipulation of a single cell with microcapillary tubing based on its electrophoretic mobility, Electrophoresis 16:1364-1368.
Klug, 1994, All you wanted to know about selex, Molecular Biology Reports, 20:97-107.
Klug, 1995, Gene Regulatory Proteins and Their Interaction with DNA, Ann NY Acad Sci, 758: 143-60.
Klug, 1995, Protein motifs 5. Zinc fingers, FASEB J 9(8):597-604.
Knaak, 1995, Development of partition coefficients, Vmax and Km values, and allometric relationships, Toxicol Lett. 79(I-3):87-98.
Knight, 1998, Hydrodynamic Focusing on a Silicon Chip: Mixing Nanoliters in Microseconds, Physical Review Left 80(17):3863-3866.
Koeller, 2001, Enzymes for chemical synthesis, Nature 409:232-240.
Kohler, 1975, Continuous cultures of fused cells secreting antibody of predefined specificity, Nature, 256:495-7.
Kojima, 2005, PCR amplification from single Dna molecules on magnetic beads in emulsion: application for high-throughput screening of transcription factor targets. Nucleic Acids Res. 33:e150, 9 pages.
Kolb, 1995, Cotranslational folding of proteins, Biochem Cell Biol, 73:1217-20.
Komatsu, 2001, Roles of cytochromes P450 1A2, 2A6, and 2C8 in 5-fluorouracil formation rom tegafur, an anticancer prodrug, in human liver microsomes. Drug Met. Disp., 28:1457-1463.
Kopp, 1998, Chemical amplification: continuous flow PCR on a chip, Science, 280:1046-48.
Koster, 2008, Drop-based microfluidic devices for encapsulation of single cells, Lab on a Chip 8:1110-1115.
Kowalczykowski, 1994, Biochemistry of homologous recombination in *Escherichia coli*, Microbiol Rev 58(3):401-65.
Kozbor, 1984, A human hybrid myeloma for production of human monoclonal antibodies, J. Immunol., 133:3001-3005.
Krafft, 1991, Synthesis and preliminary data on the biocompatibility and emulsifying properties of perfluoroalkylated phosphoramidates as injectable surfactants, Eur. J. Med. Chem., 26:545-550.
Krafft, 2001, Fluorocarbons and fluorinated amphiphiles in drug delivery and biomedical research, Adv Rev Drug Disc 47:209-228.
Krafft, 2003, Emulsions and microemulsions with a fluorocarbon phase, Colloid and Interface Science 8(3):251-258.
Kralj, 2005, Surfactant-enhanced liquid-liquid extraction in microfluidic channels with inline electric-field enhanced coalescence, Lab Chip 5:531-535.
Kricka, 1996, Micromachining: a new direction for clinical analyzers, Pure and Applied Chemistry 68(10):1831-1836.
Kricka, 2003, Microchip PCR, Anal Bioanal Chem 377(5):820-825.
Kritikou, 2005, "Its cheaper in the Picolab," Nature, September, vol. 6, 1 page.

(56) References Cited

OTHER PUBLICATIONS

Krumdiek, 1980, Solid-phase synthesis of pteroylpolyglutamates, Methods Enzymol, 524-29.
Kruth, 2003, Lasers and materials in selective laser sintering, Assembly Automation, 23(4):357-371.
Kumagai, 1994, Ablation of polymer films by a femtosecond high-peak-power Ti:sapphire laser at 798 nm, Applied Physics Letters, 65(14):1850-1852.
Kumar, 1989, Activity and kinetic characteristics of glutathione reductase in vitro in reverse micellar waterpool, Biochem Biophys Acta, 996(1-2):1-6.
Kumaresan, 2008, High-throughput single copy DNA amplification and cell analysis in engineered nanoliter droplets, Anal Chem, 80:3522-3529.
Lage, 2003, Whole genome analysis of genetic alterations in small Dna samples using hyperbranched strand displacement amplification and array-CGH, Genome Res 13:294-307.
Laird, 2013, Rapid Quantification of the Latent Reservoir for HIV-1 Using a Viral Outgrowth Assay, PLOS Pathogens 9(5):e1003398.
Lamprecht, 2004, pH-sensitive microsphere delivery increases oral bioavailability of calcitonin, J Control Rel 98(1):1-9.
Lancet, 1993, Probability model for molecular recognition in biological receptor repertoirs, PNAS 90(8):3715-9.
Landergren, 1988, A ligase mediated gene detection technique, Science 241(4869):1077-80.
Lasheras, 1998, Breakup and atomization of a round water jet by a high speed annular air jet, J Fluid Mech 357:351-379.
Laufer, 1996, Introduction to Optics and Lasers in Engineering, Cambridge University Press, Cambridge UK:156-162.
Leamon, 2003, A massively parallel pictoterplate based platform for discrete picoliter-scale PCR, Electrophoresis 24:3769-3777.
Leary, 2000, Application of advanced cytometric and molecular technologies to minimal residual disease monitoring, Proc SPIE 3913:36-44.
Lee, 2000, Circulating flows inside a drop under time-periodic non-uniform electric fields, Phys Fuilds 12(8):1899-1910.
Lee, 2001, Preparation of silica particles encapsulating retinol using O/W/O multiple emulsions, J Coll Interface Sci 240(1):83-89.
Lee, 2002, Effective formation of silicone-in-fluorocarbon-in-water double emulsions, J Disp Sci Tech 23(4):491-497.
Lee, 2002, Investigating the target recognition of DNA cytosine-5 methyltransferase Hhal by library selection using in vitro compartmentalisation (IVC), Nucleic Acids Res 30:4937-4944.
Lee, 2004, Special issue on biomedical applications for MEMS and microfluidics, Proc IEEE 92(1):3-5.
Lemof, 2003, An AC magnetohydrodynamic microfluidic switch for Micro Total Analysis Systems, Biomed Microdev 5(1):55-60.
Leng 2009, Microfluidic crystalizaiton,Lab Chip 9:24-23.
Leng, 2010, Agarose droplet microfluidics for highly parallel and efficient single molecule emulsion PCR, Lab Chip 10:2841-2843.
Lesley, 1991, Use of in vitro protein synthesis from PCR-generated templates to study interaction of *E coli* transcription factors with core RNA polymerase, J Biol Chem 266(4):2632-8.
Lesley, 1995, Preparation and use of *E. coli* S-30 extracts, Methods Mol Biol 37:265-78.
Leung, 1989, A method for random mutagenesis of a defined DNA segment using a modified polymerase chain reaction, Technique 1:11-15.
Li, 1995, Single-step procedure for labeling DNA strand breaks with fllourescein- or BODIPY-conjugated deoxynucleotides, Cytometry 20:172-180.
Li, 1997, Transport, manipulation, and reaction of biological cells on-chip using electrokinetic effects, Anal Chem 69(8):1564-1568.
Li, 2005, Multiplexed detection of pathogen DNA with DNA-based fluorescence nanobarcodes, Nat Biotech 23(7):885-889.
Li, 2006, Nanoliter microfluidic hybrid method for simultaneous screening and optimization validated with crystallization of membrane proteins, PNAS 103:19243-19248.
Li, 2018, Microfluidic fabrication of microparticles for biomedical applications, Chem Soc Rev 47(15):5646-5683.
Liao, 1986, Isolation of a thermostable enzyme variant by cloning and selection in a thermophile, PNAS 83:576-80.
Lim, 1980, Microencapsulated islets as bioartificial endocrine pancreas, Science 210(4472):908-10.
Lin, 2007, Self-assembled combinatorial encoding nanoarrays for multiplexed biosensing, Nano Lett 7(2):507-512.
Link, 2004, Geometrically mediated breakup of drops in microfluidic devices, Phys Rev Lettv92(5):054503-1-4.
Link, 2006, Electric control droplets in microfluidic devices, Angew Chem Int Ed 45:2556-2560.
Lipinski, 2001, Experimental and computational approaches to estimate solubility and permeability in drug discovery Adv Drug Deliv Rev 46:3-26.
Lipkin, 1988, Biomarkers of increased susceptibility to gastreointestinal cancer: new application to studies of cancer prevention in human subjects, Cancer Res 48:235-245.
Liu, 2000, Passive mixing in a three-dimensional serpentine microchannel, J MEMS 9(2):190-197.
Liu, 2002, Fabrication and characterization of hydrogel-based microvalves, Mecoelectromech. Syst.11:45-53.
Lizardi, 1998, Mutation detection and single-molecule counting using isothermal rolling-circle amplification. Nat Genet 19(3):225-32.
Lo, 2007, Digital PCR for the molecular detection of fetal chromosomal aneuploidy, PNAS 104(32):13116-13121.
Loakes, 1994, 5-Nitroindole as a universal base analogue, Nucleic Acids Res 22:4039-4043.
Loakes, 1997, Stability and structure of DNA oligonucleotides containing non-specific base analogues, J Mol Biol 270:426-435.
Lodish, 2000, Structure of Nucleic Acids, Section 4.1 , Molecular Cell Biology, 4th edition, New York, 1-3.
Loeker, 2003, FTIR analysis of water in supercritical carbon dioxide microemulsions using monofunctional perfluoropolyether surfanctants, Colloids and Surfaces A: Phys Eng Asp 214:143-150.
Loo, 2004, Nanoshell Enabled Photonics-Based Imaging and Therapy of Cancer, Technology in Cancer Research & Treatment 3(1):33-40.
Lopez-Herrera, 1995, The electrospraying of viscous and non-viscous semi-insulating liquids: scaling laws, Bull Am Phys Soc 40 (12):2041.
Lopez-Herrera, 1999, One-dimensional simulation of the breakup of capillary jets of conducting liquids application to EHD spraying, Aerosol Set 30(7):895-912.
Lopez-Herrera, 2003, Coaxial jets generated from electrified Taylor cones, Aerosol Sci 34:535-552.
Lorenceau, 2005, Generation of polymerosomes from double-emulsions, Langmuir 21(20):9183-9186.
Lorenz, 1991, Isolation and expression of a cDNA encoding Renilla reniformis luciferase, PNAS 88(10):4438-42.
Loscertales, 2002, Micro/nano encapsulation via electrified coaxial liquid jets, Science 295(5560):1695-1698.
Lowe, 2002, Perfluorochemical respiratory gas carriers: benefits to cell culture systems, J Fluorine Chem 118:19-26.
Lu, 2007, Robust fluorescein-doped silica nanoparticles via dense-liquid treatment, Colloids and Surfaces A Phys Eng Asp 303(3):207-210.
Hermankova, 2003, Analysis of human immunodeficiency virus type 1 gene expression in lately infected reseting CD4 T lymphocytes in vivo, J Virology 77(13):7383-7392.
Herzer, 2001, DNA Purification, in Molecular Biology Problem Solver: A Laboratory Guide, Edited by Alan S. Gerstein, Ch.1.
Heyries, 2011, Megapixel digital PCR, Nat. Methods 8, 649-651.
Hildebrand, 1949, Liquid-Liquid Solubility of Perfluoromethylcyclohexane with Benzene, Carbon Tetrachloride, Chlorobenzene, Chloroform and Toluene, J. Am. Chem. Soc, 71:22-25.
Hindson, 2011, High-Throughput Droplet Digital PCR System for Absolute Quantitation of DNA Copy Number, Anal. Chem., 83, 8604-8610.
Hjelmfelt, 1993, Pattern-Recognition in Coupled Chemical Kinetic Systems, Science, 260(5106):335-337.
Ho, 1989, Site-directed mutageneiss by overlap extension using the polymerase chain reaction, Gene, 77(1):51-9.

(56) References Cited

OTHER PUBLICATIONS

Hochuli, 1987, New metal chelate adsorbent selective for proteins and peptides containing neighbouring histidine residues, J Chromatogr 411: 177-84.
Holmes, 1995, Reagents for Combinatorial Organic Synthesis: Development of a New O-Nitrobenzyl Photolabile Linder for Solid Phase Synthesis, J. OrgChem., 60: 2318-2319.
Holtze, 2008, Biocompatible surfactants for water-in-fluorocarbon emulsions, Lab Chip, 8, 1632-1639.
Hong, 1999, Stereochemical constraints on the substrate specificity of phosphodiesterase, Biochemistry, 38:1159-1165.
Hoogenboom, 1997, Designing and optimizing library selection strategies for generating high-affinity antibodies, Trends Biotechnol, 15:62-70.
Hopfinger, 1996, Explosive Breakup of a Liquid Jet by a Swirling Coaxial Jet, Physics of Fluids 8(7):1696-1700.
Hopman, 1998, Rapid synthesis of biotin-, digoxigenin-, trinitrophenyl-, and fluorochrome-labeled tyramides and their application for In situ hybridization using CARD amplification, J of Histochem and Cytochem, 46(6):771-77.
Horton, 1989, Engineering hybrid genes without the use of restriction enzymes: gene splicing by overlap extension, Gene 77(1):61-8.
Hosokawa, 1999, Handling of Picoliter Liquid Samples in a Poly(dimethylsiloxane)-Based Microfluidic Device, Analytical Chemistry, 71(20):4781-4785.
Hsieh, 2009, Rapid label-free DNA analysis in picoliter microfluidic droplets using FRET probes, Microfluidics and nanofluidics 6(3):391-401.
Hsu, 1999, et al., Comparison of process parameters for microencapsulation of plasmid DNA in poly(D, L-lactic-co-glycolic acid microspheres, J Drug Target, 7:313-23.
Hua, 2010, Multiplexed Real-Time Polymerase Chain Reaction on a Digital Microfluidic Platform, Analytical Chemistry 82(6):2310-2316.
Huang, 1991, Kinetic assay of fluorescein mono-beta-D-galactosidase hydrolysis by beta-galactosidase: a front-face measurement for strongly absorbing fluorogenic substrates, Biochemistry, 30:8530-4.
Huang, 1992, A sensitive competitive ELISA for 2,4-dinitrophenol using 3,6-fluorescein diphosphate as a fluorogenic substrate, J Immunol Meth, 149:261.
Huang, 2004, Continuous particle separation through deterministic lateral displacement, Science 304(5673):987-990.
Huang, 2007, Identification of 8 foodborne pathogens by multicolor combinational probe coding technology in a single real-time PCR, Clin Chem., 53(10):1741-8.
Hubert, 2003, Data Concordance from a Comparison between Filter Binding and Fluorescence Polarization Assay Formats for Identification of Ruock—II Inhibitors, J biomol Screen 8(4):399-409.
Huebner, 2007, Quantitative detection of protein expression in single cells using droplet microfluidics, Chem Com 12:1218-1220.
Hug, 2003, Measurement of the number of molecules of a single mRNA species in a complex mRNA preparation. J Theor Biol.; 221(4):615-24.
Hung, 2004, Controlled Droplet Fusion in Microfluidic Devices, MicroTAS 2004, Sep. 26-30, Malmo, Sweden.
Hung, 2004, Optimization of Droplet Generation by controlling PDMS Surface Hydrophobicity, 2004 ASME International Mechanical Engineering Congress and RD&D Expo, Nov. 13-19, Anaheim, CA, 47-48.
Hutchison, 2005, Cell-free cloning using Phi29 polymerase, PNAS 102(48):17332-17336.
Ibrahim, 2003, High-speed cell sorting: fundamentals and recent advances, Curr Opin Biotchnol, 14(1):5-12.
Ikeda, 2000, Bioactivation of tegafur to 5-fluorouracil is catalyzed by cytochrome P-450 2A6 in human liver microsomes in vitro, Clin Cancer Res 6(11):4409-4415.
Illumina, 2010, Genomic Sequencing, data Sheet, 6 pages.
Inai, 1993, Immunohistochemical detection of an enamel protein-related epitope in rat bone at an early stage of osteogenesis, Histochemistry 99(5):335-362.
Invitrogen, 2008, Specification sheet for Dynabeads® Oligo (dT)25, http://www.invitrogen.com, 2 pages.
Ismagilov, 2003, Integrated Microlluidic Systems, Angew. Chem. Int. Ed 42:4130-4132.
Jakobovits, 1993, Analysis of homozygous mutant chimeric mice:deletion of the immunoglobulin heavy-chain joining region blocks B-cell development and antibody production, PNAS USA 90:2551-255.
Jakobovits, 1993, Germ-line transmission and expression of a human-derived yeast artificial chromosome, Nature 362:255-258.
Janda, 1997, Chemical selection for catalysis in combinatorial antibody libraries, Science, 275:945-948.
Jang, 2003, Controllable delivery of non-viral DNA from porous scaffold, J Controlled Release 86(1):157-168.
Jarvie, 2007, Amplicon Sequencing, Roche Dx Application Note No. 5 (16 pages).
Jermutus, 1998, et al., Recent advances in producing and selecting functional proteins by using cell-free translation, Curr Opin Biotechnol 9(5): 534-48.
Jo, 2003, Encapsulation of Bovine Serum Albumin in Temperature-Programmed Shell-in-Shell Structures, Macromol. Rapid Comm 24:957-962.
Joerger, 1995, Analyte detection with DNA-labeled antibodies and polymerase chain reaction, Clin. Chem. 41(9):1371-7.
Johannsson, 1988, Amplification by Second Enzymes, In ELISA and Other Solid Phase Immunoassays, Kemeny et al (ed), Chapter 4, pp. 85-106 John Wiley.
Johannsson, 1991, Heterogeneous Enzyme Immunoassays, In Principles and Practice of Immunoassay, pp. 295-325 Stockton Press.
Johnson, 1993, Human antibody engineering: Current Opinion in Structural Biology, 3:564-571.
Johnson, 2002, Protein tyrosine phosphatase 1B inhibitors for diabetes, Nature Review Drug Discovery 1, 696-709.
Jones, 1986, Replacing the complementarity-determining regions in a human antibody with those from a mouse, Nature, 321:522-525.
Jones, 1997, Quenched BODIPY dye-labeled casein substrates for the assay of protease activity by direct fluorescence measurement, Anal Biochem, 251:144-152.
Jones, 1999, Glowing jellyfish, luminescence and a molecule called coelenterazine, Trends Biotechnol. 17(12):477-81.
Patel, 2003, Formation of Fluorinated Nonionic Surfactant Microemulsions in Flydrfuorocarbon 134a, Journal of Colloid and Interface Science, 258, 345-353.
Pedersen, 1998, A method for directed evolution and functional cloning of enzymes, PNAS 95(18):10523-8.
Pekin, 2011, Quantitative and sensitive detection of rare mutations using droplet-based microfluidics, Lab on a Chip 11(13):2156-2166.
Pelham, 1976, An efficient mRNA-dependent translation system from reticulocyte lysates, Eur J Biochem 67:247-56.
Pelletier, 1999, An in vivo library-versus-library selection of optimized protein-protein interactions, Nature Biotechnology, 17:683-90.
Peng, 1998, Controlled Production of Emulsions Using a Crossflow Membrane, Particle & Particle Systems Characterization 15:21-25.
Pepe, 2004, Limitations of the odds ratio in gauging the performance of a diagnostic, prognostic, or screening marker, American Journal of Epidemiology 159(9):882-890.
Perelson, 1979, Theorectical studies of clonal selection: minimal antibody repertoire size and relaibility of self-non-self discrimination. J Theor Biol 81(4):645-70.
Perez-Gilabert, 1992, Application of active-phase plot to the kinetic analysis of lipoxygenase in reverse micelles, Biochemistry J. 288:1011-1015.
Petrounia, 2000, Designed evolution of enzymatic properties, Curr Opin Biotechnol, 11:325-330.
Pirrung, 1996, A General Method for the Spatially Defined Immobilization of Biomolecules on Glass Surfaces Using 'Caged' Biotin, Bioconjug Chem 7: 317-321.
Ploem, 1993, in Fluorescent and Luminescent Probes for Biological Activity Mason, T. G. Ed., Academic Press, Landon, pp. 1-11.

(56) References Cited

OTHER PUBLICATIONS

Pluckthun, 2000, In vitro selection and evolution of proteins, Adv Protein Chem, 55: 367-403.
Pollack, 1986, Selective chemical catalysis by an antibody, Science 234(4783):1570-3.
Pollack, 2002, Electrowetting-based actuation of droplets for integrated microfluidics, Lab Chip 2:96-101.
Pons, 2009, Synthesis of Near-Infrared-Emitting, Water-Soluble CdTeSe/CdZnS Core/Shell Quantum Dots, Chemistry of Materials 21(8):1418-1424.
Posner, 1996, Engineering specificity for folate into dihydrofolate reductase from *Escherichia coli*, Biochemistry, 35:1653-63.
Priest, 2006, Generation of Monodisperse Gel Emulsions in a Microfluidic Device, Applied Physics Letters, 88:024106, 3 pages.
Qi, 1998, Acid Beta-Glucosidase: Intrinsic Fluorescence and Conformational Changes Induced by Phospholipids and Saposin C, Biochem,, 37(33): 11544-11554.
Raghuraman, 1994, Emulston Liquid Membranes for Wastewater Treatment: Equillibrium Models for Some Typical Metal-Extractant Systems,Environ. Sci. Technol 28:1090-1098.
Ralhan, 2008, Discovery and Verification of Head-and-neck Cancer Biomarkers by Differential Protein Expression Analysis Using iTRAQ Labeling, Multidimensional Liquid Chromatography, and Tandem Mass Spectrometry, Mol Cell Proteomics 7(6):1162-1173.
Ramanan, 2016, Algae-bacteria interactions, Biotech ADv 34:14-29.
Ramsey, 1999, The burgeoning power of the shrinking laboratory, Nat Biotechnol 17(11):1061-2.
Ramstrom, 2002, Drug discovery by dynamic combinatorial libraries, Nat Rev Drug Discov 1:26-36.
Rasmussen, 2013, Comparison of HDAC inhibitors in clinical development, Human Vacc Immunother 9(5):993-1001.
Raushel, 2000, Phosphotriesterase: an enzyme in search of its natural substrate, Adv Enzymol Relat Areas Mol Bid, 74: 51-93.
Rech, 1990, Introduction of a yeast artificial chromosome vector into *Sarrachomyeces cervesia* by electroporation, Nucleic Acids Res 18:1313.
Reyes, 2002, Micro Total Analysis Systems. 1. Introduction, Theory and Technology, Anal Chem 74(12):2623-2636.
Riechmann, 1988, Reshaping human antibodies for therapy, Nature, 332:323-327.
Riess, 2002, Fluorous micro- and nanophases with a biomedical perspective, Tetrahedron 58(20):4113-4131.
Roach, 2005, Controlling nonspecific protein adsorption in a plug-based microfluidic system by controlling inteifacial chemistry using fluorous-phase surfactants, Anal. Chem. 77:785-796.
Roberts, 1969, Termination factor for RNA synthesis, Nature, 224: 1168-74.
Roberts, 1975, Simian virus 40 DNA directs synthesis of authentic viral polypeptides in a linked transcription-translation cell-free system 72(5):1922-1926.
Roberts, 1997, RNA-peptide fusion for the in vitro selection of peptides and proteins, PNAS 94:12297-302.
Roberts, 1999, In vitro selection of nucleic acids and proteins: What are we learning, Curr Opin Struct Biol 9(4): 521-9.
Roberts, 1999, Totally in vitro protein selection using mRNA-protein fusions and ribosome display. Curr Opin Chem Biol 3(3), 268-73.
Roche, 2011, 454 Sequencing System Guidelines for Amplicon Experimental Design, 50 pages.
Rodriguez-Antona, 2000, Quantitative RT-PCR measurement of human cytochrome P-450s: application to drug induction studies. Arch. Biochem. Biophys., 376:109-116.
Rogers, 2005, Closing bacterial genoimc sequence gaps with adaptor-PCR, BioTechniques 39(1):1-3.
Rolland, 1985, Fluorescence Polarization Assay by Flow Cytometry, J. Immunol. Meth., 76(1): 1-10.
Rosenberg, 1975, Inhibition of Human Factor IX by Human Antithrombin, J Biol Chem, 250: 4755-64.
Rosenberry, 1975, Acetylcholinesterase, Adv Enzymol Relat Areas Mol Biol, 43: 103-218.
Rotman, 1961, Measurement of activities of single molecules of beta-galactosidase, PNAS, 47:1981-91.
Rouzioux, 2013, How to best measure HIV reservoirs, Curr Op HIV AIDS 8(3):170-175.
Russon et al., Single-nucleotide polymorphism analysis by allele-specific extension of fluorescently labeled nucleotide in a microfluidic flow-through device, Electrophoresis, 24:158-61 (2003).
Saarela, 2006, Re-usable multi-inlet PDMS fluidic connector, Sensors Actuators B 114(1):552-57.
Sadtler, 1996, Achieving stable, reverse water-in-fluorocarbon emulsions, Angew Chem Int Ed 35(17):1976-1978.
Sadtler, 1999, Reverse water-In-fluorocarbon emulsions as a drug delivery system: an in vitro study, Colloids & Surfaces A: Phys Eng Asp 147:309-315.
Saiki, 1988, Primer directed enzymatic amplification of DNA with a thermostable DNA polymerase, Science 239(4839):487-91.
Sakamoto, 2005, Rapid and simple quantification of bacterial cells by using a microfluidic device, Appl Env Microb 71:2.
Montigiani, 1996, Alanine substitutions in calmodulin-binding peptides result in unexpected affinity enhancement, J Mol Biol, 258:6-13.
Moore, 1995, Exploration by lamp light, Nature, 374:766-7.
Morrison, 1984, Chimeric human antibody molecules: mouse antigen-binding domains with human constant region domains, PNAS 81:6851-6855.
Moudrianakis, 1965, Base sequence determination in nucelic acids with the electron microscope 3. Chemistry and microscopy of guanine-labeled DNA, PNAS 53:564-71.
Mueth, 1996, Origin of stratification in creaming emulsions, Physical Review Letters 77(3):578-581.
Mulbry, 1989, Parathion hydrolase specified by the Flavobacterium opd gene: relationshio between the gene and protein. J Bacteriol, 171: 6740-6746.
Mulder, 1993, Characterization of two human monoclonal antibodies reactive with HLA-B12 and HLA-B60, respectively, raised by in vitro secondary immunization of peripheral blood lymphocytes, Hum. Immunol 36(3):186-192.
Munson, 1980, Ligand: a versatile computerized approach for characterization of ligand-binding systems, Analytical Biochemistry, 107:220-239.
Nakano, 1994, High speed polymerase chain reaction in constant flow, Biosci Biotech and Biochem, 58:349-52.
Nakano, 2003, Single-molecule PCR using water-in-oil emulsion, J Biotech, 102:117-124.
Nakano, 2005, Single-molecule reverse transcription polymerase chain reaction using water-in-oil emulsion, J Biosci Bioeng 99:293-295.
Nametkin, 1992, Cell-free translation in reversed micelles, FEB Letters, 309(3):330-32.
Narang, 1979, Improved phosphotriester method for the synthesis of gene fragments, Methods Enzymol, 68:90-98.
Neiman, 2011, Decoding a substantial set of samples in parallel by massive sequencing, PLoS ONE 6(3):1-7.
Nelson, 1989, Bifunctional oligonucleotide probes synthesized using a novel CPG support are able to detect single base pair mutations, Nucl Acids Res 17(18): 7187-7194.
Nemoto, 1997, In vitro virus: bonding of mRNA bearing puromycin at the 3 terminal end to the C-terminal end of its encoded protein on the ribosome in vitro, Federation of European Biochemical Societies, 414:405-8.
Ness, 2000, Molecular Breeding: the natural approach to protein design. Adv Protein Chem, 55: 261-292.
Ng, 2003, Protein crystallization by capillary counter-diffusion for applied crystallographic structure determination, J. Stuct. Biol, 142:218-231.
Ng, 2006, Factors affecting flow karyotype resolution, Cytometry, Part A 69A: 1028-1036.
Nguyen, 2006, Optical detection for droplet size control in microfluidic droplet-based analysis systems, Sensors and Actuators B 117(2):431-436.

(56) References Cited

OTHER PUBLICATIONS

Nihant, 1994, Polylactide Microparticles Prepared by Double Emulsion/Evaporation Technique. I. Effect of Primary Emulsion Stability, Pharmaceutical Research, 11(10):1479-1484.
Nisisako, 2002, Droplet formation in a microchannel network, Lab Chip 2:24-26.
Nisisako, 2002, Formation of droplets using branch channels in a microfluidic circuit, Proceedings of the SICE Annual Conference. International Session Papers 1262-1264.
Nisisako, 2005, Controlled formulation of monodisperse double emulsions in a multiple-phase microluidic system, Sot Matter, 1:23-27.
Nisisako, 2008, Microstructured Devices for Preparing Controlled Multiple Emulsions. Chem. Eng. Technol 31(8):1091-1098.
Nof, 2002, Drug-releasing scaffolds fabricated from drug-loaded microspheres, J. Biomed Mater Res 59:349-356.
Norman, 1980, Flow Cytometry, Med. Phys., 7(6):609-615.
Nygren, 1982, Conjugation of horseradish peroxidase to Fab fragments with different homobifunctional and heterobifunctional cross-linking reagents. A comparative study, J. Histochem. and Cytochem. 30:407-412.
Oberholzer, 1995, Enzymatic RNA replication in self-reproducing vesicles: an approach to a minimal cell, Biochem Biophys Res Commun 207(1):250-7.
Oberholzer, 1995, Polymerase chain reaction in liposomes, Chem. Biol. 2(10):677-82.
Obukowicz, 1988, Secretion and export of IGF-1 in *Escerichia coli* strain JM101, Mol Gen Genet, 215:19-25.
Ogura, 1955, Catalase activity at high concentrations of hydrogen peroxide, Archs Biochem Biophys, 57: 288-300.
Oh, 2002, Distribution of Macropores in Silica Particles Prepared by Using Multiple Emulsions, Journal of Colloid and Interface Science, 254(1): 79-86.
Oh, 2005, World-to-chip microfluidic interface with built-in valves for multichamber chip-based PCR assays, Lab Chip, 5, 845-850.
Okuno, 2003, Recent Advances in Optical Switches Using Silica-based PLC Technology, NTT Technical Review 1(7):20-30.
Okushima, 2004, Controlled production of monodisperse double emulsions by two-step droplet breakup in microfluidic devices, Langmuir 20(23): 9905-8.
Olsen, 2000, Function-based isolation of novel enzymes from a large library, Nat Bioteoltnol 13(10):1071-4.
Omburo, 1992, Characterization of the zinc binding site of bacterial phosphotriesterase, J of Biological Chem, 267:13278-83.
Oroskar, 1996, Detection of immobilized amplicons by ELISA-like techniques, Clin. Chem. 42:1547-1555.
Ostermeier, 1999, A combinatorial approach to hybrid enzymes independent of DNA homology, Nat Biotechnol, 17(12):1205-9.
Ott, 1967, Biological and medical research annual report, Los Alamos Scientific Laboratory, 14 pages.
Ouelette, 2003, A new wave of microfluidic devices, Indust Physicist pp. 14-17.
Pabit, 2002, Laminar-Flow Fluid Mixer for Fast Fluorescence Kinetics Studies, Biophys J 83:2872-2878.
Paddison, 2002, Stable suppression of gene expression by RNAi in mammalian cells, PNAS 99(3):1443-1448.
Pain, 1981, Preparation of protein A-peroxidase mono conjugate using a heterobifunctional reagent, and its use in enzyme immunoassays, J Immunol Methods, 40:219-30.
Pannacci, 2008, Equilibrium and Nonequilibrium States in Microluidic Double Emulsions Physical Review Leters, 101(16):164502.
Park, 2001, Model of Formation of Monodispersed Colloids, J. Phys. Chem. B 105:11630-11635.
Park, 2003, Cylindrical compact thermal-cycling device for continuous-flow polymeras chain reaction, Anal Chem, ACS, 75:6029-33.
Parker, 2000, Development of high throughput screening assays using fluorescence polarization: nuclear receptor-ligand-binding and kinase/phosphatase assays, J Biomol Screen, 5(2): 77-88.
Pasternak, 2013, Cell-associated HIV RNA: a dynmic biomarker of viral persistence, Retrovirology 10:41.
Cooper, 2000, The Central Role of Enzymes as Biological Catalysts, The Cell: A Molecular Approach, 2nd Edition, pp. 1-6.
Cormack, 1996, FACS-optimized mutants of the green fluorescent protein (GFP), Gene 173(1):33-38.
Cortesi, 2002, Production of lipospheres as carriers for bioactive compounds, Biomateials, 23(11): 2283-2294.
Courrier, 2004, Reverse water-in-fluorocarbon emulsions and microemulsions obtained with a fluorinated surfactant, Colloids and Surfaces A: Physicochem. Eng. Aspects 244:141-148.
Craig, 1995, Fluorescence-based enzymatic assay by capillary electrophoresis laser-induced fluoresence detection for the determinination of a few alpha-galactosidase molecules, Anal. Biochem. 226:147.
Creagh, 1993, Structural and catalytic properties of enzymes in reverse micelles, Enzyme Microb Technol 15(5):383-92.
Crosland-Taylor, 1953, A Device for Counting Small Particles suspended in a Fluid through a Tube, Nature 171:37-38.
Crowley, 1973, Electrical breakdown of bimolecular lipid membranes as an electromechanical instability, Biophys J. 13(7):711-724.
Cull, 1992, Screening for receptor ligands using large libraries of peptides linked to the C terminus of the lac repressor, PNAS 89:1865-9.
Curran, 1998, Strategy-level separations in organic synthesis: from planning to practice. Angew Chem Int Ed, 37:1174-11-96.
Czarnik, 1997, Encoding methods for combinatorial chemistry, Curr Opin Chem Biol 1:60-66.
Dankwardt, 1995, Combinatorial synthesis of small-molecule libraries using 3-amino-5-hydroxybenzoic acid, 1:113-120.
David, 1974, Protein iodination with solid-state lactoperoxidase, Biochemistry 13:1014-1021.
Davis, 1987, Multiple emulsions as targetable delivery systems, Meth Enzymol 149:51-64.
Davis, 2006, Deterministic hydrodynamics: Taking blood apart, PNAS 103:14779-14784.
De Gans, 2004, Inkjet printing of polymers: state of the art and future developments, Advanced materials, 16: 203-213.
De Wildt, 2002, Isolation of receptor-ligand pairs by capture of long-lived multivalent interaction complexes, Proceedings of the National Academy of Sciences of the United States, 99, 8530-8535.
DelRaso, 1993, In vitro methodologies for enhanced toxicity testing, Toxicol. Lett. 68:91-99.
Deng, 2008, Design and analysis of mismatch probes for long oligonucleotide microarrays, BMC Genomics; 9:491, 13 pages.
Dickinson, 1992, Interfacial interactions and the stability of oil-in-water emulsions, Pure Appl Chem 64(11):1721-1724.
Dickinson, 1994, Emulsions and droplet size control, Wedlock, D.J., Ed., in Controlled Particle Droplet and Bubble Formulation, ButterWorth-Heine-mann, 191-257.
DiMatteo, 2008, Genetic conversion of an SMN2 gene to SMN1: A novel approach to the treatment of spinal muscular atrophy, Exp Cell Res. 314(4):878-886.
Ding, 2001, Scheduling of microfluidic operations for reconfigurable two-dimensional electrowetting arrays, IEEE Trans CADICS 20(12):1463-1468.
Ding, 2003, Direct molecular haplotyping of long-range genomic DNA with M1-PCR, Proc. Natl. Acad. Sci. USA, 100(33):7449-7453.
Dinsmore, 2002, Colioidosomes: Selectively Permeable Capsules Composed of Colloidal Particles, Science 298(5595):1006-1009.
Dittrich, 2005, A new embedded process for compartmentalized cell-free protein expression and on-line detection in microfluidic devices, Chembiochem 6(5):811-814.
Doi, 1999, STABLE: protein-DNA fusion system for screening of combinatorial protein libraries in vitro, FEBS Lett., 457: 227-230.
Doi, 2004, In vitro selection of restriction endonucleases by in vitro compartmentilization, Nucleic Acids Res, 32(12):e95.
Doman, 2002, Molecular docking and high-throughput screening for novel inhibitors of protein tyrosine phosphatase-1B, J Med Chem, 45: 2213-2221.
Domling, 2000, Multicomponent Reactions with Isocyanides, Angew Chem Int Ed 39(18):3168-3210.
Domling, 2002, Recent advances in isocyanide-based multicomponent chemistry, Curr Opin Chem Biol, 6(3):306-13.

(56) References Cited

OTHER PUBLICATIONS

Dorfman, 2005, Contamination-free continuous flow microfluidic polymerase chain reaction for quantitative and clinical applications, Anal Chem 77:3700-3704.
Dove, 2002, Research News Briefs, Nature Biotechnology 20:1213, 1 page.
Dower, 1988, High efficiency transformation of *E. coli* by high voltage electroporation, Nucleic Acids Res 16:6127-6145.
Dressman, 2003, Transforming single DNA molecules into fluorescent magnetic particles for detection and enumeration of genetic variations, PNAS 100:8817-22.
Dreyfus, 2003, Ordered and disordered patterns in two phase flows in microchannels, Phys Rev Lett 90(14):144505-1-144505-4.
Drmanac, 1992, Sequencing by hybridization: towards an automated sequencing of one million M13 clones arrayed on membranes, Elctrophoresis 13:566-573.
Du, 2009, SlipChip, Lab Chip, 9, 2286-2292.
Dubertret, 2002, In vivo imaging of quantum dots encapsulated in phospholipid micelles, Science, 298: 1759-1762.
Duffy, 1998, Rapid Protyping of Microfluidic Systems and Polydimethylsiloxane, Anal Chem 70:474-480.
Duggleby, 1995, Analysis of Enzyme Progress Curves by Nonlinear Regression, Pt D. Academic Press 249:61-90.
Dumas, 1989, Purification and properties of the phosphotriesterase from Psuedomonas diminuta, J Biol Chem 264:19659-19665.
Eckert, 1991, DNA polymerase fidelity and the polymerase chain reaction, Genome Res 1:17-24.
Ecole Polytech Federate de Lausanne, 2014, Tracing water channels in cell surface receptors, PhysOrg News (2 pages).
Edel, 2002, Microfluidic Routes to the Controlled Production of Nanopaticles, Chemical Communications, 1136-1137.
Edris, 2001, Encapsulation of orange oil in a spray dried double emulsion, Nahrung/Food, 45(2):133-137.
Effenhauser, 1993, Glass chips for high-speed capillary electrophoresis separations with submicrometer plate heights, Anal Chem 65:2637-2642.
Eggers, 1999, Coalescence of Liquid Drops, J Fluid Mech 401:293-310.
Ehrig, 1995, Green-fluorescent protein mutants with altered fluorescence excitation spectra, Febs Lett, 367(2):163-66.
Eigen, 1980, Hypercycles and compartments: compartments assists—but does not replace—hypercyclic organization of early genetic information, J Theor Biol, 85:407-11.
Xia, 1998, Soft Lithography, Ann. Rev. Mat. Sci. 28:153-184.
Xiao, 2007, Rapid DNA mapping by fluorescent single molecule detection, Nucleic Acids Research 35:1-12.
Xing, 2011, Novel structurally related compounds reactivate latent HIV-1 in a bcl-2-transduced primary CD4+ T cell model without inducing global T cell activation, Journal of Antimicrobial Chemotherapy, 67(2):398-403.
Xu, 2005, Generation of monodisperse particles by using microfluidics: control over size, shape, and composition, Angew. Chem. Int. Ed. 44:724-728.
Xu, 2009, Design of 240, 000 orthogonal 25mer DNA barcode probes, PNAS, 106(7) p. 2289-2294.
Yamagishi, 1990, Mutational analysis of structure-activity relationships in human tumor necrosis factor-alpha, Protein Eng, 3:713-9.
Yamaguchi, 2002, Insulin-loaded biodegradable PLGA microcapsules: initial burst release controlled by hydrophilic additives, Journal of Controlled Release, 81(3): 235-249.
Yelamos, 1995, Targeting of non-Ig sequences in place of the V segment by somatic hypermutation. Nature 376(6537):225-9.
Yershov, 1996, DNA analysis and diagnostics on oligonucleotide microchips, PNAS 93(10):4913-4918.
Yonezawa, 2003, DNA display for in vitro selection of diverse peptide libraries, Nucleic Acids Research, 31(19): e118, 5 pages.
Yu, 1997, Specific inhibition of PCR by non-extendable oligonucleotides using a 5' to 3' exonuclease-deficient DNA polymerase, Biotechniques 23(4):714-6, 718-20.
Yu, 2001, Responsive biomimetic hydrogel valve for microfluidics. Appl. Phys. Lett 78:2589-2591.
Yu, 2002, Environmental Carcinogenic Polycyclic Aromatic Hydrocarbons: Photochemisrty and Phototoxicity, J Environ Scie Health C Environ Carcinog Exotoxicol Rev, 20(2), 1-43.
Yu, 2007, Quantum dot and silica nanoparticle doped polymer optical fibers, Optics Express 15(16):9989-9994.
Zaccolo, 1996, An approach to random mutagenesis of DNA using mixtures of triphosphate derivatives of nucleoside analogues. J Mol Biol 255(4):589-603.
Zakrzewski, 1980, Preparation of tritiated dihydrofolic acid of high specific activity, Methods Enzymol, 529-533.
Zaug, 1986, The intervening sequence RNA of Tetrahymena is an enzyme, Science 231(4737):470-5.
Zaug, 1986, The Tetrahymena intervening sequence ribonucleic acid enzyme is a phosphotransferase and an acid phosphatase, Biochemistry 25(16):4478-82.
Zaug, 1986, The Tetrahymena ribozyme acts like an RNA restriction endonuclease, Nature 324(6096):429-33.
Zhang, 1993, Substrate specificity of the protein tyrosine phosphatases, PNAS 90: 4446-4450.
Zhang, 1999, A Simple Statistical Parameter for Use in Evaluation and Validation of High Throughput Screening Assays, Journal of Biomolecular Screening, 4(2): 67-73.
Zhao, 1998, Molecular evolution by staggered extension process (StEP) in vitro recombination. Nat Biotechnol 16(3):258-61.
Zhao, 2002, Control and Applications of Immiscible Liquids in Microchannels, J. Am. Chem. Soc, vol. 124:5284-5285.
Zheng, 2003, Screening of Protein Crystallization Conditions on a Microfluidic Chip Using Nanoliter-Size Droplets, J Am Chem Soc 125(37):11170-11171.
Zheng, 2004, A Droplet-Based, Composite PDMS/Glass Capillary Microfluidic System for Evaluating Protein Crystallization Conditions by Microbatch and Vapor-Diffusion Methods with On-Chip X-Ray Diffraction, Angew. Chem.,116:1-4.
Zheng, 2004, Formation of Droplets of Alternating Composition in Microfluidic Channels and Applications to Indexing of Concentrations in Droplet-Based /Assays, Anal. Chem.,76: 4977-4982.
ZHeng, 2005, A Microiuidic Approach for Screening Submicroliter Volumes against Multiple Reagents by Using Performed Arrays of Nanoliter Plugs in a Three-Phase Liquid/Liquid/Gas Flow, Angew. Chem. Int. Ed., 44(17):2520-2523.
Zhong, 2011, Multiplex digital PCR: breaking the one target per color barrier of quantitative PCR, Lab on a Chip 11(13):2167-2174.
Zimmermann, 1974, Dielectric Breakdown of Cell Membranes, Biophys J 14(11):881-889.
Zimmermann, 1992, Microscale Production of Hybridomas by Hypo-Osmolar Electrofusion, Hum. Antibod. Hybridomas, 3(1): 14-18.
Zimmermann, 2008, Digital PCR: a powerful new tool for noninvasive prenatal diagnosis?, Prenat Diagn 28, 1087-1093.
Zubay, 1973, In vitro synthesis of protein in microbial systems, Annu Rev Genet, 7: 267-87.
Zubay, 1980, The isolation and properties of CAP, the catabolite gene activator, Methods Enzymol, 65: 856-77.
Zuckermann, 1987, Efficient Methods for Attachment of Thiol-Specific Probes to the 3-end of Synthetic Oligodeoxyribonucleotides, Nucleic Acids Res. 15:5305-5321.
Sano, 1992, Immuno-PCR: very sensitive antigen-detection by means of sepcific Ab-DNA conjugates, Science 258(5079):120-122.
SantaLucia, 1998, A unified view of polymer, dumbbell, and oligonucleotide DNA nearest-neighbor thermodynamics, PNAS 95(4):1460-5.
Santa, 2006, Fluorescence lifetime measurements to determine the core-shell nanostructure of FITC-doped silica nanoparticles, J Luminescence 117(1):75-82.
Sawada, 1996, Synthesis and surfactant properties of novel fluoroalkylated amphiphilic oligomers, Chem Commun 2:179-190.
Schatz, 1996, Screening of peptide libraries linked to lac repressor, Meth Enzymol 267:171-91.
Schneegass, 2001, Miniaturized flow-through PCR with different template types in a silicone chip thermocycler, Lab on a Chip 1:42-9.

(56) References Cited

OTHER PUBLICATIONS

Schopman, 2012, Selective packaging of cellular miRNAs in HIV-1 particles, Virus Res 169(2):438-47.
Schubert, 2002, Designer Capsules, Nat Med 8:1362.
Schweitzer, 2000, Immunoassays with rolling circle DNA amplification, PNAS 97(18):10113-10119.
Schweitzer, 2001, Combining nucleic acid amplification and detection. Curr Opin Biotechnol 12(1):21-7.
Scott, 1948, The solubility of fluorocarbons, J Am Chem Soc 70:4090-4093.
Sedlak, 2013, Viral diagnostics in the era of digital polymerase chain reaction, Diag Microb Inf Dis 75(1):1-4.
Seethala, 1997, Homogeneous fluorescence polarization assay for Src-Family tyrosine kinases, Anal Biochem 253(2):210-218.
Seiler, 1993, Planar glass chips for capillary electrophoresis: repetitive sample injection, quantitation, and separation efficiency, Anal Chem 65(10):1481-1488.
Selwyn, 1965, A simple test for inactivation of an enzyme during assay, Biochim Biophys Acta 105:193-195.
Seo, 2007, Microfluidic consecutive flow-focusing droplet generators, Soft Matter 3:986-992.
Seong, 2002, Efficient mixing and reactions within microlluidic channels using microbead-supported catalysts, J Am Chem Soc 124(45):13360-1.
Seong, 2002, Fabrication of microchambers defined by photopolymerized hydrogels and weirs within microfluidic systems, Anal Chem 74(14):3372-3377.
Sepp, 2002, Microbead display by in vitro compartmentalisation: selection for binding using flow cytometry, FEBS Letters 532:455-58.
Serpersu, 1985, Reversible and irreversible modification of erythrocyte membrane permeability by electric field, Biochim Biophys Acta 812(3):779-785.
Shapiro, 1983, Multistation multiparameter flow cytometry: a critical review and rationale, Cytometry 3: 227-243.
Shastry, 2006, Directing droplets using microstructured surfaces, Langmuir 22:6161-6167.
Shen, 2006, Eigengene-based linear discriminant model for tumor classification using gene expression microarray data, Bioinformatics 22(21):2635-2642.
Shestopalov, 2004, Multi-step synthesis of nanoparticles performed on millisecond time scale in a microfluidic droplet-based system, Royal Soc Chem 4:316-321.
Shim, 2007, Using microfluidics to decouple nucleation and growth of protein crystals, Cryst Growth Des 7(11):2192-2194.
Shimizu, 1995, Encapsulation of biologically active proteins in a multiple emulsion, Biosci Biotech Biochem 59(3):492-496.
Shtern, 1996, Hysteresis in swirling jets, J Fluid Mech 309:1-44.
Sia, 2003, Microfluidic devices fabricated in poly(dimethylsiloxane) for biological studies, Electrophoresis 24(21):3563-3576.
Siemering, 1996, Mutations that suppress the thermosensitivity of green fluorescent protein, Curr Biol 6:1653-1663.
Silva-Cunha, 1998, W/O/W multiple emulsions of insulin containing a protease inhibitor and an absorption enhancer: biological activity after oral administration to normal and diabetic rats, Int J Pharm 169:33-44.
Sims, 2000, Immunopolymerase chain reaction using real-time polymerase chain reaction for detection, Anal. Biochem. 281(2):230-2.
Sista, 2007, Development of a Digital Microfluidic Lab-on-a-Chip for Automated Immunoassay with Magnetically Responsive Beads, Doctoral Thesis, Florida State University, 128 pages.
Sista, 2008, Development of a digital microfluidic platform for point care testing, Lab on a Chip 8:2091-2104.
Siwy, 2003, Electro-responsive asymmetric nanopores in polyimide with stable ion-current signal, Appl Phys A: Mat Sci Proc 76:781-785.
Slappendel, 1994, Normal cations and abnormal membrane lipids in the red blood cells of dogs with familial stomatocytosis hypertrophic gastritis, Blood 84:904-909.
Slob, 1997, Structural identifiability of Pbpk models: practical consequences for modeling strategies and study designs, Crit Rev Toxicol. 27(3):261-72.
Smith, 1985, The synthesis of oligonucleotides containing an aliphatic amino group at the 5' terminus: synthesis of fluorescent DNA primers for use in DNA sequence analysis, Nucl Acid Res 13:2399-2412.
Smith, 1986, Fluorescence detection in automated DNA sequence analysis, Nature 321:674-679.
Smith, 1989, Absolute displacement measurements using modulation of the spectrum of white light in a Michelson interferometer, Applied Optics, 28(16):3339-3342.
Smith, 1992, Direct mechanical measurements of the elasticity of single DNA molecules by using magnetic beads, Science 258(5085):1122-1126.
Smith, 2010, Highly-multiplexed barcode sequencing: an efficient method for parallel analysis of pooled samples, Nucleic Acids Res 38(13):e142.
Smyth, 2000, Markers of apoptosis: methods for elucidating the mechanism of apoptotic cell death from the nervous system, Biotechniques 32:648-665.
Sohn, 2000, Capacitance cytometry: Measuring biological cells one by one, PNAS 97(20):10687-10690.
Sola, 2014, Fabrication of a microfluidic cell made of thiolene for microarray applications, 18th Int Conf Miniaturized Systems for Chem and Life Sciences, MicroTAS, San Antonio, TX 1719-1721.
Somasundaram, 1999, Gain studies of Rhodamine 6G dye doped polymer laser, J Photochem Photobiol 125(1-3):93-98.
Song, 2002, Experimental test of scaling of mixing by chaotic advection in droplets moving through microfluidic channels, App Phy Lett 83(22):4664-4666.
Song, 2003, A microfluidic system for controlling reaction networks in time, Angew Chem Int Ed 42(7):768-772.
Song, 2003, Millisecond kinetics on a microluidic chip using nanoliters of reagents, J Am Chem Soc 125:14613-14619.
Song, 2006, Reactions in droplets in microlluidic channels, Angew chem Int ed 45(44):7336-7356.
Soni, 2007, Progress toward ultrafast DNA sequencing using solid-state nanopores, Clin Chem 53:1996-2001.
Abate, 2011, Synthesis of monidisperse microparticles from non-Newtonian polymer solutions with microfluidic devices, Adv Mat 23(15):1757-1760.
Adang, 2001, The contribution of combinatorial chemistry to lead generation: an interim analysis, Curr Med Chem 8:985-998.
Affholter 1999, Engineering a Revolution, Chemistry in Britain 48-51.
Agrawal, 1990, Site-specific functionalization of oligodeoxynucleotides for non-radioactive labelling, Tetrahedron Let 31:1543-1546.
Aharoni, 2005, High-Throughput screens and selections of enzyme-encoding genes, Curr Opin Chem Biol, 9(2):210-6.
Ahn, 2006, Dielectrophoretic manipulation of drops for high-speed microluidic sorting devices, Applied Phys Lett 88:024104.
Akasheh, 2004, Development of piezoelectric micromachined ultrasonic transducers, Sensors and Actuators A Physical, 111:275-287.
Allen, 2000, High throughput fluorescence polarization: a homogeneous alternative to radioligand binding for cell surface receptors J Biomol Screen. 5(2):63-69.
Ammar, 2003, UV/Vis absorption and fluorescence spectroscopic study of novel symmetrical biscoumarin dyes, Dyes and Pigments 57:259-265.
Amstutz, 2001, In vitro display technologies: novel developments and applications. Curr Opin Biotech 12:400-405.
Anarbaev, 1998, Klenow fragment and DNA polymerase alpha-primase fromserva calf thymus in water-in-oil rnicroemulsions, Biochim Biophy Acta 1384:315-324.
Anderson, 1983, Preparation of a cell-free protein-synthesizing system from wheat germ, Methods Enz 101:635-644.
Anderson, 1993, Restriction endonucleases and modification methylases, Curr Op Struct Biol 3:24-30.
Ando, 1999, PLGA microspheres containing plasmid DNA: preservation of supercoiled DNA via cryopreparation and carbohydrate stabilization, J Pharm Sci 88(1):126-130.

(56) References Cited

OTHER PUBLICATIONS

Angell, 1983, Silicon micromechanical devices, Scientific Am 248:44-55.
Anhuf, 2003, Determination of SMN1 and SMN2 copy number using TaqMan technology, Hum Mutat 22(1):74-78.
Anna, 2003, Formation of dispersions using flow focusing in microchannels, Appl Phys Lett82(3):364-366.
Armstrong, 1996, Multiple-Component condensation strategies for combinatorial library synthesis, Acc Chem Res 29(3):123-131.
Ashkin, 1987, Optical trapping and manipulation of single cells using infrared laser beams, Nature 330:769-771.
Ashkin, 1987, Optical trapping and manipulation of viruses and bacteria, Science 235(4795):1517-20.
Auroux, 2002, Micro Total Analysis Systems 2: Analytical standard operations and applications, Anal Chem 74(12):2637-2652.
Baccarani, 1977, *Escherichia coli* dihydrofolate reductase: isolation and characterization of two isozymes, Biochemistry 16(16):3566-72.
Bagwe, 2001, Improved drug delivery using microemulsions: rationale, recent progress, and new horizons, Crit Rev Ther Drug Carr Sys 18(1):77-140.
Baker, 2010, Clever PCR: more genotyping, smaller volumes, Nat Meth 7:351-356.
Ballantyne, 1973, Selective area metallization by electron-beam controlled direct metallic deposition, J Vac Sci Tech 10:1094.
Barany, 1991, Genetic disease detection and DNA amplification using cloned thermostable ligase, PNAS 88(1):189-93.
Barany, 1991, The ligase chain reaction in a PCR World, PCR Meth App 1(1):5-16.
Baret, 2009, Fluorescence-activated droplet sorting (FADS): efficient microfluidic cell sorting based on enzymatic activity, Lab Chip 9:1850-1858.
Baret, 2009, Kinetic aspects of emulsion stabilization by surfactants: a microfluidic analysis, Langmuir 25:6088-6093.
Baroud, 2004, Multiphase flows in microfluidics, Physique 5:547-555.
Bauer, 1999, Advances in cell separation: recent developments in counterflow centrifugal elutriation and continuous flow cell separation, J Chromot 722:55-69.
Beebe, 2000, Functional hydrogel structures for autonomous flow control inside microfluidic channels, Nature 404:588-590.
Beer, 2007, On-chip, real-time, single-copy polymerase chain reaction in picoliter droplets, Anal Chem 79(22):8471-8475.
Beer, 2008, On-chip single-copy real-time reverse transcription PCR in isolated picoliter droplets, Anal Chem 80(6):1854-1858.
Bein, 1999, Efficient assays for combinatorial methods for the eiscovery of catalysts, Agnew Chem Int Ed 38:3:323-26.
Benichou, 2002, Double emulsions stabilized by new molecular recognition hybrids of natural polymers, Polym Adv Tech 13:1019-1031.
Benner, 1994, Expanding the genetic lexicon, Trends Biotech 12:158-63.
Benning, 2000, The binding of substrate analogs to phosphotriesterase. J Biol Chem 275:30556-30560.
Berman, 1987, An agarose gel electrophoresis assay for the detection of DNA-binding activities in yeast cell extracts, Meth Enz 155:528-37.
Bernath, 2004, In Vitro Compartmentalization by double emulsions: sorting and gene enrichment by FACS Anal Biochem 325:151-157.
Bernath, 2005, Directed evolution of protein inhibitors of DNA-nucleases by in vitro compartmentalization (IVC) and nano-droplet delivery, J Mol Biol 345(5):1015-26.
Betlach, 1976, A restriction endonuclease analysis of the bacterial plasmid controlling the EcoRI restriction and modification of DNA, Fed Proc 35:2037-2043.
Bibette, 1999, Emulsions: basic principles, Rep Prog Phys 62:969-1033.
Bico, 2002, Rise of liquids and bubbles in angular capillary tubes, J Colloid & Interface Sc 247:162-166.
Bico, 2002, Self-Propelling Slugs, J Fluid Mech 467:101-127.
Binder, 2009, Mismatch and G-stack modulated probe signals on SNP microarrays, PLoS One, 4(11):e7862.
Binladen, 2007, The use of coded PCR primers enables high-throughput sequencing of multiple homolog amplification products by 454 parallel sequencing, PLoSOne 2(2):e197.
Blanchet, 1993, Laser Ablation and the Production of Polymer Films, Science, 262(5134):719-721.
Boder, 1997, Yeast surface display for screening combinatorial polypeptide libraries, Nat Biotech 15(6):553-7.
Bosque, 2009, Induction of HIV-1 latency and reactivation in primary memory CD4+ T cells, Blood, 113(1):58-65.
Luft, 20001, Detection of integrated papillomavirus sequences by ligation-mediaated PCR (DIPS-PCR) and molecular characterization in cervical cancer cells, In J Cancer 92:9-17.
Luisi, 1987, Activity and conformation of enzymes in reverse micellar solutions, Meth Enzymol 136:188-216.
Lund, 1988, Assesment of methods for covalent binding of nucleic acids to magnetic beads, Dynabeads, and the characteristics of the bound nucleic acids in hybridization reactions, Nucleic Acids Res 16(22):10861-10880.
Lunderberg, 1995, Solid-phase technology: magnetic beads to improve nucleic acid detection and analysis, Biotech Ann Rev 1:373-401.
Lundstrom, 2002, Breakthrough in cancer therapy: Encapsulation of drugs and viruses, Curr Drug Disc 19-23.
Lyne, 2002, Structure-based virtual screening: an overview, Drug Disc Tod 7(20):1047-1055.
Ma, 1993, In vitro protein engineering using synthetic tRNA(Ala) with different anticodons, Biochemistry 32(31):7939-45.
Mackenzie, 1985, IABS Symposium on Reduction of Animal Usage in the Development and Control of Biological Products, London, UK, 16 pages.
Mackenzie, 1986, The application of flow microfluorimetry to biomedical research and diagnosis: a review, Dev Biol Stand 64:181-193.
Maclean, 1999, Glossary of terms used in combinatorial chemistry, Pure Appl. Chem. 71(12):2349-2365.
Magdassi, 1984, Multiple Emulsions: HLB Shift Caused by Emulsifier Migration to External Interface, J. Colloid Interface Sci 97:374-379.
Mahajan, 1998, Bcl-2 and Bax Interactions in Mitochondria Probed with Green Florescent Protein and Fluorescence Resonance Energy Transfer, Nat. Biotechnol. 16(6): 547-552.
Mahjoob, 2008, Rapid microfluidic thermal cycler for polymerase chain reaction nucleic acid amplification. Int J HeatMass Transfer;51:2109-22.
Manafi, 2000, New developments in chromogenic and fluorogenic culture media, 2000, International Journal of Food Microbiology, 60, 205-218.
Manley, 1983, In vitro transcription: whole cell extract, Methods Enzymol, 101:568-82.
Manz, 1991, Micromachining of monocrystalline silicon and glass for chemical analysis systems A look into next century's technology or just a fashionable craze, Trends in Analytical Chemistry 10(5):144-149.
Mao, 1991, Substrate effects on the enzymatic activity of alphachymotrypsin in reverse micelles, Biochem Biophys Res Commun, 178(3):1105-12.
Mao, 1992, Kinetic behaviour of alpha-chymotrypsin in reverse micelles: a stopped-flow study, Eur J Biochem 208(1):165-70.
Mardis, 2008, The impact of next-generation sequencing technology on genetics, Trends Genet 24:133-141.
Margulies, 2005, Genome sequencing in microfabricated high-density picolitre reactors, Nature 437(7057):376-380.
Marks, 1992, Bypassing immunization: building high affinity human antibodies by chain shuffling, BioTechnol 10:779-783.
Marques, 1996, Porous Flow within Concentric Cylinders, Bull Am Phys Soc Div Fluid Dyn 41:1768, 1 page.
Maruno, 1991, Fluorine containing optical adhesives for optical communications systems, J. Appl. Polymer. Sci. 42:2141-2148.
Mason, 1997, Shear Rupturing of Droplets in Complex Fluids, Langmuir, 13(17):4600-4613.

(56) References Cited

OTHER PUBLICATIONS

Mastrobattista, 2005, High-throughput screening of enzyme libraries: in vitro evolution of a beta-galactosidase by fluorescence-activated sorting of double emulsions, Chem. Biol. 12(12): 1291-1300.
Masui, 1998, Probing of DNA-Binding Sites of *Escherichia coli* RecA Protein Utilizing 1-anilinonaphthalene-8-Sulfonic Acid, Biochem 37(35):12133-12143.
Matayoshi, 1990, Novel fluorogenic substrates for assaying retroviral proteases by resonance energy transfer, Science 247:954.
Matsubara, 2003, Detection of Single Nucleotide Substitution by Competitive Allele-Specific Short Oligonucleotide Hybridization (CASSOH) With Ummunochromatographic Strip, Human Mutation 22:166-172.
Mattheakis, 1994, An in vitro polysome display system for identifying ligands from very large peptide libraries, PNAS 1:9022-6.
Mayr, 2008, The Future of High-Throughput Screening, JBiomol Screen 13:443-448.
Mazutis, 2009, Droplet-Based Microfluidic Systems for High-Throughput Single DNA Molecule Isothermal Amplification and Analysis, Anal Chem 81(12):4813-4821.
Mazutis, 2009, Multi-step microfluidic droplet processing: kinetic analysis of an in vitro translated enzyme, Lab Chip 9:2902-2908.
McDonald, 2000, Fabrication of microfluidic systems in poly(dimethylsiloxane), Electrophoresis 21(1):27-40.
McDonald, 2002, Poly(dimethylsiloxane) as a material for fabricating microfluidic devices, Account Chem. Res. 35:491-499.
Melton, 1984, Efficient in vitro synthesis of biologically active RNA and RNA hybridization probes from plasmids containing a bacteriophage SP6 promoter, Nucl. Acids Res. 12(18):7035-7056.
Mendel, 1995, Site-Directed Mutagenesis with an Expanded Genetic Code, Annu Rev Biophys Biomol Struct, 24:435-62.
Mendieta, 1996, Complementary sequence correlations with applications to reflectometry studies, Instrumentation and Development 3(6):37-46.
Metzker, 2010, Sequencing Technologies—the next generation, Nature Reviews, vol. 11, pp. 31-46.
Meylan, 1995, Atom/fragment contribution method for estimating octanol-water partition coefficients, J Pharm Sci. 84(1):83-92.
Michalatos-Beloin, 1996, Molecular haplotyping of genetic markers 10 kb apart by allele-specific long-range PCR, Nucleic Acids Research, 24:4841-4843.
Miele, 1983, Autocatalytic replication of a recombinant RNA, J Mol Biol, 171:281-95.
Milstein, 1983, Hybrid hybridomas and their use in immunohistochemistry, Nature 305:537-540.
Mindlin, 1936, A force at a point of a semi-infinite solid, Physics, 7:195-202.
Minshuil, 1999, Protein evolution by molecular breeding, Curr Opin Chem Biol 3(3): 284-90.
Miroux, 1996, Over-production of proteins in *Escherichia coli*: mutant hosts that allow synthesis of some membrane proteins and globular proteins at high levels, J of Mol Biol 260(3):289-98.
Miyawaki, 1997, Fluorescent Indicators for Ca2+ Based on Green Fluorescent Proteins and Calmodulin, Nature, 388:882-887.
Mize, 1989, Dual-enzyme cascade—an amplified method for the detection of alkaline phosphatase, Anal Biochem 179(2): 229-35.
Mock, 1985, A fluorometric assay for the biotin-avidin interaction based on displacement of the fluorescent probe 2-anilinonaphthalene-6-sulfonic acid, Anal Biochem, 151:178-81.
Moldavan, 1934, Photo-electric technique for the counting of microscopical cells, Science 80:188-189.
Monie, 2005, A Novel Assay Allows Genotyping of the Latent Reservoir for Human Imnunodefi ciency Virus Type 1 in the Resting CD4+ T Cells of Viremic Patients, Journal of Virology, 79(8):5185-5202.
Trolier-McKinstry, 2004, Thin Film Piezoelectric for MEMS, Journal of Electroceramics 12:7-17.
Tsuchiya, 2007, On-chip polymerase chain reaction microdevice employing a magnetic droplet-manipulation system, Sens Actuators B 130:583-588.
Tuzel, 2006, Region Covariance: A Fast Descriptor for Detection and Classification, European Conference on Computer Vision (ECCV), 14 pages.
Umbanhowar, 2000, Monodisperse Emulsion Generation via Drop Break Off in a Coflowing Stream, Langmuir 16(2):347-351.
Unger, 2000, Monolithic microfabricated valves and pumps by multylayer soft lithography, Science 288(5463):113-116.
Utada, 2005, Monodisperse double emulsions generated from a microcapillary device, Science, 308:537-541.
Vainshtein, 1996, Peptide rescue of an N-terminal truncation of the stoffel fragment of Taq DNA polymerase, Protein Science, 5:1785-92.
Van der Sluis, 2013, Dendritic Cell-induced Activation of Latent HIV-1 Provirus in Actively Proliferating Primary T Lymphocytes, PLOS Pathog. 9(3): 16 pages.
Van Dilla, 1968, The fluorescent cell photometer: a new method for the rapid measurement of biological cells stained with fluorescent dyes, Annual Report of the Los Alamos Scientific Laboratory of the University of California (Los Alamos, NM), Biological and Medical Research Groupp (H-4) of the Health Division, Compiled by D. G. Ott, pp. 100-105.
Van Dilla, 1969, Cell Microfluorometry: A Method for Rapid Fluorescence Measurement, Science 163(3872):1213-1214.
Vanhooke, 1996, Three-dimensional structure of the zinc-containing phosphotrieesterase with the bound substrate analog diethy 4-methylbenzylphosphonate, Biochemistry 35:6020-6025.
Varga, 1991, Mechanism of allergic cross-reactions—I. Multispecific binding of ligands to a mouse monoclonal anti-DNP IgE antibody. Mol Immunol 28(6), 641-54.
Vary, 1987, A homogeneous nucleic acid hybridization assay based on strand displacement, Nucl Acids Res 15(17):6883-6897.
Venkateswaran, 1992, Production of Anti-Fibroblast Growth Factor Receptor Monoclonal Antibodies by In Vitro Immunization, Hybirdoma, 11(6):729-739.
Verhoeyen, 1988, Reshaping human antibodies: grafting an antilysozyme activity, Science, 239:1534-1536.
Vogelstein, 1999, Digital PCR, PNAS 96(16):9236-9241.
Voss, 1993, Kinetic measurements of molecular interactions by spectrolluorometry, J Mol Recognit, 6:51-58.
Wahler, 2001, Novel methods for biocatalyst screening. Curr Opin Chem Biol, 5: 152-158.
Walde, 1988, Structure and activity of trypsin in reverse micelles, Eur J Biochem, 173(2):401-9.
Walde, 1993, Spectroscopic and kinetic studies of lipases solubilized in reverse micelles, Biochemistry, 32(15):4029-34.
Walde, 1994, Oparin's reactions revisited: enzymatic synthesis of poly(adenylic acid) in micelles and self-reproducing vesicles. J Am Chem Soc, 116: 7541-7547.
Walker, 1992, Isothermal in vitro amplification of DNA by a restriction enzyme/DNA polymerase system, PNAS 89(1):392-6.
Walker, 1992, Strand displacement amplification—an isothermal, in vitro DNA amplification technique, Nucleic Acid Res, 20(7):1691-6.
Wang, 1989, Quantitation of mRNA by the polymerase chain reaction. Proc natl Acad Sci USA 86(24), 9717-21.
Wang, 1990, Design and synthesis of new fluorogenic Hiv protease substrates based on resonance energy transfer, Tetrahedron Lett., 31:6493.
Wang, 2002, Preparation of Titania Particles Utilizing the Insoluble Phase Interface in a MicroChannel Reactor, Chemical Communications 14:1462-1463.
Wang, 2008, DEP actuated nanoliter droplet dispensing using feedback control, Lab on a Chip 9:901-909.
Wang, 2010, Quantifying EGFR Alterations in the Lung Cancer Genome with Nanofluidic Digital PCR Arrays, Clinical Chemistry 56:4.
Warburton, 1993, Microcapsules for Multiple Emulsions, Encapsulation and Controlled Release, Spec Publ R Soc Chem, 35-51.

(56) References Cited

OTHER PUBLICATIONS

Wasserman, 1989, Structure and reactivity of allyl-siloxane monolayers formed by reaction of allcyltrichlorosilanes on silicon substrates, Langmuir 5:1074-1087.
Weaver, 2010, Taking qPCR to a higher level: Analysis of CNV reveals the power of high throughput qPCR to enhance quantitative resolution, Methods 50, 271-276.
Weil, 1979, Selective and accurate initiation of transcription at the Ad2 major late promotor in a soluble system dependent on purified RNA polymerase II and DNA, Cell, 18(2):469-84.
Werle, 1994, Convenient single-step, one tube purification of PCR products for direct sequencing, Nucl Acids Res 22(20):4354-4355.
Wetmur, 2005, Molecular haplotyping by linking emulsion PCR: analysis of paraoxonase 1 haplotypes and phenotypes, Nucleic Acids Res 33(8):2615-2619.
White, 2009, Digital PCR provides sensitive and absolute calibration for high throughput sequencing, BMC Genomics 10:116.
Wick, 1996, Enzyme-containing liposomes can endogenously produce membrane-constituting lipids, Chem Biol 3(4):277-85.
Wiggins, 2004, Foundations of chaotic mixing, Philos Transact A Math Phys Eng Sci 362(1818):937-70.
Williams, 1979, Methotrexate, a high-affinity pseudosubstrate of dihydrofolate reductase, Biochemistry, 18(12):2567-73.
Williams, 2006, Amplification of complex gene libraries by emulsion PCR, Nature Methods 3(7):545-550.
Wilson, 1999, In vitro selection of functional nucleic acids, Ann. Rev. Biochem. 68: 611-647.
Wittrup, 2001, Protein engineering by cell-surface display. Curr Opin Biotechnology, 12: 395-399.
Wittwer, 1989, Automated polymerase chain reaction in capillary tubes with hot air, Nucleic Acids Res., 17(11) 4353-4357.
Wittwer 1990, Minimizing the Time Required for DNA Amplification by Efficient Heat Transfer to Small Samples, Anal. Biochem., 186, 328-331.
Wolff, 2003, Integrating advanced functionality in a microfabricated high-throughput fluorescent-activated cell sorter, Lab Chip, 3(1): 22-27.
Woolley, 1994, Ultra-high-speed DNA fragment separations using microfabricated capillary array electrophoresis chips, Proc. Natl. Acad. Sci. USA, 91, 11348-11352.
Woolley, 1996, Functional Integration of PCR Amplification and Capillary Electrophoresis in a Microfabricated DNA Analysis Device, Anal. Chem. 68, 4081-4086.
Wronski, 2002, Two-color, fluorescence-based microplate assay for apoptosis detection. Biotechniques, 32:666-668.
Wu, 1989, the ligation amplification reaction (LAR)-amplification of specific DNA sequences using sequential rounds of template-dependent ligation, Genomics 4(4):560-9.
Wyatt, 1991, Synthesis and purification of large amounts of RNA oligonucleotides, Biotechniques 11(6):764-9.
Xia, 1998, Soft Lithography, Angew. Chem. Int. Ed. 37:550-575.
Elghanian, 1997, Selective colorimetric detection of polynucleotides based on the distance-dependent optical properties of gold nanoparticles, Science, 277(5329):1078-1080.
Ellington, 1990, In vitro selection of RNA molecules that bind specific ligands, Nature, 346:818-822.
Ellman, 1991, Biosynthetic method for introducing unnatural amino acids site-specifically into proteins, Methods Enzymol, 202:301-36.
Endo, 1996, Autocatalytic decomposition of cobalt complexes as an indicator system for the determination of trace amounts of cobalt and effectors, Analyst 121:391-394.
Endo, 1998, Kinetic determination of trace cobalt by visual autocatalytic indication, Talanta 47:349-353.
Engl, 2005, Droplet Traffic at a Simple Junction at Low Capillary Nos. Physical Review Letters, vo1.95, 208304, 1 page.
Eow, 2002, Electrocoalesce-separators for the separation of aqueous drops from a flowing dielectric viscous liquid, Separation and Purification Tech 29:63-77.
Eow, 2002, Electrostatic and hydrodynamic separation of aqueous drops in a flowing viscous oil, Chemical Eng Proc 41:649-657.
Eow, 2002, Electrostatic enhancement of coalescence of water droplets in oil: a review of the technology, Chemical Engineeing Journal 85:357-368.
Eow, 2003, Motion, deformation and break-up of aqueous drops in oils under high electric field strengths, Chemical Eng Proc 42:259-272.
Eow, 2003, The behavior of a liquid-liquid interface and drop-interface coalescence under the influence of an electric field, Colloids and Surfaces A: Physiochern. Eng. Aspects 215:101-123.
Eriksson, 2013, Comparative analysis of measures of viral reservoirs in HIV-1 eradication studies, PLoS Pathogens 9(2):e1003174, 17 pages.
Faca, 2008, A mouse to human search for plasma proteome changes associated with pancreatic tumor development, PLoS Med 5(6):e123:0953-0967.
Fahy, 1991, Self-sustained sequence replication (35R): an isothermal transcription-based amplification system alternative to PCR, PCR Methods Appl 1:25-33.
Fan, 1994, Micromachining of capillary electrophoresis injectors and separators on glass chips and evaluation of flow at capillary intersections, Anal Chem 66:177-184.
Fran, 2007, Detection of Aneuploidy with Digital PCR, available at https://arxiv.org/ftp/arxiv/papers /0705/0705.1 030.pdf, 16 pages.
Fastrez 1997, In vivo versus in vitro screening or selection for catalytic activity in enzymes and abzymes, Mol Biotechnol 7(1):37-55.
Fellinger, 1993, Stacked modules for micro flow systems in chemical analysis: concept and studies using an enlarged model, Sens Actuat B. 17:19-25.
Fiedler, 1998, Dielectrophoretic sorting of particles and cells in a microsystem, Anal Chem 70(9):1909-1915.
Field, 1988, Purification of a RAS-responsive adenylyl cyclase complex from *Saccharomyces cervisiae* by use of an epitope addition method. Mol Cell Biol, 8: 2159-2165.
Fields, 1989, A novel genetic system to detect protein-protein interactions, Nature 340(6230):245-6.
Filella, 1994, TAG-72, CA 19.9 and CEA as tumor markers in gastric cancer, Acta Oncol. 33(7):747-751.
Finch, 1993, Encapsulation and controlled release, Spec Publ R Soc Chem, 138:35, 12 pages.
Fingas, 1997, Studies of Water-In-Oil Emulsions: Stability Studies, Environment Canada, Proceedings of the Twentieth Arctic Marine Oilspill Program Technical Seminer, 1-20.
Fire, 1995, Rolling replication of short DNA circles, PNAS 92(10):4641-5.
Firestine, 2000, Using an AraC-based three hybrid system to detect biocatalysts in vivo, Nat Biotechnol 18: 544-547.
Fisher, 2004, Cell Encapsulation on a Microfluidic Platform, the Eighth International Conference on Miniaturised Systems for Chemistry and Life Scieces, MicroTAS, Malmo, Sweden.
Fletcher, 2002, Micro reactors: principles and applications in organic synthesis, Tetrahedron 58:4735-4757.
Fluri, 1996, Integrated capillary electrophoresis devices with an efficient postcolumn reactor in planar quartz and glass chips, Anal Chem 68:4285-4290.
Fornusek, 1986, Polymeric microspheres as diagnostic tools for cell surface marker tracing, Crit Rev Ther Drug Carrier Syst, 2:137-74.
Fowler, 2002, Enhancement of Mixing by Droplet-Based Microfluidics, Int Conf MEMS 97-100.
Frenz, 2008, Reliable microfluidic on-chip incubation of droplets in delay-lines, Lab on a Chip 9:1344-1348.
Fu, 1999, A microfabricated fluorescence-activated cell sorter, Nature Biotechnology, 17(11):1109-1111.
Fu, 2002, An Integrated Microfabricated Cell Sorter, Anal. Chem., 74: 2451-2457.
Fulton, 1997, Advanced multiplexed analysis with the FlowMetrix system, Clin Chem 43:1749-1756.
Fulwyler, 1965, Electronic Separation of Biological Cells by Volume, Science 150(3698):910-911.
Galan, 2010, A 454 multiplex sequencing method for rapid and reliable genotyping of highly polymorphic genes in large-scale studies., BMC Genomics 11(296):1-15.

(56) References Cited

OTHER PUBLICATIONS

Gallarate, 1999, On the stability of ascorbic acid in emulsified systems for topical and cosmetic use, Int J Pharm 188(2):233-241.
Ganan-Calvo, 1998, Generation of Steady Liquid Microthreads and Micron-Sized Monodisperse Sprays and Gas Streams, Phys Rev Lett 80(2):285-288.
Ganan-Calvo, 2001, Perfectly Monodisperse Microbubbling by Capillary Flow Focusing, Phys Rev Lett 87(27): 274501-1-4.
Garcia-Ruiz, 1994, Investigation on protein crystal growth by the gel acupuncture method, Acta, Cryst., D50, 99. pp. 484-490.
Garcia-Ruiz, 2001, A super-saturation wave of protein crystallization, J. Crystal Growth, 232:149-155.
Garstecki, 2004, Formation of monodisperse bubbles in a microfiuidic flow-focusing device, Appl Phys Lett 85(13):2649-2651.
Gasperlin, 1994, The structure elucidation of semisolid w/o emulsion systems containing silicone surfactant, Intl J Pharm, 107:51-6.
Gasperlin, 2000, Viscosity prediction of lipophillic semisolid emulsion systems by neural network modeling, Intl J Pharm, 196:37-50.
Gelderblom, 2008, Viral complemntation allows HIV-1 replication without integration, Retrovirology 5:60.
Georgiou, 1997, Display of heterologous proteins on the surface of microorganisms: from the screenign of combinatiorial libraires to live recombinant vaccines. Nat Biotechnol 15(1), 29-34.
Georgiou, 2000, Analysis of large libraries of protein mutants using flow cytometry, Adv Protein Chem, 55: 293-315.
Gerdts, 2004, A Synthetic Reaction NetWork: Chemical Amplification Using Nonequilibrium Autocatalytic Reactions coupled in Time, J. Am. Chem. Soc 126:6327-6331.
Ghadessy, 2001, Directed Evolution of Polymerase Function by Compartmentalized Self-Replication, PNSAS 98(8):4552-4657.
Bougueleret, 1984, Characterization of the gene coding for the EcoRV restriction and modification system of *E coli*, Nucleic Acids Res 12(8):3659-76.
Branebjerg, 1996, Fast mixing by lamination, MEMS Proc 9th Ann 9:441-446.
Braslavsky, 2003, Sequence information can be obtained from single DNA molecules, PNAS 100(7):3960-3964.
Breslauer, 2006, Microfluidics based systems biology, Mol Bio Syst 2:97-112.
Bringer, 2004, Microfluidic systems for chemical kinetics that rely on chaotic mixing in droplets, Phil Trans A Math Phys Eng Sci 362:1-18.
Brown, 1979, Chemical synthesis and cloning of a tyrosine tRNA gene, Methods Enzymol 68:109-151.
Bru, 1991, Product inhibition of alpha-chymotrypsin in reverse micelles. Eur J Biochem 199(1):95-103.
Bru, 1993, Catalytic activity of elastase in reverse micelles, Biochem Mol Bio Int, 31(4):685-92.
Brummelkamp, 2002, A system for stable expression of short interfering RNAs in mammalian cells, Science 296(5567):550-3.
Buican, 1987, Automated single-cell manipulation and sorting by light trapping, Appl Optics 26(24):5311-5316.
Burbaum, 1998, Miniaturization technologies in HTS, Drug Disc Today 3:313-322.
Burns, 1996, Microfabricated structures for integrated DNA analysis, PNAS 93:5556-5561.
Burns, 1998, An integrated nanoliter DNA analysis device, Science 282:484-487.
Burns, 2002, The intensification of rapid reactions in multiphase systems using slug flow in capillaries, Lab on a Chip 1:10-15.
Byrnes, 1982, Sensitive fluorogenic substrates for the detection of trypsin-like proteases and pancreatic elastase, Anal Biochem 126:447.
Cahill, 1991, Polymerase chain reaction and Q beta replicase amplification, Clin Chem 37(9):1482-5.
Caldwell, 1991, Limits of diffusion in the hydrolysis of substrates by the phosphodiesterase from Pseudomonas diminuta, Biochem 30:7438-7444.
Calvert, 2001, Inkjet printing for materials and devices, Chem Mater 13:3299-3305.
Caruccio, 2009, Nextura technology for NGS DNA library preparation: simulaneous fragmentation and tagging by in vitro transposition, Epibio Newsletter.
Caruthers, 1985, Gene synthesis machines: DNA chemistry and its uses, Science 230:281-285.
Cavalli, 2010, Nanosponge formulations as oxygen delivery systems, Int J Pharmaceutics 402:254-257.
Chakrabarti, 1994, Production of RNA by a polymerase protein encapsulated within phospholipid vesicles, J Mol Evol 39(6):555-9.
Chamberlain, 1973, Characterization of T7-specific ribonucleic acid polymerase. 1. General properties of the enzymatic reaction and the template specificity of the enzyme, J Biol Chem 248:2235-44.
Chan, 2003, Size-Controlled Growth of CdSe Nanocrystals in Microfluidic Reactors, Nano Lett 3(2):199-201.
Chan, 2008, New trends in immunoassays, Adv Biochem Engin/Biotech 109:123-154.
Chang, 1987, Recycling of NAD(P) by multienzyme systems immobilized by microencapsulation in artifical cells, Methods Enzymol, 136(67):67-82.
Chang, 2008, Controlled double emulsification utilizing 3D PDMS microchannels, Journal of Micromechanics and Microengineering 18:1-8.
Chao, 2004, Control of Concentration and Volume Gradients in Microfluidic Droplet Arrays for Protein Crystallization Screening, 26th Annual International Conference of the IEEE Engineering in Medicine and Biology Society, San Francisco, California Sep. 1-5.
Chao, 2004, Droplet Arrays in Microfluidic Channels for Combinatorial Screening Assays, Hilton Head: A Solid State Sensor, Actuator and Microsystems Workshop, Hilton Head Island, South Carolina, Jun. 6-10.
Chapman, 1994, In vitro selection of catalytic RNAs, Curr. op. Struct. Biol., 4:618-22.
Chayen, 1999, Crystallization with oils: a new dimension in macromolecular crystal growth Journal of Crystal Growth,196:434-441.
Chen, 2001, Capturing a Photoexcited Molecular Structure Through Time-Domain X-ray Absorption Fine Structure, Science 292(5515):262-264.
Chen, 2003, Microfluidic Switch for Embryo and Cell Sorting the 12th International Conference on Solid State Sensors, Actuators, and Microsystems, Boston, MA, Transducers, 1: 659-662.
Chen-Goodspeed, 2001, Enhancement, relaxation, and reversal of the stereoselectivity for phosphotriesterase by rational evolution of active site residues, Biochemistry, 40: 1332-1339.
Chen-Goodspeed, 2001, Structural Determinants of the substrate and stereochemical specificity of phosphotriesterase, Biochemistry, 40(5):1325-31.
Cheng, 2003, Electro flow focusing inmicrofluidic devices, Microfluidics Poster, presented at DBAS, Frontiers in Nanoscience, 1 page.
Cheng, 2006, Nanotechnologies for biomolecular detection and medical diagnostics, Current Opinion in Chemical Biology, 10:11-19.
Chetverin, 1995, Replicable RNA vectors: prospects for cell-free gene amplification, expression, and cloning, Prog Nucleic Acid Res Mol Biol, 51:225-70.
Chiang, 1993, Expression and purification of general transcription factors by FLAG epitope-tagging and peptide elution, Pept Res, 6:62-64.
Chiba, 1997, Controlled protein delivery from biodegradable tyrosino-containing poly(anhydride-co-imide) microspheres, Biomaterials, 18(13):893-901.
Chiou, 2001, A closed-cycle capillary polymerase chain reaction machine, Analytical Chemistry, American Chamical Society, 73:2018-21.
Chiu, 1999, Chemical transformations in individual ultrasmall biomimetic containers, Science, 283:1892-1895.
Chou, 1998, A microfabricated device for sizing and sorting DNA molecules 96:11-13.
Clackson, 1994, In vitro selection from protein and peptide libraries, Trends Biotechnol, 12:173-84.
Clausell-Tormos, 2008, Droplet-based microfluidic platforms for the encapsulation and screening of Mammalian cells and multicellular organisms, Chem Biol 15(5):427-437.

(56) References Cited

OTHER PUBLICATIONS

Cohen, 1991, Controlled delivery systems for proteins based on poly(lactickilycolic acid) microspheres, Pharm Res, 8(6):713-720.
Collins, 2003, Optimization of Shear Driven Droplet Generation in a Microluidic Device, ASME International Mechanical Engineering Congress and R&D Expo, Washington, 4 pages.
Collins, 2004, Microlluidic flow transducer based on the measurements of electrical admittance, Lab on a Chip, 4:7-10.
Compton, 1991, Nucleic acid sequence-based amplification, Nature, 350(6313):91-2.
Cook, 2007, Use and misuse of receiver operating characteristic curve in risk prediction, Circulation 115(7):928-35.
Gibbs, 1989, Detection of single DNA base differences by competitive oligonucleotide priming, Nucleic Acids Res. 17(7): 2437-48.
Gilliland, 1990, Analysis of cytokine mRNA and DNA: Detection and quantitation by competitive polymerase chain reaction, PNAS, 87(7):2725-9.
Giusti,1993, Synthesis and characterization of 5' fluorescent dye labeled oligonucleotides, Genome Res 2:223-227.
Glass, 1995, Development of primer sets designed for use with the PCR to amlify conserved genes from filamentous ascomycetes, Applied and Environmental Microbiology, vol. 6, pp. 1323-1330.
Gold, 1995, Diversity of Oligonucleotide Functions Annu Rev Biochem, 64: 763-97.
Gong, 2015, Simple method to prepare oligonucleotide conjugated antibodies and its applicaiotn in multiplex protein detection in single cells, Bioconjugate Chm 27(1):271-225.
Goodall, 1998, Operation of Mixed-Culture Immobilized Cell Reactors for the Metabolism of Meta- and Para-Nitrobenzoate by *Comamonas* Sp. JS46 and *Comamonas* Sp. JS47, Biotechnology and Bioengineering, 59 (1): 21-27.
Gordon, 1999, Solid phase synthesis—designer linkers for combinatorial chemistry: a review, J. Chem. Technol. Biotechnol., 74(9):835-851.
Grasland-Mongrain, 2003, Droplet coalescence in microfluidic devices, 30 pages, From internet: http://www.eleves.ens.fr/home/grasland/rapports/stage4.pdf.
Gray, 1987, High speed crhomosome sorting, Science 238(4825):323-329.
Green, 1992, Selection of a Ribozyme That Functions as a Superior Template in a Self Copying Reaction, Science, 258: 1910-5.
Gregoriadis, 1976, Enzyme entrapment in liposomes, Methods Enzymol 44:218-227.
Griffiths, 2000, Man-made enzymes-from design to in vitro compartmentalisation, Curr Opin Biotechnol 11:338-353.
Griffiths, 2003, Directed evolution of an extremely fast phosphotriesterase by in vitro compartmentalization, EMBO J, 22:24-25.
Griffiths, 2006, Miniaturising the laboratory in emulsion droplets, Trend Biotech 24(9):395-402.
Grinwood, 2004, The DNA sequence and biology of human chromosome 19, Nature 428:529-535.
Grothues, 1993, PCR amplification of megabase DNA with tagged random primers (T-PCR), Nucl. Acids Res vol. 21(5):1321-1322.
Grund, 2010, Analysis of biomarker data:logs, odds, ratios and ROC curves, Curr Opin HIV AIDS 5(6):473-479.
Guatelli, 1990, Isothermal, in vitro amplification of nucleic acids by a multienzyme reaction modeled after retroviral replication, PNAS, 87(5):1874-8.
Guixe, 1998, Ligand-Induced Conformational Transitions in *Escherichia coli* Phosphofructokinase 2: Evidence for an Allosteric Site for MgATP2n, Biochem., 37: 13269-12375.
Gupta, 1991, A general method for the synthesis of 3'-sulfhydryl and phosphate group containing oligonucleotides, Nuel Acids Res 19 (11): 3019-3026.
Haber, 1993, Activity and spectroscopic properties of bovine liver catalase in sodium bis(2-ethylhexyl) sulfosuccinate/isooctane reverse micelles, Eur J Biochem 217(2): 567-73.
Habig, 1981, Assays for differentiation of glutathione S-transferases, Methods in Enzymology, 77: 398-405.
Hadd, 1997, Microchip Device for Performing Enzyme Assays, Anal. Chem 69(17): 3407-3412.
Haeberle, 2007, Microfluidic platforms for lab-on-a-chip applications, Lab on a Chip 7:1081-1220.
Hagar, 1992, The effect of endotoxemia on concanavalin A induced alterations in cytoplasmic free calcium in rat spleen cells as determined with Fluo-3, Cell Calcium 13:123-130.
Hai, 2004, Investigation on the release of fluorescent markers from the wlolw emulsions by fluorescence-activated cell sorter, J Control Release, 96(3): 393-402.
Haies, 1981, Morphometric study of rat lung cells. I. Numerical and dimensional characteristics of parenchymal cell population, Am. Rev. Respir. Dis. 123:533-54.
Hall, 2003, The EBG system of *E. coli*: origin and evolution of a novel beta-galactosidase for the metabolism of lactose, Genetica 118(2-3):143-56.
Hamady, 2008, Error-correcting barcoded primers for pyrosequencing hundreds of samples in multiplex. Nature Nethods vol. 5, No. 3, p. 235-237.
Han, 2001, Quantum-dot-tagged Microbeads for Multiplexed Optical Coding of Biomolecules, Nat Biotech 19(7):331-635.
Handen, 2002, High-throughput screening—challenges for the future, Drug Discov World, 47-50.
Handique, 2001, On-Chip Thermopneumatic Pressure for Discrete Drop Pumping, Analytical Chemistry, 73:1831-1838.
Hanes, 1997, In vitro selection and evolution of functional proteins by using ribosome display, PNAS 94:4937-42.
Hanes, 1998, Degradation of porous poly(anhydide-co-imide) microspheres and implication for controlled macromolecule delivery, Biomaterials, 19(1-3): 163-172.
Hansen, 2002, A robust and scalable microfluidic metering method that allows protein crystal growth by free interface diffusion, PNAS 99(26):16531-16536.
Harada, 1993, Monoclonal antibody G6K12 specific for membrane-associated differentiation marker of human stratified squamous epithelia and squamous cell carcinoma, J. Oral Pathol. Med 22(4):145-152.
Harder, 1994, Characterization and kinetic analysis of the intracellular domain of human protein tyrosine phosphatase beta (HPTP beta) using synthetic phosphopeptides, Biochem J 298 (Pt 2): 395-401.
Harries, 2006, A Numerical Model for Segmented Flow in a Microreactor, Int J of Heat and Mass Transfer, 46:3313-3322.
Harris, 2008, Single-molecule DNA sequencing of a viral genome, Science 320(5872):106-109.
Harrison, 1993, Micromachining a miniaturized capillary electrophoresis-based chemical analysis system on a chip, Science 261(5123):895-897.
Hasina, 2003, Plasminogen activator inhibitor-2: a molecular biomarker for head and neck cancer progression, Cancer Research 63:555-559.
Haynes, 2012, Digital PCR: A Technology Primer, Principles of Digital PCR and Measurement Issues: The certification of Cytomegalovirus Standard Reference Material (SRM 2366) as a model for future SRMs, National Institute of Standards and Tecnology, San Diego, CA, 4 pages.
Hayward, 2006, Dewetting Instability during the Formation of Polymersomes from BloceCopolymer-Stabilized Double Emulsions, Langmuir, 22(10): 4457-4461.
He, 2005, Selective encapsulation of single cells and subcellular organelles into picoliter- and femtoliter-volume droplets, Anal Chem 77(6):1539-1544.
Head, 2014, Library construction for next generation sequencing, Biotech Rap Disp 56(2):61.
Heim, 1996, Engineering Green Fluorescent Protein for Improved Brightness, Longer Wavelengths and Fluorescence Response Energy Transfer, Carr. Biol, 6(2): 178-182.
Hellman, 2009, Differential tissue-specific protein markers of vaginal carcinoma, Br J Cancer, 100(8): 1303-131.
Henrich, 2012, Low-level detection and quantitation of cellular HIV-1 DNA and 2-ILTR circles using droplet dPCR, J Virol Meth 186(1-2):68-72.

(56) References Cited

OTHER PUBLICATIONS

Hergenrother, 2000, Small-Molecule Microarrays: Covalent Attachment and Screening of Alcohol-Containing Small Molecules on Glass Slides, J. Am. Chem. Soc, 122: 7849-7850.
Soumillion, 2001, Novel concepts for the selection of catalytic activity. Curr Op Biotech 12:387-394.
Spiro, 2000, A bead-based method for multiplexed identification and quantitation of DNA sequences using flow cytometry, Appl Env Micro 66:4258-4265.
Sproat, 1987, The synthesis of protected 5'-mercapto-2',5'-dideoxyribonucleoside-3'-0-phosphorainidites, uses of 5'-mercapto-oligodeoxyribonucleotides, Nucleic Acids Res 15:4837-4848.
Squires, 2005, Microfluidics: fluid physics at the nanoliter scale, Rev Mod Phys 77:977-1026.
Stauber, 1993, Rapid generation of monoclonal antibody-secreting hybridomas against African horse sickness virus by in vitro immunization and the fusion/cloning technique, J Immunol Meth 161(2):157-168.
Stemmer, 1994, DNA shuffling by random fragmentation and reassembly: in vitro recombination for molecular evolution. PNAS 91(22):10747-51.
Stemmer, 1994, Rapid evolution of a protein in vitro by DNA shuffling, Nature 370(6488):389-91.
Stober, 1998, Controlled growth of monodisperse silica spheres in the micron size range, J Colloid Interface Sci 26(1):62-69.
Stofko, 1992, A single step purification for recombinant proteins, Febs Lett 302:274-278.
Stone, 2004, Engineering flows in small devices: microfluidics toward a lab-on-a-chip, Ann Rev Fluid Mech 36:381-441.
Strizhkov, 2000, PCR amplification on a microarray of gel-immobilized oligonucleotides: Detection of bacterial toxin- and drug-resistant genes and their mutations, BioTechniques 29(4):844-857.
Strommenger, 2003, Multiplex PCR assay for simultaneous detection of nine clinicly relevant antibiotic resistance genes in *S aureus*, J Clin Microb 41(9):4089-4094.
Stroock, 2002, Chaotic mixer for microchannels, Science 295(5555):647-651.
Studer, 1997, Fluorous synthesis: a fluorous-phase strategy for improving separation efficiency in organic synthesis, Science 275:823-826.
Sugiura, 2001, Interfacial tension driven monodispersed droplet formation from mtcrofabricated channel array, Langmuir 17:5562-5566.
Sugiura, 2002, Effect of channel structure on microchannel emuisification, Langmuir 18:5708-5712.
Sundberg, 1995, Spatially-addressable immobilisation of macromolecules on solid supports, J Am Chem Soc 117:12050-12057.
Sung, 2005, Chip-based microfluidic devices coupled with electrospray ionization-mass spectrometry, Electrophoresis 26:1783-1791.
Sutcliffe, 1986, Dynamics of UV laser ablation of organic polymer surfaces, J Appl Phys 60(9):3315-3322.
Suzuki, 1996, Random mutagenesis of thermus aquaticus DNA polmerase I: concordance of immutable sites in vivo with the crystal structure, PNAS 93:96701-9675.
Syed, 2009, Next-generation sequencing library preparation: simultaneous fragmentation and tagging using in vitro transposition, Nat Meth 6:1-2.
Takayama, 1999, Patterning cells and their environmnets using multiple laminar fluid flows in cappillary networks, PNAS 96:5545-5548.
Takeuchi, 2005, An axisymmetric flow-focusing microfluidic device, Adv Mater 17(8):1067-1072.
Taly, 2007, Droplets as microreactors for high-throughput biology, Chembiochem 8(3):263-272.
Tan, 2003, Controlled fission of droplet emulsions in bifurcating microfluidic channels, 12th Int Conf SSAM 28-31.
Tan, 2003, Microfluidic liposome generation from monodisperse droplet emulsion, Summer Bioeng Conf, Florida, 2 pages.
Tan, 2003, Monodisperse droplet emulsions in co-flow microfluidic channels, Micro TAS, 2 pages.
Tan, 2004, Design of microluidic channel geometries for the control of droplet volume, chemical concentration, and sorting, Lab Chip 4(4):292-298.
Tang, 2009, A multi-color fast-switching microfluidic droplet dye laser, Lab Chip 9:2767-2771.
Taniguchi, 2002, Chemical reactions in microdroplets by electrostatic manipulation of droplets in liquid media, Lab Chip 2:19-23.
Tawfik, 1998, Man-made cell-like compartments for molecular evolution, Nat Biotech 7(16):652-56.
Taylor, 1934, The formation of emulsions in definable field of flow, Proc R Soc London A 146(858):501-523.
Taylor, 1991, Characterization of chemisorbed monolayers by surface potential measurments, J Phys D Appl Phys 24:1443.
Tencza, 2000, Development of a fluorescence polarization-based diagnostic assay for equine infectious anemia virus, J Clin Microbiol 38(5):1854-185.
Terray, 2002, Fabrication of linear colloidal structures for microfluidic applications, Applied Phys Lett 81(9):1555-1557.
Terray, 2002, Microfluidic control using colloidal devices, Science 296(5574):1841-1844.
Tewhey, 2009, Microdroplet based PCR environment for large scale targeted sequence, Nat Biotech 27(11):1025-1031.
Theberge, 2010, Microdroplets in microfluidics: an evolving platform for discoveries in chemistry and biology, Angew Chem Int Ed 49(34):5846-5868.
Thompson, 1983, Introduction to Lithography, ACS Symp Ser 219:1-13.
Thorsen, 2001, Dynamic pattern formation in a vesicle-generating microfluidic device, Phys Rev Lett 86(18):4163-4166.
Thorsen, 2002, Microfluidic large-scale integration, Science 298:580-584.
Thorsen, 2003, Microlluidic technologies for highthroughput screening applications, California Institute of Technology.
Tice, 2003, Formation of droplets and mixing in multiphase microfluidics at low values of the reynolds and the capillary numbers, Langmuir 19:9127-9133.
Tice, 2004, Effects of viscosity on droplet formation and mixing in microfluidic channels, Analytica Chimica Acta 507:73-77.
Titomanlio, 1990, Capillary experiments of flow induced crystallization of HDPE, AIChe J 36(1):13-18.
Tleugabulova, 2004, Evaluating formation and growth mechanisms of silica particles using fluorescence anisotropy decay analysis, Langmuir 20(14):5924-5932.
Tokatlidis, 1995, Nascent chains: folding and chaperone infraction during elongation on ribosomes, Philos Trans R Soc Lond B Biol Sci, 348:89-95.
Tokeshi, 2002, Continuous-flow chemical processing on a microchip by combining microunit operations and a multiphase flow network, Anal Chem 74(7):1565-1571.
Tokumitsu, 1999, Preparation of gadopentetic acid-loaded chitosan microparticles for gadolinium neutron-capture therapy of cancer by a novel emulsion-droplet coalescence technique, Chem Pharm Bull 47(6):838-842.
Tonelli et al., 2002, Perfluoropolyether functional oligomers: unusual reactivity in organic chemistry, Journal of fluorine Chemistry, 118; 107-121.

* cited by examiner

METHODS FOR FORMING MIXED DROPLETS

RELATED APPLICATION

The present application is a continuation of U.S. patent application Ser. No. 15/171,616, filed Jun. 2, 2016, which is a continuation of U.S. patent application Ser. No. 13/371,222, filed Feb. 10, 2012, which claims the benefit of and priority to U.S. provisional application Ser. No. 61/441,985, filed Feb. 11, 2011, the content of which is incorporated by reference herein in its entirety.

FIELD OF THE INVENTION

The invention generally relates to methods for forming mixed droplets.

BACKGROUND

Microfluidics involves micro-scale devices that handle small volumes of fluids. Because microfluidics can accurately and reproducibly control and dispense small fluid volumes, in particular volumes less than 1 μl, application of microfluidics provides significant cost-savings. The use of microfluidics technology reduces cycle times, shortens time-to-results, and increases throughput. Furthermore, incorporation of microfluidics technology enhances system integration and automation.

Microfluidic reactions are generally conducted in microdroplets. The ability to conduct reactions in microdroplets depends on being able to merge different sample fluids and different microdroplets. A controlled modification of a chemical composition of the microdroplets is of crucial importance to the success of biochemical assays. Generally, conducting reactions in microdroplets involves merging a pair of pre-made microdroplets of different compositions, resulting in the formation of a mixed droplet that carries a mix of components needed for a particular assay. For example, in the context of PCR, a first droplet carries sample nucleic acid and a second droplet carries reagents necessary for conducting the PCR reaction (e.g., polymerase enzyme, forward and reverse primers, dNTPs buffer, and salts). Merging of the droplets produces a mixed droplet containing sample nucleic acid and PCR reagents so that the PCR reaction may be conducted in the microdroplet.

This mixing approach requires pre-emulsification of two liquid phases and a subsequent careful matching of pairs of the two different types of droplets for the purpose of achieving an optimal merge ratio of 1:1, which leads to sub-optimally merged droplets, and thus sub-optimal reactions or assays.

SUMMARY

Methods of the invention provide an approach to merging two liquid dispersed phases in which only one phase needs to reach a merge area in a form of a droplet. The other phase is injected into these drops directly from a continuous stream. In this manner, methods of the invention provide a simplified and more reliable approach to sample fluid mixing because only one of the two phases is dispersed as a droplet prior to its merge with the other phase.

In certain aspects, methods of the invention involve forming a sample droplet. Any technique known in the art for forming sample droplets may be used with methods of the invention. An exemplary method involves flowing a stream of sample fluid such that it intersects two opposing streams of flowing carrier fluid. The carrier fluid is immiscible with the sample fluid. Intersection of the sample fluid with the two opposing streams of flowing carrier fluid results in partitioning of the sample fluid into individual sample droplets. The carrier fluid may be any fluid that is immiscible with the sample fluid. An exemplary carrier fluid is oil. In certain embodiments, the carrier fluid includes a surfactant, such as a fluorosurfactant.

Methods of the invention further involve contacting the droplet with a fluid stream. Contact between the two droplet and the fluid stream results in a portion of the fluid stream integrating with the droplet to form a mixed droplet.

Methods of the invention may be conducted in microfluidic channels. As such, in certain embodiments, methods of the invention may further involve flowing the droplet through a first channel and flowing the fluid stream through a second channel. The first and second channels are oriented such that the channels intersect each other. Any angle that results in an intersection of the channels may be used. In a particular embodiment, the first and second channels are oriented perpendicular to each other.

Methods of the invention may further involve applying an electric field to the droplet and the fluid stream. The electric field assists in rupturing the interface separating the two sample fluids. In particular embodiments, the electric field is a high-frequency electric field.

In another aspect, methods of the invention involve forming a droplet surrounded by an immiscible carrier fluid, flowing the droplet through a first channel, contacting the droplet with a fluid stream in the presence of an electric field, in which contact between the droplet and the fluid stream in the presence of an electric field results in a portion of the fluid stream integrating with the droplet to form a mixed droplet.

BRIEF DESCRIPTION OF THE DRAWINGS

FIG. 3A shows a non-perpendicular orientation of the two channels at the merge site. FIGS. 3B-E shows a perpendicular orientation of the two channels at the merge site.

FIG. 4 also shows that an insulating layer may optionally be placed between the channels and the electrodes.

FIG. 7A is with electrodes and FIG. 7B is without electrodes.

FIG. 9 shows an embodiment that employs an electric field to facilitate droplet merging.

FIG. 12A shows the droplet approaching the growing bolus of the second fluid stream. FIG. 12B shows the droplet merging and mixing with the bolus of the second fluid stream.

DETAILED DESCRIPTION

The invention generally relates to methods for forming mixed droplets. In certain embodiments, methods of the invention involve forming a droplet, and contacting the droplet with a fluid stream, such that a portion of the fluid stream integrates with the droplet to form a mixed droplet.

Sample droplets may be formed by any method known in the art. The sample droplet may contain any molecule for a biological assay or any molecule for a chemical reaction. The type of molecule in the sample droplet is not important and the invention is not limited to any particular type of sample molecules. In certain embodiments, the sample droplet contains nucleic acid molecules. In certain embodiments, droplets are formed such that the droplets contain, on average, a single target nucleic acid. The droplets are aqueous droplets that are surrounded by an immiscible carrier fluid. Methods of forming such droplets are shown for example in Link et al. (U.S. patent application numbers 2008/0014589, 2008/0003142, and 2010/0137163), Stone et al. (U.S. Pat. No. 7,708,949 and U.S. patent application number 2010/0172803), Anderson et al. (U.S. Pat. No. 7,041,481 and which reissued as U.S. Pat. No. RE41,780) and European publication number EP2047910 to Raindance Technologies Inc. The content of each of which is incorporated by reference herein in its entirety.

Figure 1A:
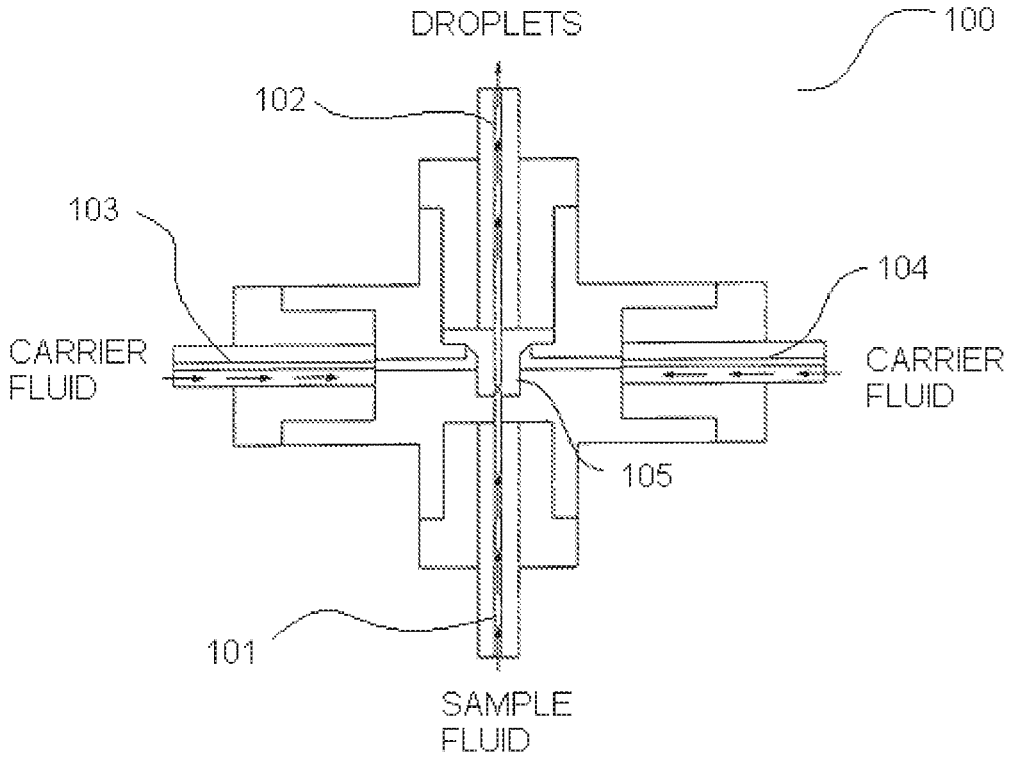
FIGS. 1A-B shows an exemplary embodiment of a device for droplet formation.
Figure 1B:
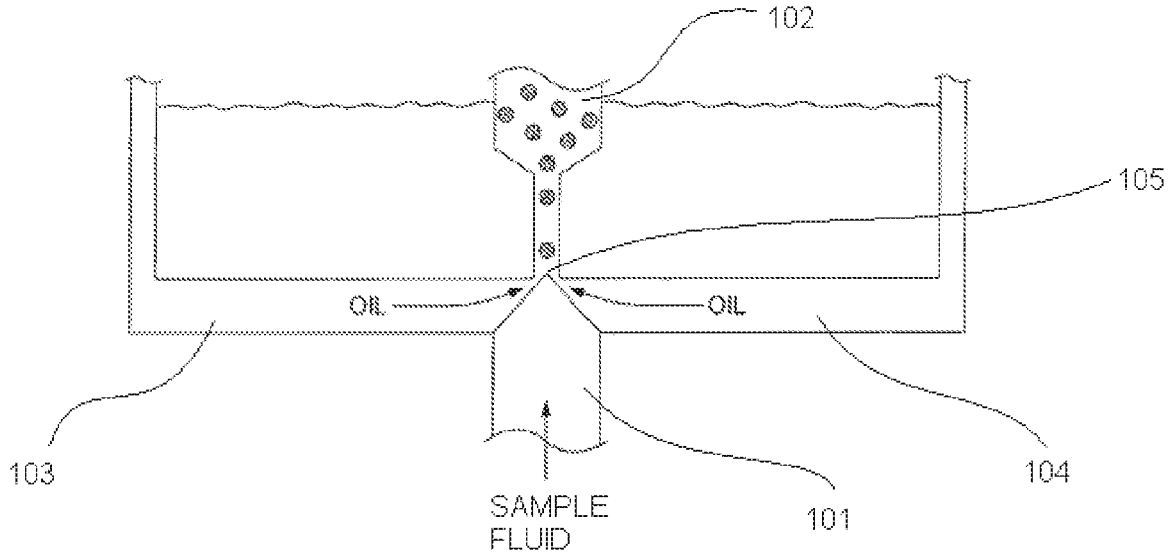

FIGS. 1A-B show an exemplary embodiment of a device 100 for droplet formation. Device 100 includes an inlet channel 101, and outlet channel 102, and two carrier fluid channels 103 and 104. Channels 101, 102, 103, and 104 meet at a junction 105. Inlet channel 101 flows sample fluid to the junction 105. Carrier fluid channels 103 and 104 flow a carrier fluid that is immiscible with the sample fluid to the junction 105. Inlet channel 101 narrows at its distal portion wherein it connects to junction 105 (See FIG. 1B). Inlet channel 101 is oriented to be perpendicular to carrier fluid channels 103 and 104. Droplets are formed as sample fluid flows from inlet channel 101 to junction 105, where the sample fluid interacts with flowing carrier fluid provided to the junction 105 by carrier fluid channels 103 and 104. Outlet channel 102 receives the droplets of sample fluid surrounded by carrier fluid.

The sample fluid is typically an aqueous buffer solution, such as ultrapure water (e.g., 18 mega-ohm resistivity, obtained, for example by column chromatography), 10 mM Tris HCl and 1 mM EDTA (TE) buffer, phosphate buffer saline (PBS) or acetate buffer. Any liquid or buffer that is physiologically compatible with nucleic acid molecules can be used. The carrier fluid is one that is immiscible with the sample fluid. The carrier fluid can be a non-polar solvent, decane (e.g., tetradecane or hexadecane), fluorocarbon oil, silicone oil or another oil (for example, mineral oil).

In certain embodiments, the carrier fluid contains one or more additives, such as agents which reduce surface tensions (surfactants). Surfactants can include Tween, Span, fluorosurfactants, and other agents that are soluble in oil relative to water. In some applications, performance is improved by adding a second surfactant to the sample fluid. Surfactants can aid in controlling or optimizing droplet size, flow and uniformity, for example by reducing the shear force needed to extrude or inject droplets into an intersecting channel. This can affect droplet volume and periodicity, or the rate or frequency at which droplets break off into an intersecting channel. Furthermore, the surfactant can serve to stabilize aqueous emulsions in fluorinated oils from coalescing.

In certain embodiments, the droplets may be coated with a surfactant. Preferred surfactants that may be added to the carrier fluid include, but are not limited to, surfactants such as sorbitan-based carboxylic acid esters (e.g., the "Span" surfactants, Fluka Chemika), including sorbitan monolaurate (Span 20), sorbitan monopalmitate (Span 40), sorbitan monostearate (Span 60) and sorbitan monooleate (Span 80), and perfluorinated polyethers (e.g., DuPont Krytox 157 FSL, FSM, and/or FSH). Other non-limiting examples of non-ionic surfactants which may be used include polyoxyethylenated alkylphenols (for example, nonyl-, p-dodecyl-, and dinonylphenols), polyoxyethylenated straight chain alcohols, polyoxyethylenated polyoxypropylene glycols, polyoxyethylenated mercaptans, long chain carboxylic acid esters (for example, glyceryl and polyglyceryl esters of natural fatty acids, propylene glycol, sorbitol, polyoxyethylenated sorbitol esters, polyoxyethylene glycol esters, etc.) and alkanolamines (e.g., diethanolamine-fatty acid condensates and isopropanolamine-fatty acid condensates).

In certain embodiments, the carrier fluid may be caused to flow through the outlet channel so that the surfactant in the carrier fluid coats the channel walls. In one embodiment, the fluorosurfactant can be prepared by reacting the perflourinated polyether DuPont Krytox 157 FSL, FSM, or FSH with aqueous ammonium hydroxide in a volatile fluorinated solvent. The solvent and residual water and ammonia can be removed with a rotary evaporator. The surfactant can then be dissolved (e.g., 2.5 wt %) in a fluorinated oil (e.g., Flourinert (3M)), which then serves as the carrier fluid.

After formation of the sample droplet from the first sample fluid, the droplet is contacted with a flow of a second sample fluid stream. Contact between the droplet and the fluid stream results in a portion of the fluid stream integrating with the droplet to form a mixed droplet.

Figure 2A:
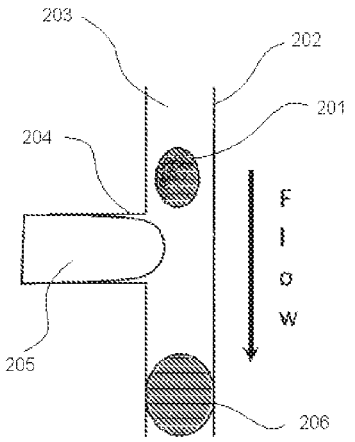
FIGS. 2A-C shows an exemplary embodiment of merging two sample fluids according to methods of the invention.
Figure 2B:
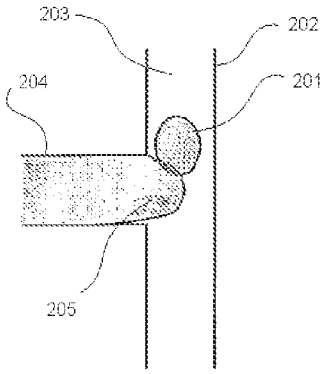
Figure 2C:
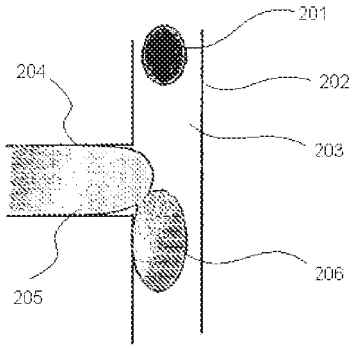
Figure 3A:
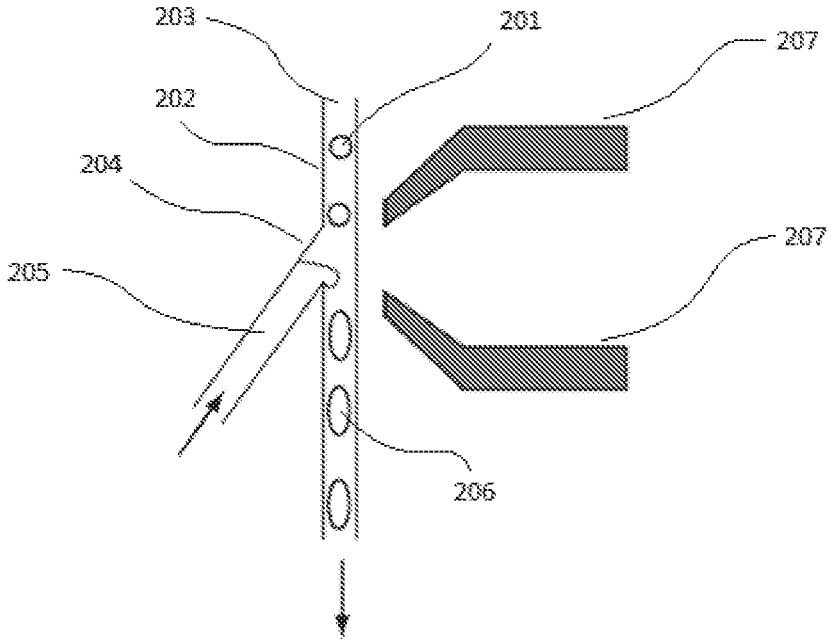
FIGS. 3A-E show embodiments in which electrodes are used with methods of the invention to facilitate droplet merging. These figures show different positioning and different numbers of electrodes that may be used with methods of the invention.

FIGS. 2A-C provide a schematic showing merging of sample fluids according to methods of the invention. Droplets 201 of the first sample fluid flow through a first channel 202 separated from each other by immiscible carrier fluid and suspended in the immiscible carrier fluid 203. The droplets 201 are delivered to the merge area, i.e., junction of the first channel 202 with the second channel 204, by a pressure-driven flow generated by a positive displacement pump. While droplet 201 arrives at the merge area, a bolus of a second sample fluid 205 is protruding from an opening of the second channel 204 into the first channel 202 (FIG. 2A). FIGS. 2A-C and 3B show the intersection of channels 202 and 204 as being perpendicular. However, any angle that results in an intersection of the channels 202 and 204 may be used, and methods of the invention are not limited to the orientation of the channels 202 and 204 shown in FIGS. 2A-C. For example, FIG. 3A shows an embodiment in which channels 202 and 204 are not perpendicular to each other. The droplets 201 shown in FIGS. 2A-C are monodispersive, but non-monodispersive drops are useful in the context of the invention as well.

Figure 12A:
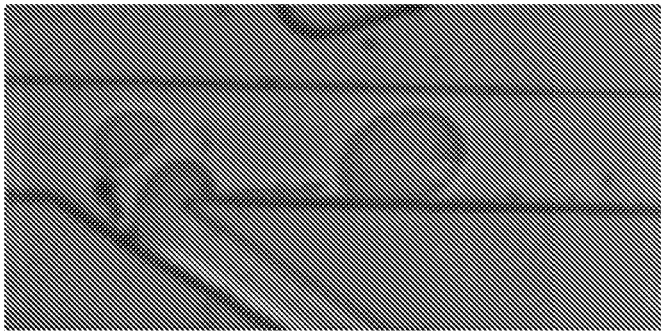
FIGS. 12A-B show a set of photographs showing an arrangement that was employed to form a mixed droplet in which a droplet of a first fluid was brought into contact with a bolus of a second sample fluid stream, in which the bolus was segmented from the second fluid stream and merged with the droplet to form a mixed droplet in an immiscible carrier fluid.
Figure 12B:
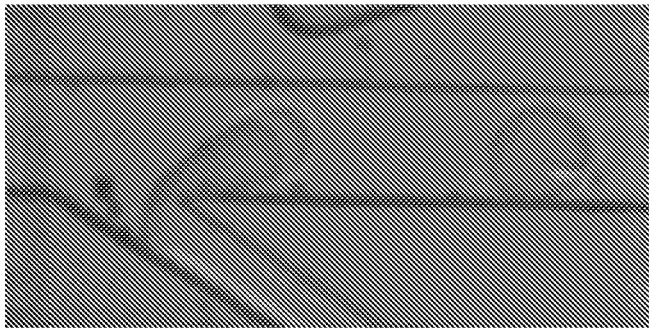

The bolus of the second sample fluid stream 205 continues to increase in size due to pumping action of a positive displacement pump connected to channel 204, which outputs a steady stream of the second sample fluid 205 into the merge area. The flowing droplet 201 containing the first sample fluid eventually contacts the bolus of the second sample fluid 205 that is protruding into the first channel 202. Contact between the two sample fluids results in a portion of the second sample fluid 205 being segmented from the second sample fluid stream and joining with the first sample fluid droplet 201 to form a mixed droplet 206 (FIGS. 2B-C). FIGS. 12A-B show an arrangement that was employed to form a mixed droplet in which a droplet of a first fluid was brought into contact with a bolus of a second sample fluid stream, in which the bolus was segmented from the second fluid stream and merged with the droplet to form a mixed droplet in an immiscible carrier fluid. FIG. 12A shows the droplet approaching the growing bolus of the second fluid stream. FIG. 12B shows the droplet merging and mixing with the bolus of the second fluid stream. In certain embodiments, each incoming droplet 201 of first sample fluid is merged with the same amount of second sample fluid 205.

In order to achieve the merge of the first and second sample fluids, the interface separating the fluids must be ruptured. In certain embodiments, this rupture can be achieved through the application of an electric charge. In certain embodiments, the rupture will result from application of an electric field. In certain embodiments, the rupture will be achieved through non-electrical means, e.g. by hydrophobic/hydrophilic patterning of the surface contacting the fluids.

Figure 3B:
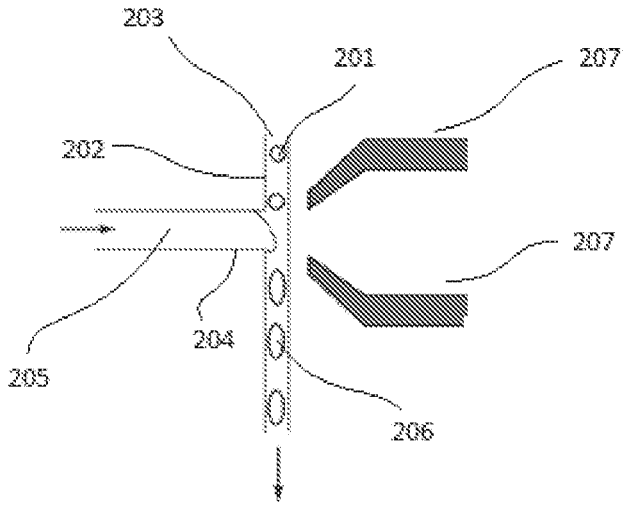
Figure 3C:
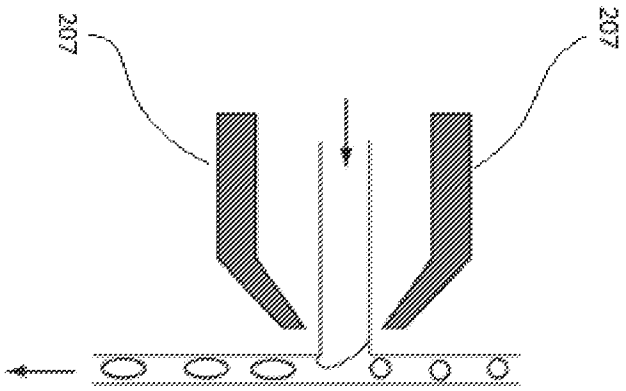
Figure 3D:
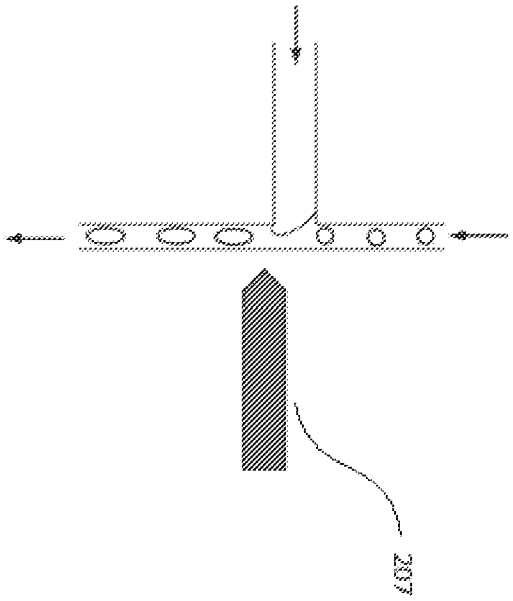
Figure 3E:
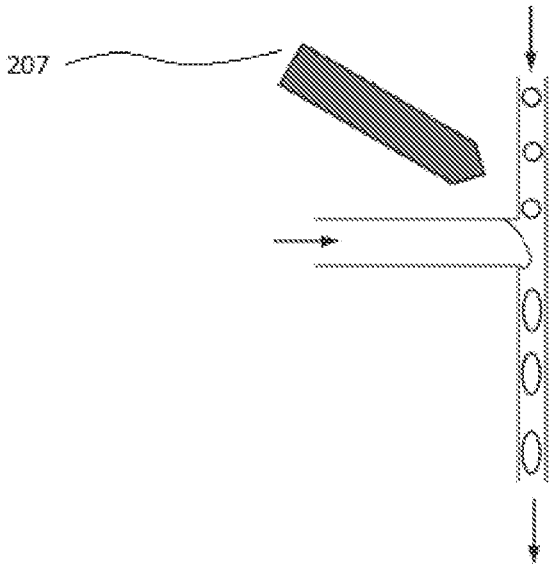
Figure 4:
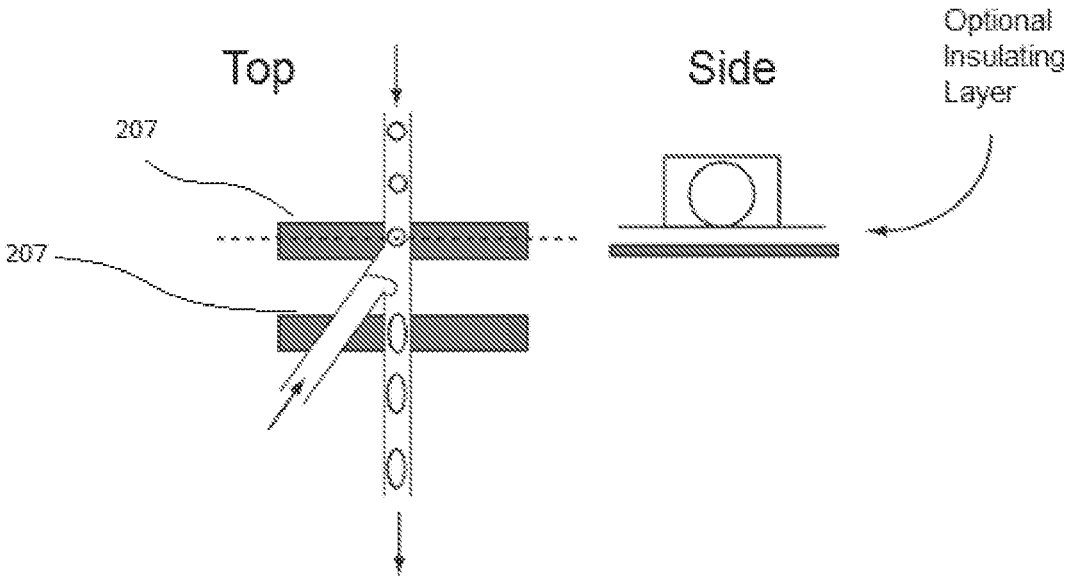
FIG. 4 shows an embodiment in which the electrodes are positioned beneath the channels.

In certain embodiments, an electric charge is applied to the first and second sample fluids (FIGS. 3A-E). Any number of electrodes may be used with methods of the invention in order to apply an electric charge. FIGS. 3A-C show embodiments that use two electrodes 207. FIGS. 3D-E show embodiments that use one electrode 207. The electrodes 207 may positioned in any manner and any orientation as long as they are in proximity to the merge region. In FIGS. 3A-B and D, the electrodes 207 are positioned across from the merge junction. In FIGS. 3C and E, the electrodes 207 are positioned on the same side as the merge junction. In certain embodiments, the electrodes are located below the channels (FIG. 4). In certain embodiments, the electrodes are optionally separated from the channels by an insulating layer (FIG. 4).

Description of applying electric charge to sample fluids is provided in Link et al. (U.S. patent application number 2007/0003442) and European Patent Number EP2004316 to Raindance Technologies Inc, the content of each of which is incorporated by reference herein in its entirety. Electric charge may be created in the first and second sample fluids within the carrier fluid using any suitable technique, for example, by placing the first and second sample fluids within an electric field (which may be AC, DC, etc.), and/or causing a reaction to occur that causes the first and second sample fluids to have an electric charge, for example, a chemical reaction, an ionic reaction, a photocatalyzed reaction, etc.

The electric field, in some embodiments, is generated from an electric field generator, i.e., a device or system able to create an electric field that can be applied to the fluid. The electric field generator may produce an AC field (i.e., one that varies periodically with respect to time, for example, sinusoidally, sawtooth, square, etc.), a DC field (i.e., one that is constant with respect to time), a pulsed field, etc. The electric field generator may be constructed and arranged to create an electric field within a fluid contained within a channel or a microfluidic channel. The electric field generator may be integral to or separate from the fluidic system containing the channel or microfluidic channel, according to some embodiments.

Techniques for producing a suitable electric field (which may be AC, DC, etc.) are known to those of ordinary skill in the art. For example, in one embodiment, an electric field is produced by applying voltage across a pair of electrodes, which may be positioned on or embedded within the fluidic system (for example, within a substrate defining the channel or microfluidic channel), and/or positioned proximate the fluid such that at least a portion of the electric field interacts with the fluid. The electrodes can be fashioned from any suitable electrode material or materials known to those of ordinary skill in the art, including, but not limited to, silver, gold, copper, carbon, platinum, tungsten, tin, cadmium, nickel, indium tin oxide ("ITO"), etc., as well as combinations thereof. In some cases, transparent or substantially transparent electrodes can be used.

The electric field facilitates rupture of the interface separating the second sample fluid 205 and the droplet 201. Rupturing the interface facilitates merging of the bolus of the second sample fluid 205 and the first sample fluid droplet 201 (FIG. 2B). The forming mixed droplet 206 continues to increase in size until it a portion of the second sample fluid 205 breaks free or segments from the second sample fluid stream prior to arrival and merging of the next droplet containing the first sample fluid (FIG. 2C). The segmenting of the portion of the second sample fluid from the second sample fluid stream occurs as soon as the force due to the shear and/or elongational flow that is exerted on the forming mixed droplet 206 by the immiscible carrier fluid overcomes the surface tension whose action is to keep the segmenting portion of the second sample fluid connected with the second sample fluid stream. The now fully formed mixed droplet 206 continues to flow through the first channel 206.

Figure 5:
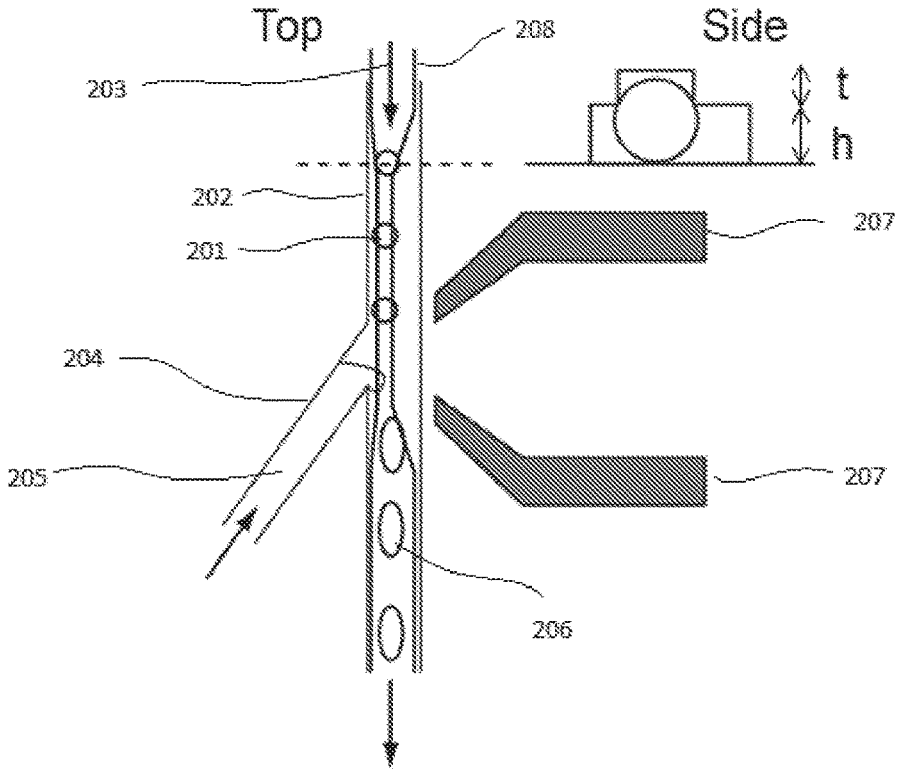
FIG. 5 shows an embodiment of forming a mixed droplet in the presence of electric charge and with use of a droplet track.

FIG. 5 illustrates an embodiment in which a drop track 208 is used in conjunction with electrodes 207 to facilitate merging of a portion of the second fluid 205 with the droplet 201. Under many circumstances it is advantageous for microfluidic channels to have a high aspect ratio defined as the channel width divided by the height. One advantage is that such channels tend to be more resistant against clogging because the "frisbee" shaped debris that would otherwise be required to occlude a wide and shallow channel is a rare occurrence. However, in certain instances, high aspect ratio channels are less preferred because under certain conditions the bolus of liquid 205 emerging from the continuous phase channel into merge may dribble down the side of the merge rather than snapping off into clean uniform merged droplets 206.

An aspect of the invention that ensures that methods of the invention function optimally with high aspect ratio channels is the addition of droplets "tracks" 208 that both guide the droplets toward the emerging bolus 205 within the merger and simultaneously provides a microenvironment more suitable for the snapping mode of droplet generation. A droplet track 208 is a trench in the floor or ceiling of a conventional rectangular microfluidic channel that can be used either to improve the precision of steering droplets within a microfluidic channel and also to steer droplets in directions normally inaccessible by flow alone. The track could also be included in a side wall. FIG. 5 shows a cross-section of a channel with a droplet track 208. The channel height (marked "h") is the distance from the channel floor to the ceiling/bottom of the track 208, and the track height is the distance from the bottom of the track to the channel floor ceiling (marked "t"). Thus the total height within the track is the channel height plus the track height. In a preferred embodiment, the channel height is substantially smaller than the diameter of the droplets contained within the channel, forcing the droplets into a higher energy "squashed" conformation. Such droplets that encounter a droplet track 208 will expand into the track spontaneously, adopting a lower energy conformation with a lower surface area to volume ratio. Once inside a track, extra energy is required to displace the droplet from the track back into the shallower channel. Thus droplets will tend to remain inside tracks along the floor and ceiling of microfluidic channels even as they are dragged along with the carrier fluid in flow. If the direction along the droplet track 208 is not parallel to the direction of flow, then the droplet experiences both a drag force in the direction of flow as well as a component perpendicular to the flow due to surface energy of the droplet within the track. Thus the droplet within a track can displace at an angle relative to the direction of flow which would otherwise be difficult in a conventional rectangular channel.

Figure 6:
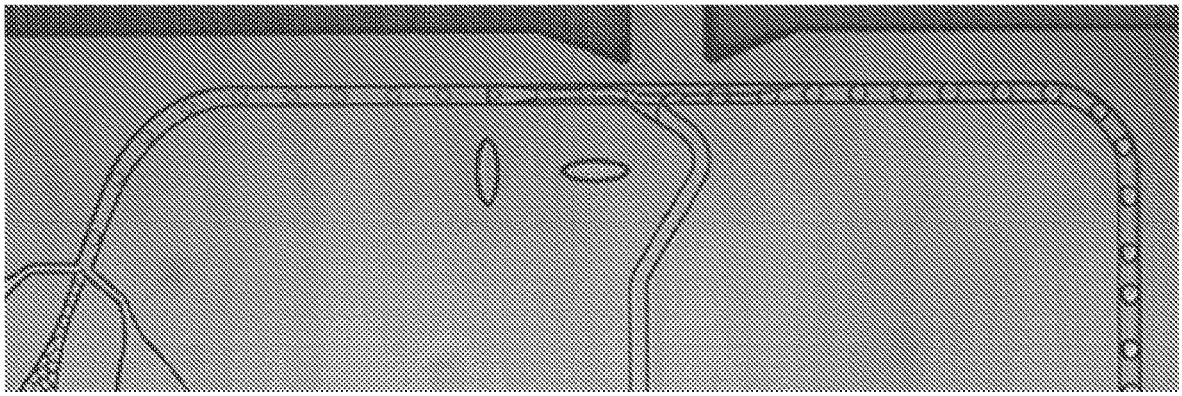
FIG. 6 shows a photograph capturing real-time formation of mixed droplets in the presence of electric charge and with use of a droplet track.
Figure 13A:
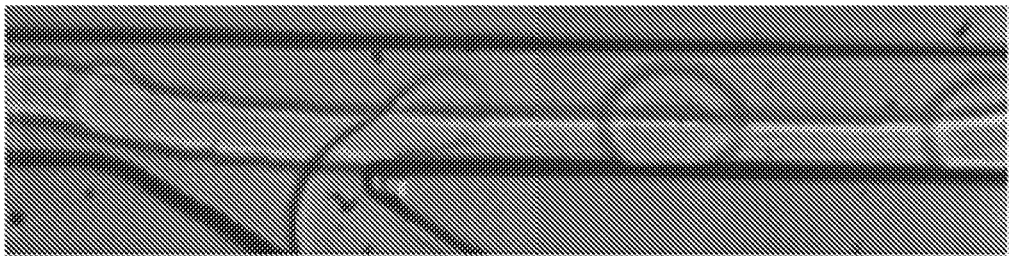
FIGS. 13A-B show a droplet track that was employed with methods of the invention to steer droplets away from the center streamlines and toward the emerging bolus of the second fluid on entering the merge area. These figures show that a mixed droplet was formed without the presence of electric charge and with use of a droplet track.
Figure 13B:
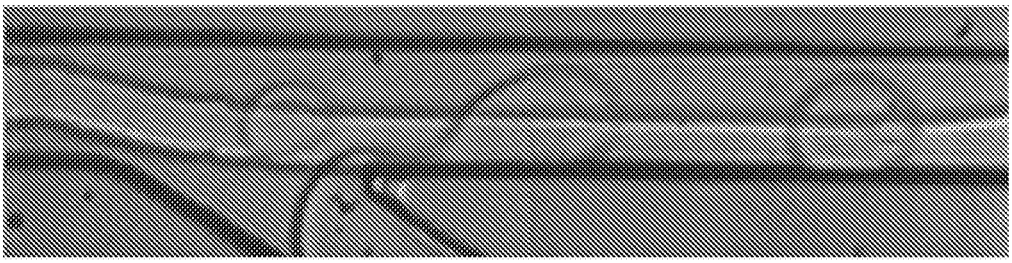

In FIG. 5, droplets 201 of the first sample fluid flow through a first channel 202 separated from each other by immiscible carrier fluid and suspended in the immiscible carrier fluid 203. The droplets 201 enter the droplet track 208 which steers or guides the droplets 201 close to the where the bolus of the second fluid 205 is emerging from the second channel 204. The steered droplets 201 in the droplet track 208 are delivered to the merge area, i.e., junction of the first channel 202 with the second channel 204, by a pressure-driven flow generated by a positive displacement pump. While droplet 201 arrives at the merge area, a bolus of a second sample fluid 205 is protruding from an opening of the second channel 204 into the first channel 202. The bolus of the second sample fluid stream 205 continues to increase in size due to pumping action of a positive displacement pump connected to channel 204, which outputs a steady stream of the second sample fluid 205 into the merge area. The flowing droplet 201 containing the first sample fluid eventually contacts the bolus of the second sample fluid 205 that is protruding into the first channel 202. The contacting happens in the presence of electrodes 207, which provide an electric charge to the merge area, which facilitates the rupturing of the interface separating the fluids. Contact between the two sample fluids in the presence of the electric change results in a portion of the second sample fluid 205 being segmented from the second sample fluid stream and joining with the first sample fluid droplet 201 to form a mixed droplet 206. The now fully formed mixed droplet 206 continues to flow through the droplet trap 208 and through the first channel 203. FIG. 6 shows a droplet track that was employed with methods of the invention to steer droplets away from the center streamlines and toward the emerging bolus of the second fluid on entering the merge area. This figure shows that a mixed droplet was formed in the presence of electric charge and with use of a droplet track. FIGS. 13A-B show a droplet track that was employed with methods of the invention to steer droplets away from the center streamlines and toward the emerging bolus of the second fluid on entering the merge area. These figures show that a mixed droplet was formed without the presence of electric charge and with use of a droplet track.

Figure 7A:
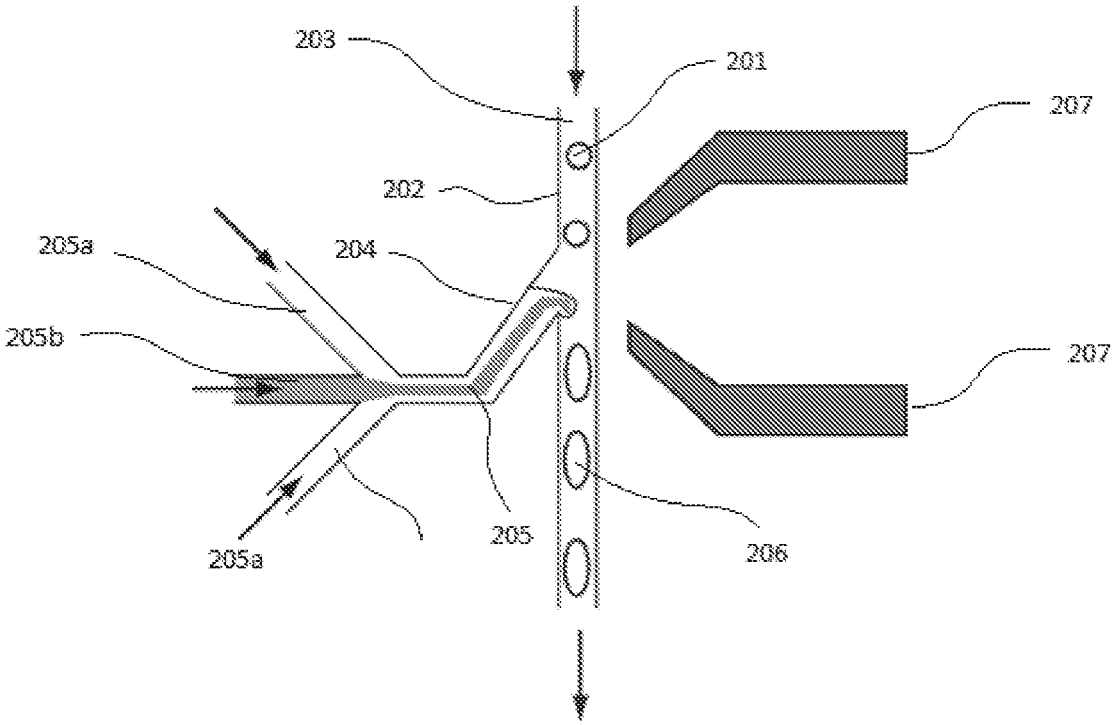
FIGS. 7A-B show an embodiment in which the second sample fluid includes multiple co-flowing streams of different fluids.
Figure 7B:
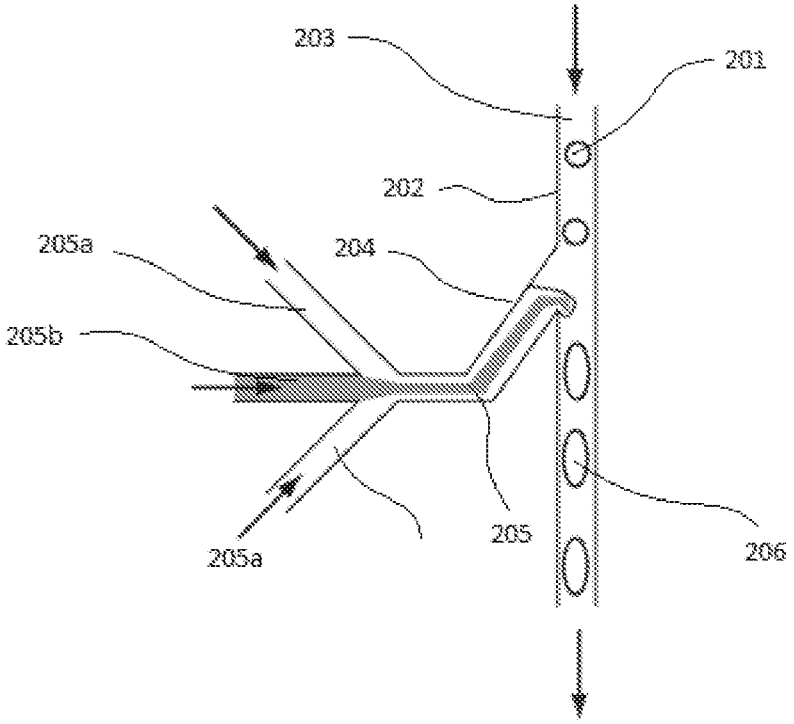

In certain embodiments, the second sample fluid 205 may consist of multiple co-flowing streams of different fluids. Such embodiments are shown in FIGS. 7A-B. FIG. 7A is with electrodes and FIG. 7B is without electrodes. In this embodiments, sample fluid 205 is a mixture of two different sample fluids 205*a* and 205*b*. Samples fluids 205*a* and 205*b* mix upstream in channel 204 and are delivered to the merge area as a mixture. A bolus of the mixture then contacts droplet 201. Contact between the mixture in the presence or absence of the electric change results in a portion of the mixed second sample fluid 205 being segmented from the mixed second sample fluid stream and joining with the first sample fluid droplet 201 to form a mixed droplet 206. The now fully formed mixed droplet 206 continues to flow through the through the first channel 203.

Figure 8:
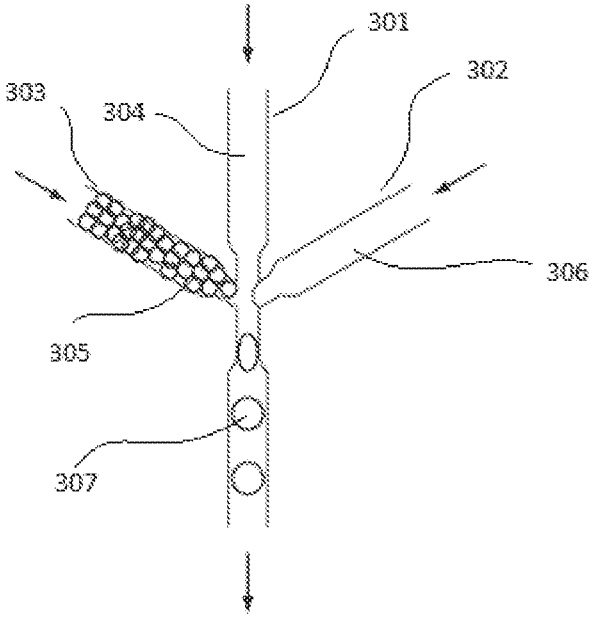
FIG. 8 shows a three channel embodiment for forming mixed droplets. This figure shows an embodiment without the presence of an electric field.
Figure 9:
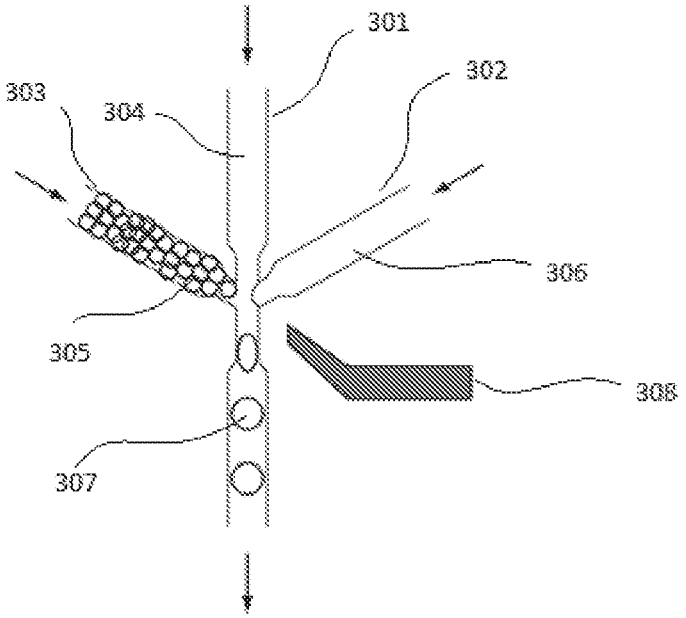
FIG. 9 shows a three channel embodiment for forming mixed droplets.

FIG. 8 shows a three channel embodiment. In this embodiment, channel 301 is flowing immiscible carrier fluid 304. Channels 302 and 303 intersect channel 301. FIG. 8 shows the intersection of channels 301-303 as not being perpendicular, and angle that results in an intersection of the channels 301-303 may be used. In other embodiments, the intersection of channels 301-303 is perpendicular. Channel 302 include a plurality of droplets 305 of a first sample fluid, while channel 303 includes a second sample fluid stream 306. In certain embodiments, a droplet 305 is brought into contact with a bolus of the second sample fluid 306 in channel 301 under conditions that allow the bolus of the second sample fluid 306 to merge with the droplet 305 to forma mixed droplet 307 in channel 301 that is surrounded by carrier fluid 304. In certain embodiments, the merging is in the presence of an electric charge provided by electrode 308 (FIG. 9). In certain embodiments, channel 301 narrows in the regions in proximity to the intersection of channels 301-303. However, such narrowing is not required and the described embodiments can be performed without a narrowing of channel 301.

Figure 10:
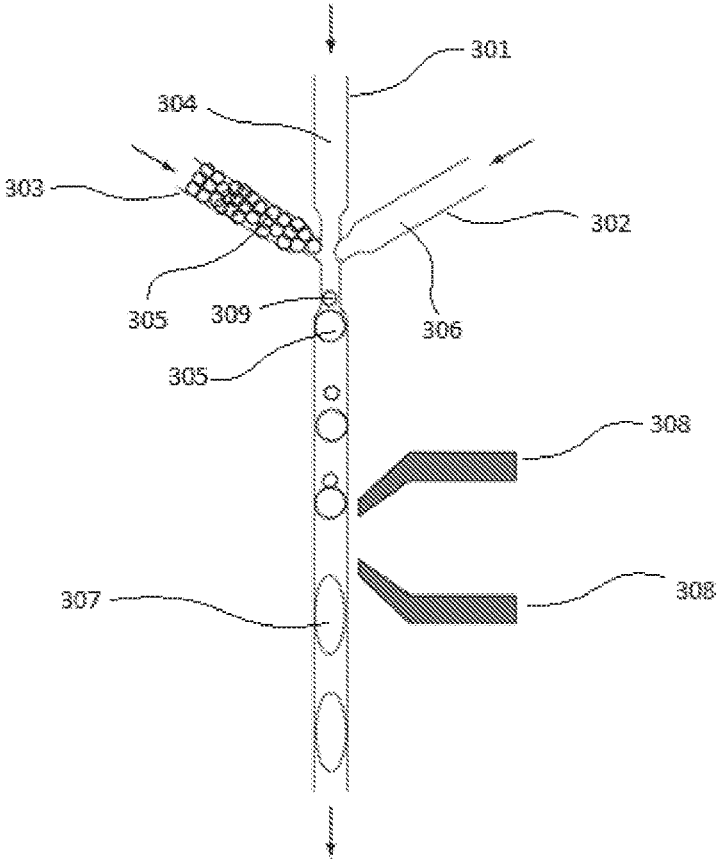
FIG. 10 shows a three channel embodiment for forming mixed droplets. This figure shows a droplet not merging with a bolus of the second sample fluid. Rather, the bolus of the second sample fluid enters the channel as a droplet and merges with a droplet of the first sample fluid at a point past the intersection of the channels.

In certain embodiments, it is desirable to cause the droplet 305 and the bolus of the second sample fluid 306 to enter channel 301 without merging, as shown in FIG. 10. In these embodiments, the bolus of the second sample fluid 306 breaks-off from the second sample fluid stream and forms a droplet 309. Droplet 309 travels in the carrier fluid 304 with droplet 305 that has been introduced to channel 301 from channel 303 until conditions in the channel 301 are adjusted such that droplet 309 is caused to merge with droplet 305. Such a change in conditions can be turbulent flow, change in hydrophobicity, or as shown in FIG. 10, application of an electric charge from an electrode 308 to the fluids in channel 301. Application of the electric charge, causes droplets 309 and 305 to merge and form mixed droplet 307.

Figure 11A:
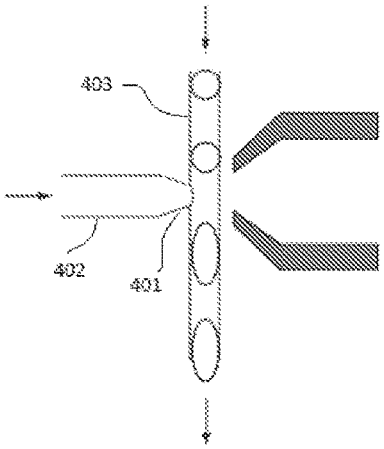
FIGS. 11A-C show embodiments in which the size of the orifice at the merge point for the channel through which the second sample fluid flows may be the smaller, the same size as, or larger than the cross-sectional dimension of the channel through which the immiscible carrier fluid flows.
Figure 11B:
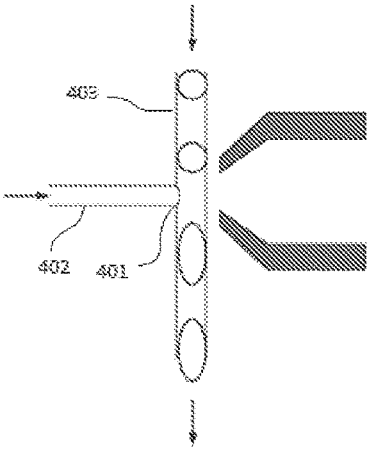
Figure 11C:
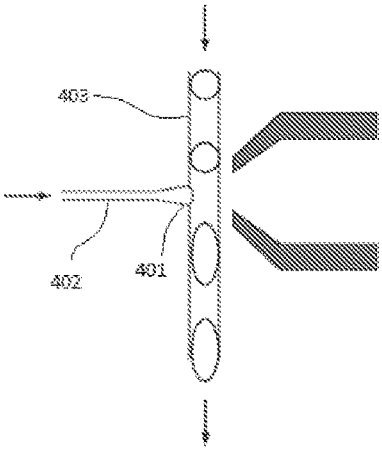

In embodiments of the invention, the size of the orifice at the merge point for the channel through which the second sample fluid flows may be the smaller, the same size as, or larger than the cross-sectional dimension of the channel through which the immiscible carrier fluid flows. FIGS. 11A-C illustrate these embodiments. FIG. 11A shows an embodiment in which the orifice 401 at the merge point for the channel 402 through which the second sample fluid flows is smaller than the cross-sectional dimension of the channel 403 through which the immiscible carrier fluid flows. In these embodiments, the orifices 401 may have areas that are 90% or less than the average cross-sectional dimension of the channel 403. FIG. 11B shows an embodiment in which the orifice 401 at the merge point for the channel 402 through which the second sample fluid flows is the same size as than the cross-sectional dimension of the channel 403 through which the immiscible carrier fluid flows. FIG. 11C shows an embodiment in which the orifice 401 at the merge point for the channel 402 through which the second sample fluid flows is larger than the cross-sectional dimension of the channel 403 through which the immiscible carrier fluid flows.

Methods of the invention may be used for merging sample fluids for conducting any type of chemical reaction or any type of biological assay. In certain embodiments, methods of the invention are used for merging sample fluids for conducting an amplification reaction in a droplet. Amplification refers to production of additional copies of a nucleic acid sequence and is generally carried out using polymerase chain reaction or other technologies well known in the art (e.g., Dieffenbach and Dveksler, PCR Primer, a Laboratory Manual, Cold Spring Harbor Press, Plainview, N.Y. [1995]). The amplification reaction may be any amplification reaction known in the art that amplifies nucleic acid molecules, such as polymerase chain reaction, nested polymerase chain reaction, polymerase chain reaction-single strand conformation polymorphism, ligase chain reaction (Barany F. (1991) PNAS 88:189-193; Barany F. (1991) PCR Methods and Applications 1:5-16), ligase detection reaction (Barany F. (1991) PNAS 88:189-193), strand displacement amplification and restriction fragments length polymorphism, transcription based amplification system, nucleic acid sequence-based amplification, rolling circle amplification, and hyper-branched rolling circle amplification.

In certain embodiments, the amplification reaction is the polymerase chain reaction. Polymerase chain reaction (PCR) refers to methods by K. B. Mullis (U.S. Pat. Nos. 4,683,195 and 4,683,202, hereby incorporated by reference) for increasing concentration of a segment of a target sequence in a mixture of genomic DNA without cloning or purification. The process for amplifying the target sequence includes introducing an excess of oligonucleotide primers to a DNA mixture containing a desired target sequence, followed by a precise sequence of thermal cycling in the presence of a DNA polymerase. The primers are complementary to their respective strands of the double stranded target sequence.

To effect amplification, primers are annealed to their complementary sequence within the target molecule. Following annealing, the primers are extended with a polymerase so as to form a new pair of complementary strands. The steps of denaturation, primer annealing and polymerase extension can be repeated many times (i.e., denaturation, annealing and extension constitute one cycle; there can be numerous cycles) to obtain a high concentration of an amplified segment of a desired target sequence. The length of the amplified segment of the desired target sequence is determined by relative positions of the primers with respect to each other, and therefore, this length is a controllable parameter.

Methods for performing PCR in droplets are shown for example in Link et al. (U.S. patent application numbers 2008/0014589, 2008/0003142, and 2010/0137163), Anderson et al. (U.S. Pat. No. 7,041,481 and which reissued as U.S. Pat. No. RE41,780) and European publication number EP2047910 to Raindance Technologies Inc. The content of each of which is incorporated by reference herein in its entirety.

The first sample fluid contains nucleic acid templates. Droplets of the first sample fluid are formed as described above. Those droplets will include the nucleic acid templates. In certain embodiments, the droplets will include only a single nucleic acid template, and thus digital PCR can be conducted. The second sample fluid contains reagents for the PCR reaction. Such reagents generally include Taq polymerase, deoxynucleotides of type A, C, G and T, magnesium chloride, and forward and reverse primers, all suspended within an aqueous buffer. The second fluid also includes detectably labeled probes for detection of the amplified target nucleic acid, the details of which are discussed below. This type of partitioning of the reagents between the two sample fluids is not the only possibility. In certain embodiments, the first sample fluid will include some or all of the reagents necessary for the PCR reaction whereas the second sample fluid will contain the balance of the reagents necessary for the PCR reaction together with the detection probes.

Primers can be prepared by a variety of methods including but not limited to cloning of appropriate sequences and direct chemical synthesis using methods well known in the art (Narang et al., Methods Enzymol., 68:90 (1979); Brown et al., Methods Enzymol., 68:109 (1979)). Primers can also be obtained from commercial sources such as Operon Technologies, Amersham Pharmacia Biotech, Sigma, and Life Technologies. The primers can have an identical melting temperature. The lengths of the primers can be extended or shortened at the 5' end or the 3' end to produce primers with desired melting temperatures. Also, the annealing position of each primer pair can be designed such that the sequence and, length of the primer pairs yield the desired melting temperature. The simplest equation for determining the melting temperature of primers smaller than 25 base pairs is the Wallace Rule ($Td=2(A+T)+4(G+C)$). Computer programs can also be used to design primers, including but not limited to Array Designer Software (Arrayit Inc.), Oligonucleotide Probe Sequence Design Software for Genetic Analysis (Olympus Optical Co.), NetPrimer, and DNAsis from Hitachi Software Engineering. The TM (melting or annealing temperature) of each primer is calculated using software programs such as Oligo Design, available from Invitrogen Corp.

A droplet containing the nucleic acid is then caused to merge with the PCR reagents in the second fluid according to methods of the invention described above, producing a droplet that includes Taq polymerase, deoxynucleotides of type A, C, G and T, magnesium chloride, forward and reverse primers, detectably labeled probes, and the target nucleic acid.

Once mixed droplets have been produced, the droplets are thermal cycled, resulting in amplification of the target nucleic acid in each droplet. In certain embodiments, the droplets are flowed through a channel in a serpentine path between heating and cooling lines to amplify the nucleic acid in the droplet. The width and depth of the channel may be adjusted to set the residence time at each temperature, which can be controlled to anywhere between less than a second and minutes.

In certain embodiments, the three temperature zones are used for the amplification reaction. The three temperature zones are controlled to result in denaturation of double stranded nucleic acid (high temperature zone), annealing of primers (low temperature zones), and amplification of single stranded nucleic acid to produce double stranded nucleic acids (intermediate temperature zones). The temperatures within these zones fall within ranges well known in the art for conducting PCR reactions. See for example, Sambrook et al. (Molecular Cloning, A Laboratory Manual, 3rd edition, Cold Spring Harbor Laboratory Press, Cold Spring Harbor, N.Y., 2001).

In certain embodiments, the three temperature zones are controlled to have temperatures as follows: 95° C. ($T_H$), 55° C. ($T_L$), 72° C. ($T_M$). The prepared sample droplets flow through the channel at a controlled rate. The sample droplets first pass the initial denaturation zone ($T_H$) before thermal cycling. The initial preheat is an extended zone to ensure that nucleic acids within the sample droplet have denatured successfully before thermal cycling. The requirement for a preheat zone and the length of denaturation time required is dependent on the chemistry being used in the reaction. The samples pass into the high temperature zone, of approximately 95° C., where the sample is first separated into single stranded DNA in a process called denaturation. The sample then flows to the low temperature, of approximately 55° C., where the hybridization process takes place, during which the primers anneal to the complementary sequences of the sample. Finally, as the sample flows through the third medium temperature, of approximately 72° C., the polymerase process occurs when the primers are extended along the single strand of DNA with a thermostable enzyme.

The nucleic acids undergo the same thermal cycling and chemical reaction as the droplets pass through each thermal cycle as they flow through the channel. The total number of cycles in the device is easily altered by an extension of thermal zones. The sample undergoes the same thermal cycling and chemical reaction as it passes through N amplification cycles of the complete thermal device.

In other embodiments, the temperature zones are controlled to achieve two individual temperature zones for a PCR reaction. In certain embodiments, the two temperature zones are controlled to have temperatures as follows: 95° C. ($T_H$) and 60° C. ($T_L$). The sample droplet optionally flows through an initial preheat zone before entering thermal cycling. The preheat zone may be important for some chemistry for activation and also to ensure that double stranded nucleic acid in the droplets is fully denatured before the thermal cycling reaction begins. In an exemplary embodiment, the preheat dwell length results in approximately 10 minutes preheat of the droplets at the higher temperature.

The sample droplet continues into the high temperature zone, of approximately 95° C., where the sample is first separated into single stranded DNA in a process called denaturation. The sample then flows through the device to the low temperature zone, of approximately 60° C., where the hybridization process takes place, during which the primers anneal to the complementary sequences of the sample. Finally the polymerase process occurs when the primers are extended along the single strand of DNA with a thermostable enzyme. The sample undergoes the same thermal cycling and chemical reaction as it passes through each thermal cycle of the complete device. The total number of cycles in the device is easily altered by an extension of block length and tubing.

After amplification, droplets may be flowed to a detection module for detection of amplification products. The droplets may be individually analyzed and detected using any methods known in the art, such as detecting for the presence or amount of a reporter. Generally, the detection module is in communication with one or more detection apparatuses. The detection apparatuses can be optical or electrical detectors or combinations thereof. Examples of suitable detection apparatuses include optical waveguides, microscopes, diodes, light stimulating devices, (e.g., lasers), photo multiplier tubes, and processors (e.g., computers and software), and combinations thereof, which cooperate to detect a signal representative of a characteristic, marker, or reporter, and to determine and direct the measurement or the sorting action at a sorting module. Further description of detection modules and methods of detecting amplification products in droplets are shown in Link et al. (U.S. patent application numbers 2008/0014589, 2008/0003142, and 2010/0137163) and European publication number EP2047910 to Raindance Technologies Inc.

In certain embodiments, amplified targets are detected using detectably labeled probes. In particular embodiments, the detectably labeled probes are optically labeled probes, such as fluorescently labeled probes. Examples of fluorescent labels include, but are not limited to, Atto dyes, 4-acetamido-4'-isothiocyanatostilbene-2,2'disulfonic acid; acridine and derivatives: acridine, acridine isothiocyanate; 5-(2'-aminoethyl)aminonaphthalene-1-sulfonic acid (EDANS); 4-amino-N-[3-vinylsulfonyl)phenyl]naphthalimide-3,5 disulfonate; N-(4-anilino-1-naphthyl)maleimide; anthranilamide; BODIPY; Brilliant Yellow; coumarin and derivatives; coumarin, 7-amino-4-methylcoumarin (AMC, Coumarin 120), 7-amino-4-trifluoromethylcouluarin (Coumaran 151); cyanine dyes; cyanosine; 4',6-diaminidino-2-phenylindole (DAPI); 5'5"-dibromopyrogallol-sulfonaphthalein (Bromopyrogallol Red); 7-diethylamino-3-(4'-isothiocyanatophenyl)-4-methylcoumarin; diethylenetriamine pentaacetate; 4,4'-diisothiocyanatodihydro-stilbene-2,2'-disulfonic acid; 4,4'-diisothiocyanatostilbene-2,2'-disulfonic acid; 5-[dimethylamino]naphthalene-1-sulfonyl chloride (DNS, dansylchloride); 4-dimethylaminophenylazophenyl-4'-isothiocyanate (DABITC); eosin and derivatives; eosin, eosin isothiocyanate, erythrosin and derivatives; erythrosin B, erythrosin, isothiocyanate; ethidium; fluorescein and derivatives; 5-carboxyfluorescein (FAM), 5-(4,6-dichlorotriazin-2-yl)aminofluorescein (DTAF), 2',7'-dimethoxy-4'5'-dichloro-6-carboxyfluorescein, fluorescein, fluorescein isothiocyanate, QFITC, (XRITC); fluorescamine; IR144; IR1446; Malachite Green isothiocyanate; 4-methylumbelliferoneortho cresolphthalein; nitrotyrosine; pararosaniline; Phenol Red; B-phycoerythrin; o-phthaldialdehyde; pyrene and derivatives: pyrene, pyrene butyrate, succinimidyl 1-pyrene; butyrate quantum dots; Reactive Red 4 (Cibacron™ Brilliant Red 3B-A) rhodamine and derivatives: 6-carboxy-X-rhodamine (ROX), 6-carboxyrhodamine (R6G), lissamine rhodamine B sulfonyl chloride rhodamine (Rhod), rhodamine B, rhodamine 123, rhodamine X isothiocyanate, sulforhodamine B, sulforhodamine 101, sulfonyl chloride derivative of sulforhodamine 101 (Texas Red); N,N,N',N'tetramethyl-6-carboxyrhodamine (TAMRA); tetramethyl rhodamine; tetramethyl rhodamine isothiocyanate (TRITC); riboflavin; rosolic acid; terbium chelate derivatives; Cy3; Cy5; Cy5.5; Cy7; IRD 700; IRD 800; La Jolta Blue; phthalo cyanine; and naphthalo cyanine. Preferred fluorescent labels are cyanine-3 and cyanine-5. Labels other than fluorescent labels are contemplated by the invention, including other optically-detectable labels.

During amplification, fluorescent signal is generated in a TaqMan assay by the enzymatic degradation of the fluorescently labeled probe. The probe contains a dye and quencher that are maintained in close proximity to one another by being attached to the same probe. When in close proximity, the dye is quenched by fluorescence resonance energy transfer to the quencher. Certain probes are designed that hybridize to the wild-type of the target, and other probes are designed that hybridize to a variant of the wild-type of the target. Probes that hybridize to the wild-type of the target have a different fluorophore attached than probes that hybridize to a variant of the wild-type of the target. The probes that hybridize to a variant of the wild-type of the target are designed to specifically hybridize to a region in a PCR product that contains or is suspected to contain a single nucleotide polymorphism or small insertion or deletion.

During the PCR amplification, the amplicon is denatured allowing the probe and PCR primers to hybridize. The PCR primer is extended by Taq polymerase replicating the alternative strand. During the replication process the Taq polymerase encounters the probe which is also hybridized to the same strand and degrades it. This releases the dye and quencher from the probe which are then allowed to move away from each other. This eliminates the FRET between the two, allowing the dye to release its fluorescence. Through each cycle of cycling more fluorescence is released. The amount of fluorescence released depends on the efficiency of the PCR reaction and also the kinetics of the probe hybridization. If there is a single mismatch between the probe and the target sequence the probe will not hybridize as efficiently and thus a fewer number of probes are degraded during each round of PCR and thus less fluorescent signal is generated. This difference in fluorescence per droplet can be detected and counted. The efficiency of hybridization can be affected by such things as probe concentration, probe ratios between competing probes, and the number of mismatches present in the probe.

Methods of the invention may further include sorting the mixed droplets based upon any chosen analytical criterion. A sorting module may be a junction of a channel where the flow of droplets can change direction to enter one or more other channels, e.g., a branch channel, depending on a signal received in connection with a droplet interrogation in the detection module. Typically, a sorting module is monitored and/or under the control of the detection module, and therefore a sorting module may correspond to the detection module. The sorting region is in communication with and is influenced by one or more sorting apparatuses.

A sorting apparatus includes techniques or control systems, e.g., dielectric, electric, electro-osmotic, (micro-) valve, etc. A control system can employ a variety of sorting techniques to change or direct the flow of molecules, cells, small molecules or particles into a predetermined branch channel. A branch channel is a channel that is in communication with a sorting region and a main channel. The main channel can communicate with two or more branch channels at the sorting module or branch point, forming, for example, a T-shape or a Y-shape. Other shapes and channel geometries may be used as desired. Typically, a branch channel receives droplets of interest as detected by the detection module and sorted at the sorting module. A branch channel can have an outlet module and/or terminate with a well or reservoir to allow collection or disposal (collection module or waste module, respectively) of the molecules, cells, small molecules or particles. Alternatively, a branch channel may be in communication with other channels to permit additional sorting.

A characteristic of a fluidic droplet may be sensed and/or determined in some fashion, for example, as described herein (e.g., fluorescence of the fluidic droplet may be determined), and, in response, an electric field may be applied or removed from the fluidic droplet to direct the fluidic droplet to a particular region (e.g. a channel). In certain embodiments, a fluidic droplet is sorted or steered by inducing a dipole in the uncharged fluidic droplet (which may be initially charged or uncharged), and sorting or steering the droplet using an applied electric field. The electric field may be an AC field, a DC field, etc. For example, a channel containing fluidic droplets and carrier fluid, divides into first and second channels at a branch point. Generally, the fluidic droplet is uncharged. After the branch point, a first electrode is positioned near the first channel, and a second electrode is positioned near the second channel. A third electrode is positioned near the branch point of the first and second channels. A dipole is then induced in the fluidic droplet using a combination of the electrodes. The combination of electrodes used determines which channel will receive the flowing droplet. Thus, by applying the proper electric field, the droplets can be directed to either the first or second channel as desired. Further description of droplet sorting is shown for example in Link et al. (U.S. patent application numbers 2008/0014589, 2008/0003142, and 2010/0137163) and European publication number EP2047910 to Raindance Technologies Inc.

Methods of the invention may further involve releasing amplified target molecules or reaction products from the droplets for further analysis. Methods of releasing molecules from the droplets are shown in for example in Link et al. (U.S. patent application numbers 2008/0014589, 2008/0003142, and 2010/0137163) and European publication number EP2047910 to Raindance Technologies Inc.

In certain embodiments, sample droplets are allowed to cream to the top of the carrier fluid. By way of non-limiting example, the carrier fluid can include a perfluorocarbon oil that can have one or more stabilizing surfactants. The droplet rises to the top or separates from the carrier fluid by virtue of the density of the carrier fluid being greater than that of the aqueous phase that makes up the droplet. For example, the perfluorocarbon oil used in one embodiment of the methods of the invention is 1.8, compared to the density of the aqueous phase of the droplet, which is 1.0.

The creamed liquids are then placed onto a second carrier fluid which contains a de-stabilizing surfactant, such as a perfluorinated alcohol (e.g. 1H,1H,2H,2H-Perfluoro-1-octanol). The second carrier fluid can also be a perfluorocarbon oil. Upon mixing, the aqueous droplets begins to coalesce, and coalescence is completed by brief centrifugation at low speed (e.g., 1 minute at 2000 rpm in a microcentrifuge). The coalesced aqueous phase can now be removed and further analyzed.

In certain embodiments, the reaction product is an amplified nucleic acid that is then sequenced. In a particular embodiment, the sequencing is single-molecule sequencing-by-synthesis. Single-molecule sequencing is shown for example in Lapidus et al. (U.S. Pat. No. 7,169,560), Quake et al. (U.S. Pat. No. 6,818,395), Harris (U.S. Pat. No. 7,282,337), Quake et al. (U.S. patent application number 2002/0164629), and Braslaysky, et al., PNAS (USA), 100: 3960-3964 (2003), the contents of each of these references is incorporated by reference herein in its entirety.

Briefly, a single-stranded nucleic acid (e.g., DNA or cDNA) is hybridized to oligonucleotides attached to a surface of a flow cell. The single-stranded nucleic acids may be captured by methods known in the art, such as those shown in Lapidus (U.S. Pat. No. 7,666,593). The oligonucleotides may be covalently attached to the surface or various attachments other than covalent linking as known to those of ordinary skill in the art may be employed. Moreover, the attachment may be indirect, e.g., via the polymerases of the invention directly or indirectly attached to the surface. The surface may be planar or otherwise, and/or may be porous or non-porous, or any other type of surface known to those of ordinary skill to be suitable for attachment. The nucleic acid is then sequenced by imaging the polymerase-mediated addition of fluorescently-labeled nucleotides incorporated into the growing strand surface oligonucleotide, at single molecule resolution.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

The invention may be embodied in other specific forms without departing from the spirit or essential characteristics thereof. The foregoing embodiments are therefore to be considered in all respects illustrative rather than limiting on the invention described herein.

What is claimed is:

1. A microfluidic device comprising:

a substrate comprising at least a first channel, a second channel, and a merge area at a junction of the first channel with the second channel, the first channel comprising a droplet track configured to steer a droplet of a first fluid flowing therethrough away from a center streamline of the first channel and towards an emerging bolus of a second fluid on entering the merge area at the junction with the second channel to form a mixed droplet comprising the first fluid and the second fluid, wherein the microfluidic device does not include electrodes positioned to create an electric field in the junction.

2. The microfluidic device of claim 1, wherein the first channel and the second channel are substantially perpendicular to each other.

3. The microfluidic device of claim 1, wherein the first channel comprises at least one droplet comprising the first fluid.

4. The microfluidic device of claim 3, wherein the first channel comprises an immiscible carrier fluid surrounding the droplet.

5. The microfluidic device of claim 4, wherein the immiscible carrier fluid is an oil.

6. The microfluidic device of claim 5, wherein the oil comprises a surfactant.

7. The microfluidic device of claim 3, wherein the second channel comprises a fluid stream of the second fluid.

8. The microfluidic device of claim 1, wherein the bolus protrudes into the first channel.

9. The microfluidic device of claim 7, wherein the first fluid comprises nucleic acid templates.

10. The microfluidic device of claim 9, wherein the second fluid comprises reagents for a polymerase chain reaction.

11. The microfluidic device of claim 7, wherein the droplet comprises a single nucleic acid template.

12. The microfluidic device of claim 7, wherein the second fluid comprises one or more of Taq polymerase, deoxynucleotides, and forward and reverse primers.

* * * * *